US008460134B2

(12) United States Patent
Palomaki et al.

(10) Patent No.: US 8,460,134 B2
(45) Date of Patent: Jun. 11, 2013

(54) ARROW POINT ALIGNMENT SYSTEM

(75) Inventors: Teddy D. Palomaki, Park City, UT (US); Kenny R. Giles, West Valley City, UT (US); Ross M. Hinschberger, West Valley City, UT (US); Robert S. Mizek, Downers Grove, IL (US)

(73) Assignee: Easton Technical Products, Inc., Salt Lake City, UT (US)

( * ) Notice: Subject to any disclaimer, the term of this patent is extended or adjusted under 35 U.S.C. 154(b) by 0 days.

(21) Appl. No.: 13/269,277

(22) Filed: Oct. 7, 2011

(65) Prior Publication Data

US 2012/0028741 A1 Feb. 2, 2012

Related U.S. Application Data

(63) Continuation-in-part of application No. 12/815,311, filed on Jun. 14, 2010, now Pat. No. 8,262,518, which is a continuation of application No. 11/613,104, filed on Dec. 19, 2006, now Pat. No. 7,811,186.

(51) Int. Cl.
*F42B 6/08* (2006.01)

(52) U.S. Cl.
USPC ..... 473/582; 473/583

(58) Field of Classification Search
USPC ..... 473/578, 582, 583
See application file for complete search history.

(56) References Cited

U.S. PATENT DOCUMENTS

| | | | |
|---|---|---|---|
| 2,265,564 | A | 12/1941 | Klopsteg |
| 2,289,284 | A | 7/1942 | Chandler |
| 2,589,137 | A | 3/1952 | Ramsey |
| 2,905,470 | A | 9/1959 | Hoyt, Jr. |
| 2,925,278 | A | 2/1960 | Sweetland |
| 3,164,385 | A | 1/1965 | Shure |
| 3,401,938 | A | 9/1968 | Bear |
| 4,504,063 | A | 3/1985 | LeBus |
| 4,505,482 | A | 3/1985 | Martin, Sr. |
| 4,558,868 | A | 12/1985 | Musacchia |
| 4,706,965 | A | 11/1987 | Schaar |
| 4,874,180 | A | 10/1989 | Fingerson et al. |
| 4,944,520 | A | 7/1990 | Fingerson et al. |
| 5,417,439 | A | 5/1995 | Bickel |
| 5,496,043 | A | 3/1996 | Ester |
| 5,611,542 | A | 3/1997 | Saunders |
| 5,636,846 | A | 6/1997 | Tinsley |
| 5,921,875 | A | 7/1999 | Bickel |
| 6,077,180 | A | 6/2000 | Adams, Jr. |
| 6,290,903 | B1 | 9/2001 | Grace, Jr. et al. |
| 6,530,853 | B1 | 3/2003 | Giannetti |
| 6,605,012 | B2 | 8/2003 | Muller |

(Continued)

OTHER PUBLICATIONS

"Beman CCL System: the perfect match for carbon arrows," 1994 Beman Catalog, p. 19.

*Primary Examiner* — John Ricci
(74) *Attorney, Agent, or Firm* — Holland & Hart

(57) ABSTRACT

An arrow apparatus includes a hollow arrow shaft, an arrow point alignment structure, an arrow point, and a central connection member. The hollow arrow shaft has an outer surface, an interior, and a leading end surface. The arrow point alignment structure includes a tapered portion and is positioned on the outer surface of the arrow shaft at a location proximal of the leading end surface of the arrow shaft. The arrow point is in contact with the tapered portion of the arrow point alignment structure. The central connection member extends into the interior and in contact with the leading end surface.

49 Claims, 33 Drawing Sheets

U.S. PATENT DOCUMENTS

| | | | | |
|---|---|---|---|---|
| 6,726,581 | B2 | 4/2004 | Muller | |
| 6,739,992 | B2 | 5/2004 | Kummerle | |
| 6,939,258 | B2 | 9/2005 | Muller | |
| 7,004,859 | B2 | 2/2006 | Palomaki et al. | |
| 7,115,055 | B2 | 10/2006 | Palomaki et al. | |
| 7,811,186 | B2 | 10/2010 | Palomaki et al. | |
| 8,262,518 | B2 * | 9/2012 | Palomaki et al. | 473/582 |
| 2005/0181898 | A1 | 8/2005 | Muller | |
| 2006/0030439 | A1 | 2/2006 | Muller | |
| 2007/0037640 | A1 | 2/2007 | Rager | |

* cited by examiner

ARROW POINT ALIGNMENT SYSTEM

RELATED APPLICATIONS

This application is a continuation-in-part of and claims the benefit of U.S. patent application Ser. No. 12/815,311, filed on 14 Jun. 2010, now pending, which is a continuation of U.S. patent application Ser. No. 11/613,104, filed on 19 Dec. 2006, now, U.S. Pat. No. 7,811,186, issued on 22 Sep. 2010, the disclosures of which are incorporated herein in their entireties by this reference.

FIELD OF THE INVENTION

The instant disclosure relates generally to the field of arrow systems, such as hunting and target arrow systems.

BACKGROUND

Over the years, various arrows and arrow systems have been developed for use in hunting and sport archery. Conventional arrow systems typically comprise an arrow shaft, an arrow point (such as a field point or a broadhead) permanently or removably attached to the leading or distal end of the arrow shaft, and a nock provided at the trailing or proximal end of the arrow shaft. A plurality of vanes or other fletching are also typically secured to the trailing end of the arrow shaft to facilitate proper arrow flight.

In conventional field point arrow systems, a field point may be removably attached to the arrow shaft using one or more insert components. For example, an insert having a shank portion, a lip portion, and a threaded end portion may be affixed within a hollow arrow shaft by inserting the shank portion into the hollow arrow shaft until the lip portion of the insert abuts an end wall of the arrow shaft. A field point having a threaded aperture defined therein may then be threaded onto the threaded end of the insert until a wall of the field point seats against the lip portion of the insert. Removably attaching the field point to the arrow shaft in this manner enables archers to mix and match various field points and arrow shafts as may be required for differing hunting or sport archery applications.

Similarly, in conventional broadhead arrow systems, a broadhead may be removably attached to the arrow shaft using a component commonly known as a "ferrule," Conventional broadhead ferrules may comprise a shank portion having a threaded trailing end, a threaded leading end, and a conically shaped lip portion disposed between the leading and trailing ends. The ferrule may be attached to the arrow shaft by threading the threaded trailing end of the shank portion into a threaded bore located in the hollow arrow shaft until the flat end of the conically shaped lip portion abuts an end wall of the arrow shaft. A broadhead (which may comprise a plurality of blades extending from a common frontal point to a base, a tapered base collar connected to the base of each blade, and a threaded aperture defined in a central hub structure provided on the underside of each blade) may then be threaded onto the threaded leading end of the ferrule until the outer surface of the conically shaped lip portion is brought to bear against the inner surface of the tapered base collar, resulting in a tight engagement between the broadhead and the ferrule secured within the arrow shaft. As with conventional field point arrow systems, removably attaching the broadhead to the arrow shaft in this manner enables archers to mix and match various broadheads and arrow shafts as may be required for various hunting or sport archery applications.

In certain conventional arrow systems (including both field point and broadhead arrow systems), the precise axial alignment of the arrow point with the arrow shaft depends upon at least four different sets of interfacing surfaces, all of which have the potential to affect adversely the axial alignment of the arrow point with the arrow shaft. For example, in field point arrow systems, a first interfacing surface set may comprise the trailing end wall of the field point and the flat leading end surface of the lip portion of the insert. Another set may comprise the flat trailing end surface of the lip portion of the insert and the end wall of the leading end of the arrow shaft. An additional set may comprise the cylindrical outer surface of the insert and the inside surface of the arrow shaft. Finally, the threaded end of the insert and the threaded aperture defined in the field point may comprise a further set of interfacing surfaces. Similarly, in broadhead arrow systems, a first interfacing surface set may comprise the flat trailing end surface of the conically shaped lip portion of the ferrule and the end wall of the leading end of the arrow shaft. Another set may comprise the outer surface of the conically shaped lip portion and the inner surface of the tapered base collar. An additional set may comprise the threaded trailing end of the ferrule and the threaded bore defined in the arrow shaft. Finally, the threaded leading end of the ferrule and the threaded aperture defined in the central hub structure of the broadhead may comprise a further set of interfacing surfaces.

Because any one of the foregoing interfacing surfaces may adversely affect the axial alignment of the arrow point with the arrow shaft (and thus potentially adversely affect arrow flight and accuracy), significant costs may be expended in an attempt to manufacture precisely and align each respective component in conventional arrow systems. Accordingly, there exists a need for a simple, accurate, reliable, and cost-effective apparatus and method for aligning an arrow point with an arrow shaft arrow in an arrow apparatus.

SUMMARY

According to at least one embodiment, an arrow apparatus includes a hollow arrow shaft, an arrow point alignment structure, an arrow point, and a central connection member. The hollow arrow shaft has an outer surface, an inner cavity, and a leading end surface. The arrow point alignment structure may include a tapered portion and is positioned on the outer surface of the arrow shaft at a location proximal of the leading end surface of the arrow shaft. The arrow point is in contact with the tapered portion of the arrow point alignment structure. The central connection member extends into the inner cavity and contacts the leading end surface.

The entire arrow point alignment structure may be spaced proximally of the leading end surface of the arrow shaft. The central connection member may be permanently connected to the arrow point. The central connection member may include a shank portion and an abutment shoulder, wherein the shank portion includes a plurality of threads and the abutment shoulder is arranged to contact the leading end surface of the arrow shaft. The arrow apparatus may also include an insert disposed within the inner cavity of the arrow shaft at a location proximal of the leading end surface. The insert may be configured to releasably connect to the central connection member. The insert may include a proximal end and as distal end, wherein the distal end is spaced proximal of the leading end surface of the arrow shaft, and the proximal end of the insert is spaced proximally of a proximal end of the arrow point alignment structure. A proximal end of the insert may be spaced proximally of a proximal end of the arrow point alignment structure a distance at least as great as a diameter of the arrow shaft.

The arrow point alignment structure may be movable relative to the outer surface of the arrow shaft. The arrow point alignment structure may be connected to the arrow point with a snap-fit connection. The arrow point may be a broadhead and comprise a collar, wherein the collar is configured to receive and contact at least a tapered portion of the arrow point alignment structure. The collar may define a tapered surface arranged to contact the tapered portion of the arrow point alignment structure. The arrow point alignment structure may be in contact with the outer surface of the arrow shaft. The tapered surface of the collar may have a taper angle that is the same as a taper angle of the tapered portion of the arrow point alignment structure.

Another aspect of the present disclosure relates to an arrow point assembly for attachment to an arrow shaft. The arrow point assembly includes a leading end, a trailing end, a central connection portion, and a tapered aperture. The central connection portion has a threaded shaft and an abutment shoulder. The threaded shaft is insertable into an arrow shaft, and the abutment shoulder is arranged to contact a leading end surface of the arrow shaft. The tapered aperture is defined within the arrow point assembly proximate the trailing end and defines a tapered surface. The tapered surface of the tapered aperture is configured to contact a corresponding tapered surface of an arrow point alignment structure that is in contact with an outer surface of the arrow shaft.

The arrow point alignment structure may be connected to the arrow point assembly. The arrow point assembly may comprise a broadhead and a tapered collar that defines the tapered aperture. The abutment shoulder and tapered surface may be axially spaced apart.

The present disclosure is also directed to a method of assembling an arrow apparatus. The method includes providing a hollow arrow shaft, an arrow point, and an arrow point alignment structure, wherein the arrow shaft has an inner cavity, an outer surface, and a leading end surface. The arrow point includes axially spaced apart first and second contact points. The arrow point alignment structure has a tapered portion. The method also includes positioning the arrow point alignment structure spaced proximal of the leading end surface of the arrow shaft in contact with the outer surface of the arrow shaft, and positioning the arrow point in contact with the leading end surface of the arrow shaft at the first contact point and in contact with the tapered portion of the arrow point alignment structure at the second contact point to axially align the arrow point alignment structure with the arrow shaft.

The arrow point may include a tapered aperture defining a tapered surface within the arrow point, and positioning the arrow point in contact with the tapered portion of the arrow point alignment structure includes contacting the tapered portion of the arrow point alignment structure with the tapered surface. The method may also include providing an arrow shaft insert and a central connection member, wherein the central connection member is connected to the arrow point and has an abutment shoulder that defines the first contact point. The method may also include disposing the insert within the cavity of the arrow shaft spaced proximally of the leading end surface of the arrow shaft. The method may further include inserting the central connection member into the cavity of the arrow shaft and releasably connecting the central connection member with the insert. The method may include affixing the arrow point alignment structure to the arrow point. The method may include permanently affixing the central connection member to the arrow point Another aspect of the present disclosure relates to a broadhead arrow point assembly that includes a broadhead arrow point and an arrow point alignment structure. The broadhead arrow point has a threaded shank and a collar, wherein the collar defines a collar aperture. The arrow point alignment structure has a tapered portion that is in contact with the collar aperture. The arrow point alignment structure is configured to align axially the broadhead arrow point with an arrow shaft to which the broadhead arrow point is mounted.

The collar aperture may include a tapered surface that contacts the tapered portion of the arrow point alignment structure. The broadhead arrow point may be mounted to an arrow shaft, and the arrow point alignment structure may contact an outer surface of the arrow shaft. The broadhead arrow point may include a distal end portion and a proximal end portion, and the threaded shank extends proximally from the distal end portion with the collar being positioned at the distal end portion at a location axially spaced apart from the threaded shank. The arrow point alignment structure comprises a molded thermoplastic elastomer material.

Another aspect of the present disclosure relates to a method of assembling an arrow apparatus that includes providing an arrow shaft, an arrow point, and an arrow point alignment structure, the arrow shaft having an outer surface, the arrow point having a first tapered portion, the arrow point alignment structure having a second tapered portion. The method also includes positioning the arrow point alignment structure on the outer surface of the arrow shaft, inserting the arrow shaft through a portion of the arrow point to contact the first and second tapered portions, and threadably connecting the arrow point to the arrow shaft. As the arrow point is threadably connected to the arrow shaft, the arrow point alignment structure is urged proximally overcoming friction between the arrow point alignment structure and the outer surface of the arrow shaft until the arrow point attains an operation position relative to the arrow shaft.

The arrow point alignment structure may include a thermoplastic elastomer. When the arrow point is threadably removed from the arrow shaft, the arrow point alignment structure may maintain an axial position along the arrow shaft. The arrow point may include a threaded shank and the arrow shaft includes an insert having a threaded bore, wherein threadably connecting the arrow point to the arrow shaft includes threadably engaging the threaded shank with the threaded bore.

Another aspect of the present disclosure relates to an arrow apparatus that includes a hollow arrow shaft, an arrow point alignment structure, and a broadhead arrow point. The hollow arrow shaft has an outer surface, an interior, and a leading end. The arrow point alignment structure is positioned on the outer surface of the arrow shaft at a location spaced proximal of the leading end surface of the arrow shaft, and includes a tapered portion. The broadhead arrow point is supported at the leading end of the arrow shaft and at the tapered portion of the arrow point alignment structure.

The arrow point alignment structure may include a shoulder member positioned at a proximal end thereof, wherein the shoulder member defines a stop surface against which a proximal surface of the broadhead arrow contacts. The proximal surface of the broadhead arrow may contact the shoulder member to move the arrow point alignment structure axially when mounting the broadhead arrow point to the arrow shaft. The arrow point alignment structure may include Santoprene™ material. The broadhead arrow point may be void of ferrule structures. The arrow apparatus may further include an insert including a threaded bore and positioned within the interior of the arrow shaft, and the broadhead arrow point includes a threaded shank positioned distal of a proximal end of the broadhead arrow point that threadably engages the threaded bore of the insert.

The tapered portion of the arrow point alignment structure may include a continuous, smooth surface. The arrow point alignment structure may include an arrow bore sized to receive the arrow shaft and provide an interference fit with the outer surface of the arrow shaft. The arrow bore may be adjustable in diameter to fit arrow shafts of different outer diameter. The broadhead arrow point may include a threaded shank extending in a proximal direction, wherein the threaded shank includes a slot formed in a proximal end thereof sized to receive a screwdriver head.

Features from any of the above-mentioned embodiments may be used in combination with one another in accordance with the general principles described herein. These and other embodiments, features and advantages will be more fully understood upon reading the following detailed description in conjunction with the accompanying drawings and claims.

BRIEF DESCRIPTION OF THE DRAWINGS

The accompanying drawings illustrate a number of exemplary embodiments and are a part of the specification. Together with the following description, these drawings demonstrate and explain various principles of the instant disclosure.

Figure 1:
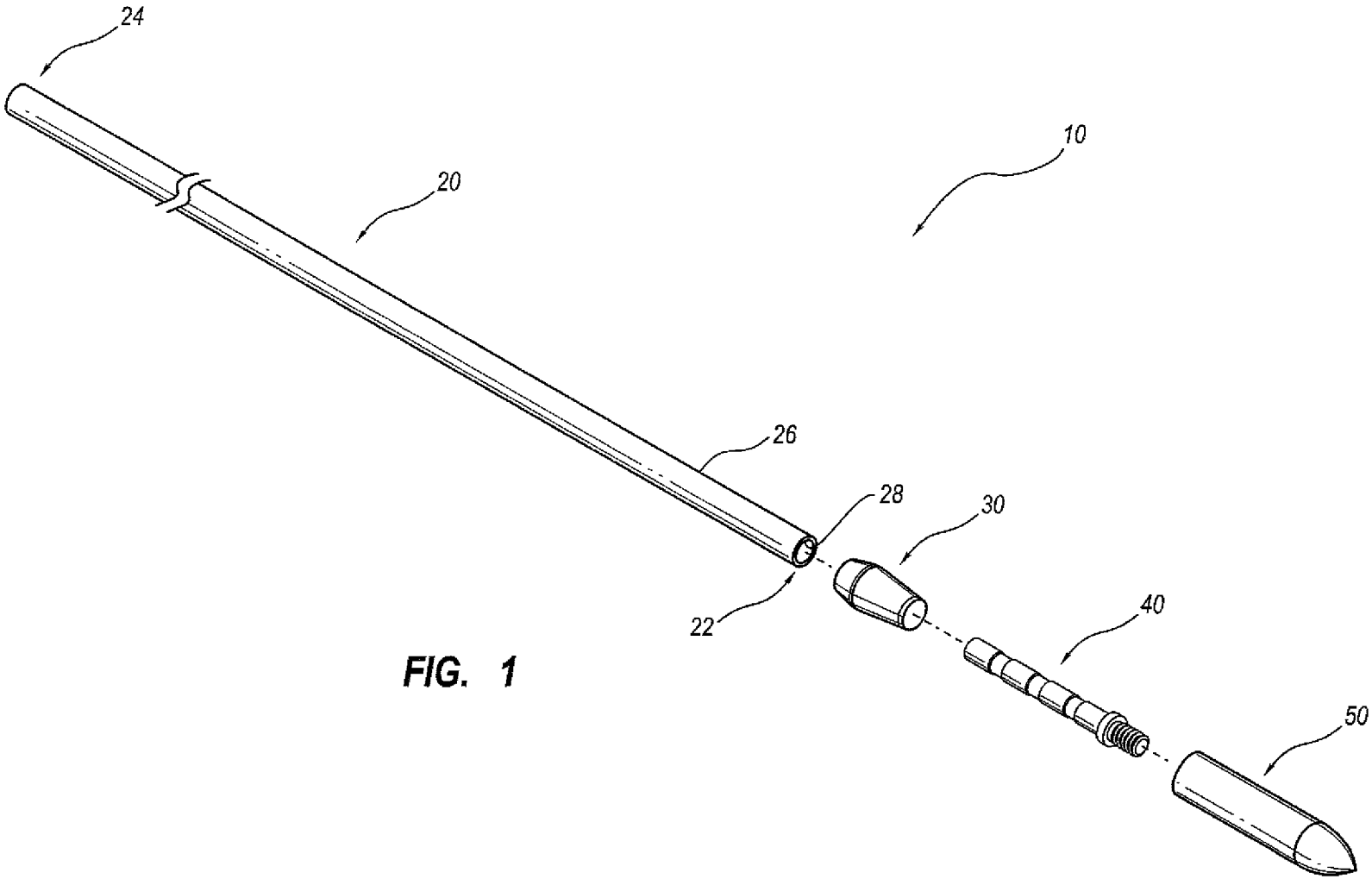
FIG. 1 is an exploded perspective view of an exemplary arrow apparatus according to at least one embodiment.

Throughout the drawings, identical reference characters and descriptions indicate similar, but not necessarily identical, elements. While the exemplary embodiments described herein are susceptible to various modifications and alternative forms, specific embodiments have been shown by way of example in the drawings and will be described in detail herein. However, one of skill in the art will understand that the exemplary embodiments described herein are not intended to be limited to the particular forms disclosed. Rather, the instant disclosure covers all modifications, equivalents, and alternatives falling within the scope defined by the appended claims.

DETAILED DESCRIPTION OF EXEMPLARY EMBODIMENTS

Figure 2:
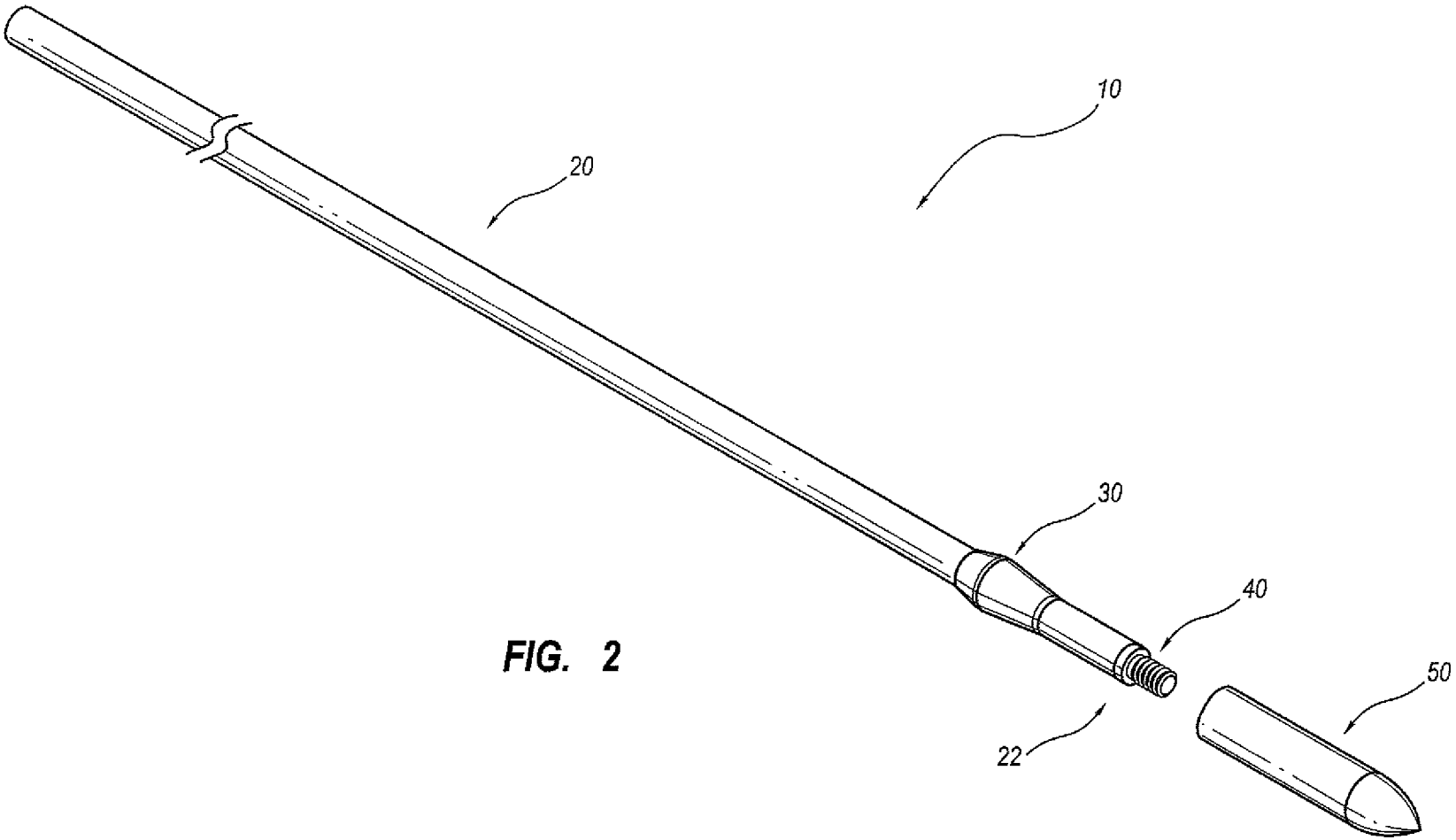
FIG. 2 is a partially assembled perspective view of the exemplary arrow apparatus illustrated in FIG. 1.
Figure 3:
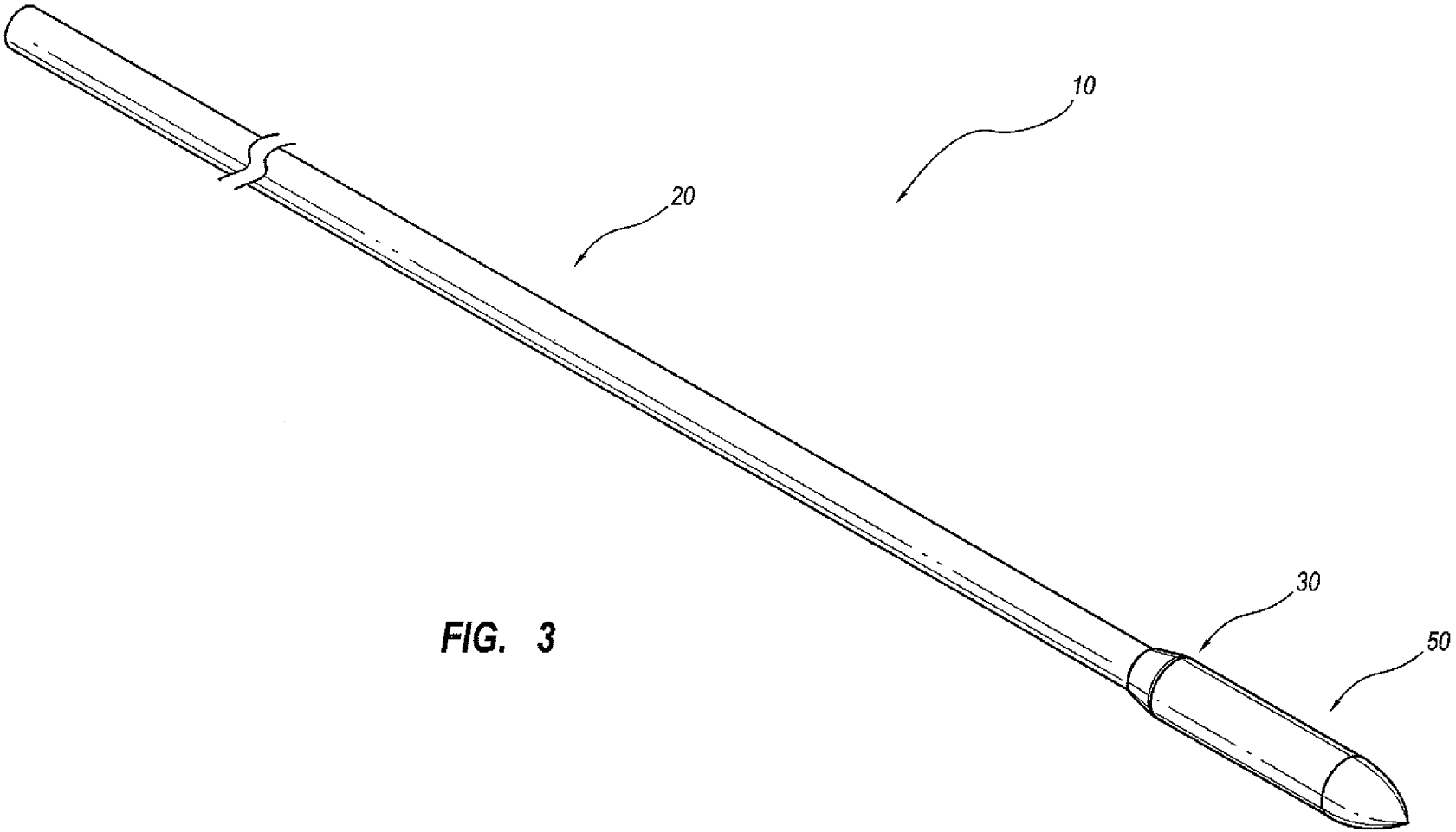
FIG. 3 is an assembled perspective view of the exemplary arrow apparatus illustrated in FIG. 1.

FIGS. 1-3 are perspective views of an exemplary arrow apparatus 10 according to at least one embodiment. As seen in these figures, an exemplary arrow apparatus 10 may comprise an arrow shaft 20, an arrow point alignment structure 30, an insert 40, and an arrow point 50, "Arrow" means any elongated projectile with a point on the front or leading end and fletching or any other stabilizing structure on the back or trailing end, and shall include arrows for archery bows and arrows or bolts for crossbows. Arrow shaft 20 generally represents any form of arrow shaft known to those of ordinary skill in the art; including, for example, so-called fiber reinforced polymer (FRP) arrow shafts (such as fiberglass and carbon fiber composite arrow shafts), aluminum arrow shafts, aluminum over composite shafts, or composite over aluminum shafts, and the like. In at least one embodiment, as seen in FIG. 1, arrow shaft 20 comprises a leading end 22, a trailing end 24, an outer surface 26, and an inner surface 28. The diameters of outer surface 26 and inner surface 28 may be varied as appropriate for differing hunting or sport archery applications.

Figure 4B:
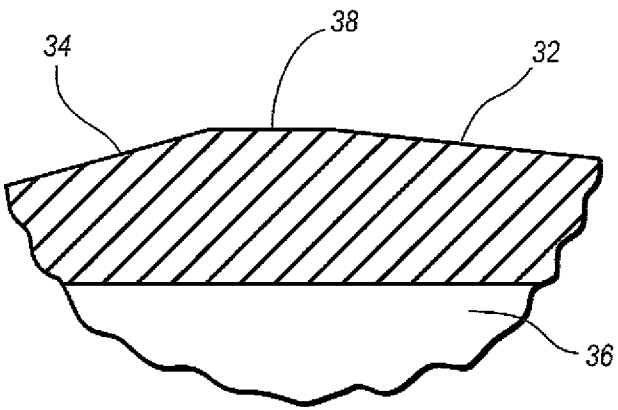
FIG. 4B is an enlarged cross-sectional view of a portion of the alignment structure shown in FIG. 4A.
Figure 4A:
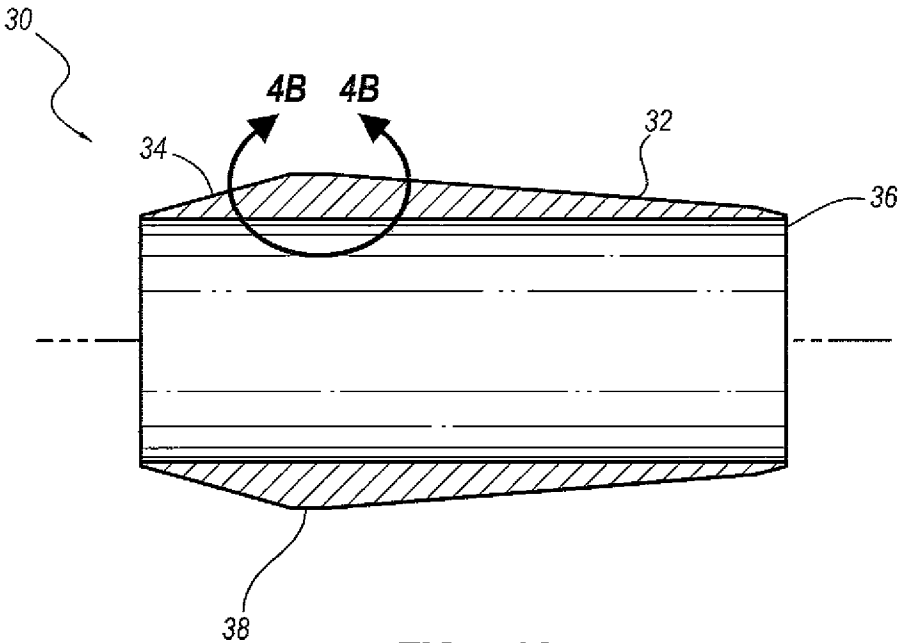
FIG. 4A is a cross-sectional side view of an exemplary arrow point alignment structure according to at least one embodiment.

FIG. 4A is a cross-sectional side view of the exemplary arrow point alignment structure 30 illustrated in FIGS. 1-3. As will be discussed in greater detail below, arrow point alignment structure 30 generally represents any structure configured to align the longitudinal axis of arrow point 50 with the longitudinal axis of arrow shaft 20. Arrow point alignment structure 30 may be manufactured in any number of shapes and sizes and may be adapted for use with arrow shafts of differing diameters. For example, as will be described in greater detail below, arrow point alignment structure 30 may either be discretely formed from, or integrally formed with, one or more of the components of exemplary arrow apparatus 10, such as arrow shaft 20 or insert 40. The arrow point alignment structure 30 may also comprise any number or combination of materials. For example, arrow point alignment structure 30 may be injection molded or formed of glass-filled nylon, aluminum, steel, brass, or any other suitable material.

As seen in FIGS. 4A and 4B, in at least one embodiment arrow point alignment structure 30 may comprise an inner surface 36 and an outer surface having a tapered leading end 32, a tapered trailing end 34, and a so-called flat or substantially cylindrical portion 38 (FIG. 4B) disposed between tapered leading end 32 and tapered trailing end 34. In certain embodiments, tapered leading end 32 and tapered trailing end 34 may be beveled, sloped, inclined, or substantially frustoconical in shape. In addition, and as discussed in greater detail below, the diameter of tapered leading end 32 may taper from a diameter approximately equal to the outer diameter of arrow shaft 20 to a diameter that is greater than or approximately equal to an outer diameter of arrow point 50 (at a point near the junction between tapered leading end 32 and tapered trailing end 34). In at least one embodiment, the diameter of inner surface 36 may be slightly greater than the outer diameter of arrow shaft 20 so that a portion of arrow shaft 20 may be disposed within arrow point alignment structure 30. For example, as seen in FIG. 2, leading end 22 of arrow shaft 20 may be inserted into and pass through arrow point alignment structure 30 until the leading end 22 of arrow shaft 20 extends past arrow point alignment structure 30. In certain embodiments, arrow point alignment structure 30 may be adhered, bonded, or otherwise affixed to the outer surface 26 of arrow shaft 20. Alternatively, as discussed in greater detail below in connection with FIGS. 15-16, arrow point alignment structure 30 may not be adhered or otherwise affixed to the outer surface 26 of arrow shaft 20, thus allowing arrow point alignment structure 30 to slide along the outer surface 26 of arrow shaft 20.

In addition, inner surface 36 of arrow point alignment structure 30 and outer surface 26 of arrow shaft 20 may be shaped such that, when arrow shaft 20 is disposed within arrow point alignment structure 30, arrow point alignment structure 30 may be brought into axial alignment with arrow shaft 20. In other words, the cylindrically shaped inner surface 36 of arrow point alignment structure 30 may be proportional to, and just slightly larger than, the cylindrically shaped outer surface 26 of arrow shaft 20 so that the longitudinal axes of arrow shaft 20 and arrow point alignment structure 30 are brought into alignment with one another when arrow shaft 20 is inserted and disposed within arrow point alignment structure 30.

Figure 4C:
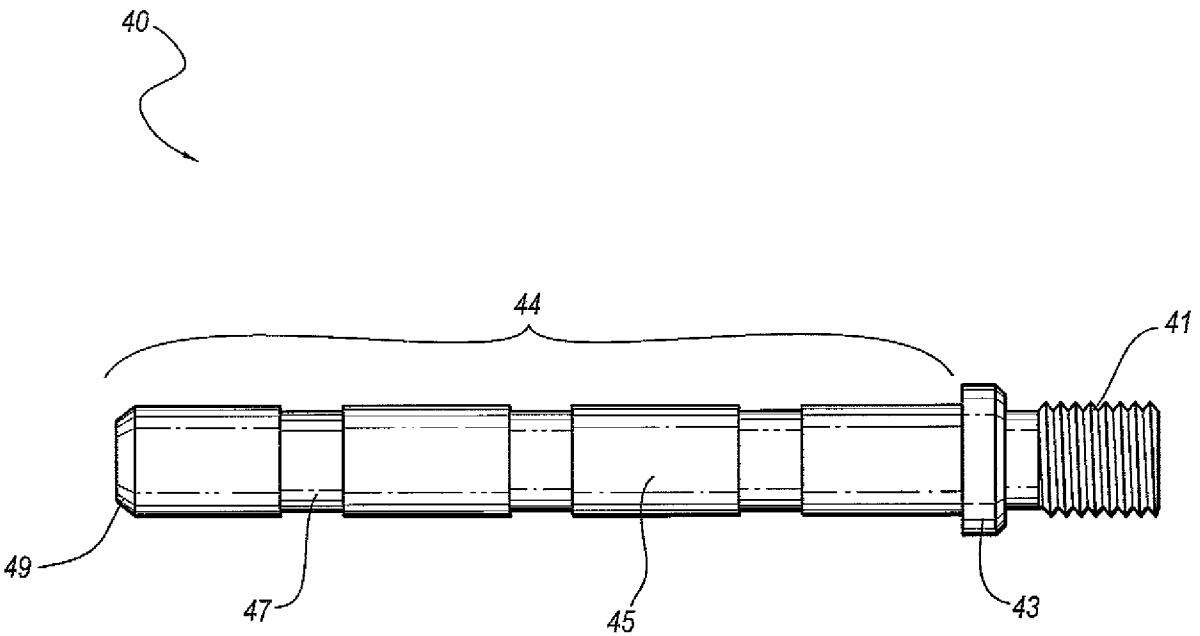
FIG. 4C is a side view of an exemplary insert according to at least one embodiment.

FIG. 4C is a side view of the exemplary insert 40 illustrated in FIGS. 1-3. Insert 40 generally represents any structure capable of being at least partially disposed within arrow shaft 20. Insert 40 may be formed in any number of shapes and sizes and of any combination of materials, such as aluminum, stainless steel, brass, or the like. For example, as discussed in greater detail below in connection with FIGS. 17-18, insert 40 may comprise a so-called hidden insert, such as the hidden insert embodiments described and illustrated in U.S. Pat. Nos. 7,004,859 and 7,115,055, the disclosures of which are incorporated herein in their entireties by this reference. The size of insert 40 may also be adapted as necessary for use with arrow shafts of varying sizes and diameters. In addition, as discussed in greater detail below, the weight of insert 40 may be adjusted by varying the materials used to form insert 40 or by varying the size and shape of insert 40. In the exemplary embodiment illustrated in FIG. 4C, insert 40 may comprise a threaded end 41, a lip portion 43, a shank portion 44, and a tapered end 49. Shank portion 44 may comprise a plurality of circumferential ridges 45 separated by a plurality of circumferential recesses 47. In at least one embodiment, the diameter of shank portion 44 (i.e., the diameter of each ridge 45) may be less than the inner diameter of arrow shaft 20 so that a portion of insert 40 (e.g., shank portion 44) may be inserted within arrow shaft 20, as seen in FIG. 2. In contrast, the diameter of lip portion 43 may be greater than the inner diameter of arrow shaft 20 to prevent insert 40 from being completely inserted within arrow shaft 20. In at least one embodiment, the diameter of lip portion 43 is substantially equal to the outer diameter of arrow shaft 20. As shown in at least FIG. 6B, the insert 40, when inserted into the arrow shaft 20, may define a leading end of the arrow shaft 20 to which at least a portion of the arrow point 50 is mounted.

Figure 4D:
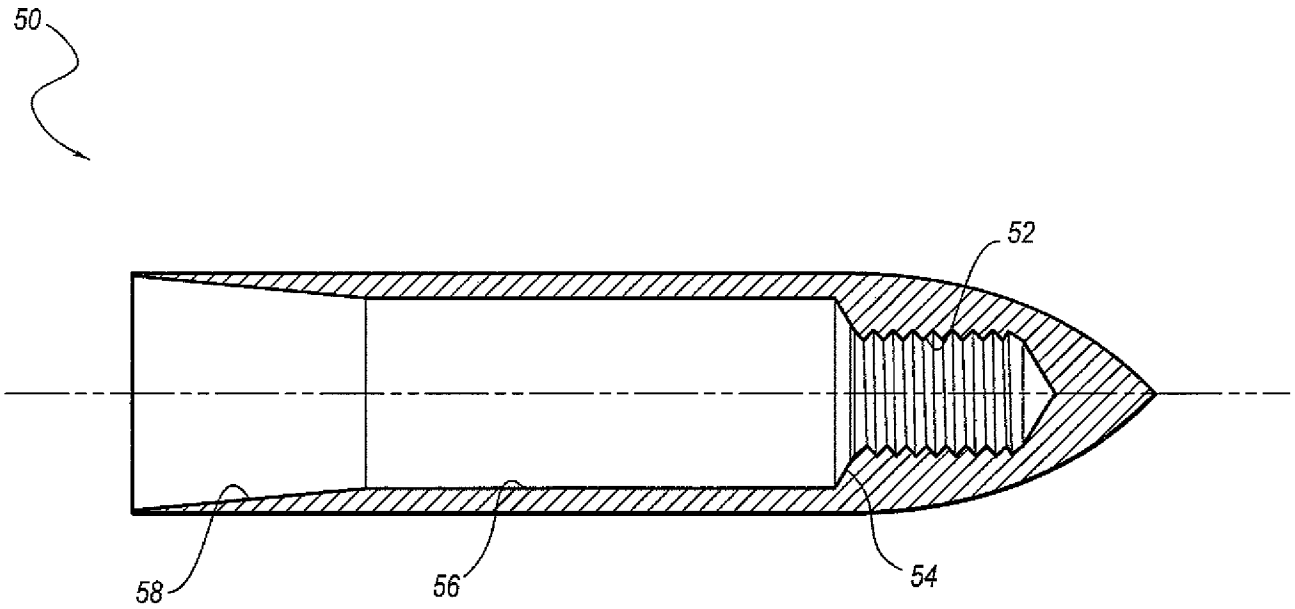
FIG. 4D is a cross-sectional side view of an exemplary arrow point according to at least one embodiment.

FIG. 4D is a cross-sectional side view of the exemplary arrow point 50 illustrated in FIGS. 1-3. Arrow point 50 generally represents any structure formed at or secured to the leading or distal end of an arrow shaft; including, for example, field points, broadheads (including expandable and replaceable fixed-blade broadheads), and the like. As seen in FIG. 4D, an internal aperture may be defined within arrow point 50 comprising a threaded portion 52, a shoulder portion 54, a substantially cylindrical portion 56, and a tapered portion 58. As will be discussed in greater detail below, arrow point 50 may be configured to receive at least a portion of insert 40, arrow point alignment structure 30, and/or arrow shaft 20.

Figure 5:
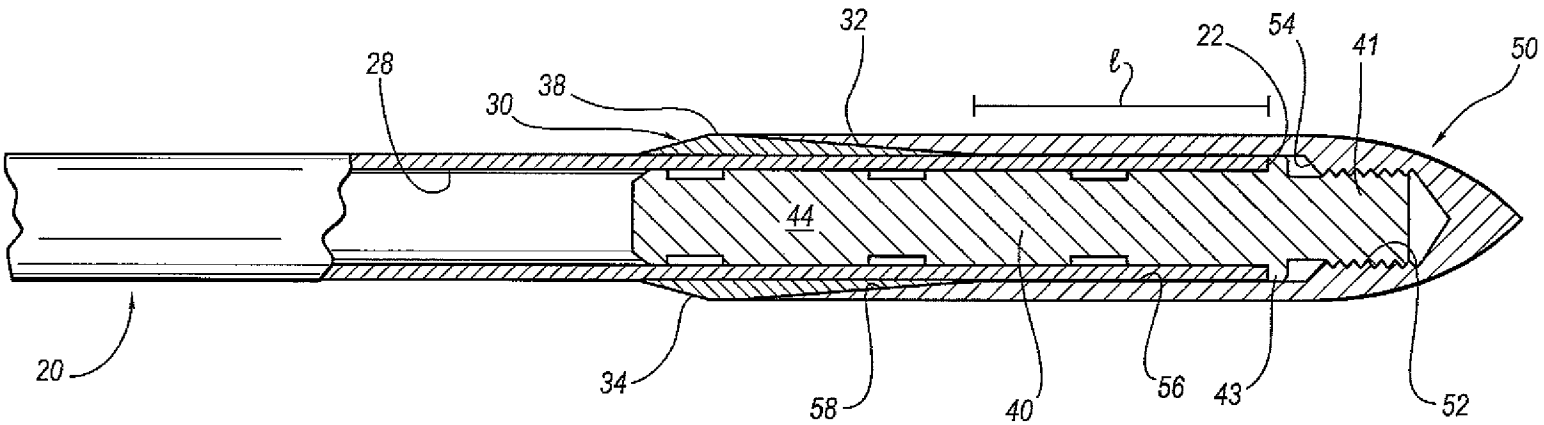
FIG. 5 is an assembled cross-sectional side view of the exemplary arrow apparatus illustrated in FIG. 3.

FIG. 5 is an assembled cross-sectional side view of the exemplary arrow apparatus 10 illustrated in FIGS. 1-3. As shown, shank portion 44 of insert 40 may be disposed within arrow shaft 20, with lip portion 43 of insert 40 abutting the leading end 22 (FIG. 2) of arrow shaft 20. In certain embodiments, shank portion 44 (FIG. 4B) of insert 40 may be adhered, bonded, or otherwise affixed to the inner surface 28 (FIG. 1) of arrow shaft 20. In addition, and as discussed previously, the leading end 22 of arrow shaft 20 may be inserted into and passed through arrow point alignment structure 30, as illustrated in FIGS. 2 and 5. As will be discussed in greater detail below, in many embodiments the terminating portion of tapered leading end 32 of arrow point alignment structure 30 may be positioned a predetermined distance from the leading end 22 of arrow shaft 20.

In at least one embodiment, and as seen in FIG. 5, threaded end 41 of insert 40 may be threaded into and mate with threaded portion 52 of arrow point 50. The threaded portion 52 may be referenced as a first contact point for the arrow point 50. In certain embodiments, the portion of arrow shaft 20 that houses shank portion 44 (FIG. 4C) of insert 40 may be disposed within substantially cylindrical portion 56 (FIG. 4D) of arrow point 50. In addition, as threaded end 41 of insert 40 is threaded into threaded portion 52 of arrow point 50, tapered portion 58 of arrow point 50 may contact, and more specifically may receive and mate with, the tapered leading end 32 of arrow point alignment structure 30. The tapered portion 58 may be referenced as a second contact point for the arrow point 50 that provides contact between the tapered portion 58 and the arrow point 50. The threaded portion 52 (i.e., first contact point) and tapered portion 58 (i.e., second contact point) may be axially spaced apart. Tapered portion 58 may embody the inverse of the generally frustoconical shape of tapered leading end 32 of arrow point alignment structure 30 such that, as threaded end 41 is threaded into threaded portion 52 of arrow point 50, the outer surface of tapered leading end 32 may bear against the tapered portion 58 of the internal aperture defined within arrow point 50, resulting in a tight engagement or contact between arrow point 50 and arrow point alignment structure 30, and thus alignment between the arrow point 50 and arrow shaft 20.

As detailed above, tapered leading end 32 may taper from a diameter approximately equal to the outer diameter of arrow shaft 20 to a diameter that is greater than or approximately equal to an outer diameter of arrow point 50. In at least one embodiment, arrow point alignment structure 30 may be positioned on arrow shaft 20 so as to prevent threaded end 41 of insert 40 from being completely threaded into threaded portion 52 of arrow point 50. In other words, the distance between the tapered leading end 32 of arrow point alignment structure 30 and the leading end 22 of arrow shaft 20 may be chosen such that, as insert 40 is threaded into arrow point 50, the outer surface of tapered leading end 32 may bear against the inner surface of tapered portion 58 of the internal aperture defined within arrow point 50 to prevent lip portion 43 from contacting shoulder portion 54 of arrow point 50. Alternatively, the distance between the tapered leading end 32 of arrow point alignment structure 30 and the leading end 22 of arrow shaft 20 may be chosen so that lip portion 43 bears against shoulder portion 54 of arrow point 50 at the same time that the outer surface of tapered leading end 32 bears against the tapered portion 58 of the internal aperture defined within arrow point 50.

In at least one embodiment, tapered leading end 32 of arrow point alignment structure 30 may be shaped so as to bring arrow point 50 into axial alignment with arrow point alignment structure 30. In other words, as seen in FIG. 5, as the tapered portion 58 of the internal aperture defined within arrow point 50 mates with and bears against the outer surface of tapered leading end 32 of arrow point alignment structure 30, the frustoconical shape of tapered leading end 32 may guide arrow point 50 into axial alignment with arrow point alignment structure 30. Moreover, because, as explained in greater detail above, arrow point alignment structure 30 may be shaped and positioned so as to be in axial alignment with arrow shaft 20, arrow point alignment structure 30 may also bring arrow point 50 into axial alignment with arrow shaft 20.

Because in certain embodiments the shortened distance between the tapered leading end 32 of arrow point alignment structure 30 and the leading end 22 of arrow shaft 20 may prevent threaded end 41 of insert 40 from being completely threaded into threaded portion 52 of arrow point 50, many of the axial alignment difficulties experienced in conventional arrow systems may be eliminated. In addition, because arrow point 50 extends over and surrounds at least a portion of arrow shaft 20, as opposed to being cantilevered off the leading end 22 of arrow shaft 20, as with conventional arrow points, arrow point 50 may receive internal structural support from arrow shaft 20, thereby strengthening the attachment of arrow point 50 to arrow shaft 20. Thus, arrow point 50 may be axially aligned with arrow shaft 20 with greater accuracy and reliability than is possible with conventional arrow systems, resulting in improved arrow flight and accuracy. Additionally or alternatively, in certain embodiments where the distance between the tapered leading end 32 of arrow point alignment structure 30 and the leading end 22 of arrow shaft 20 is chosen to allow lip portion 43 to bear against shoulder portion 54 of arrow point 50, arrow point alignment structure 30 may help negate any alignment problems generated by the engagement of lip portion 43 with shoulder portion 54.

Figure 6A:
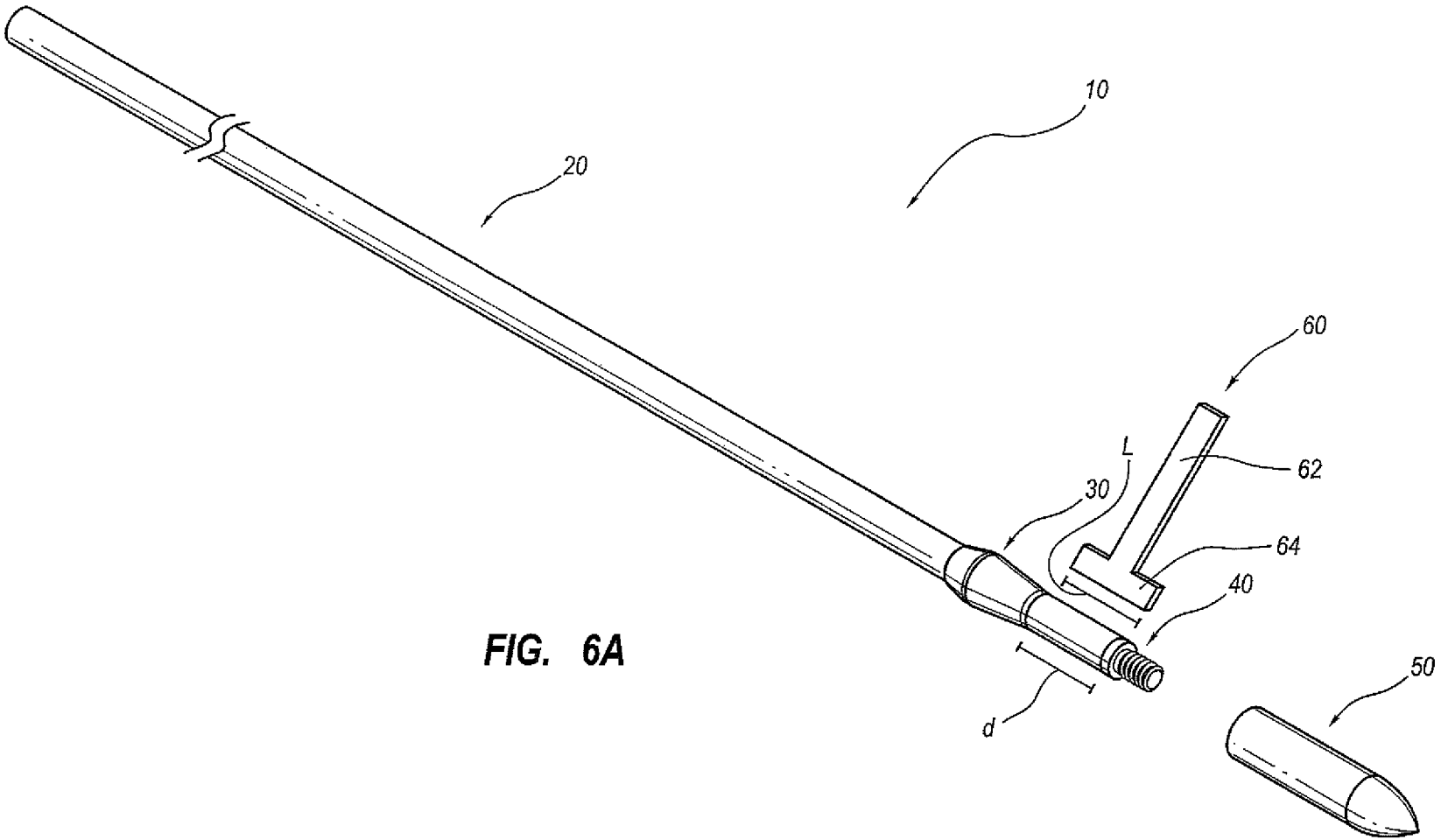
FIG. 6A is a partially assembled perspective view of an arrow apparatus according to an additional embodiment.
Figure 6B:
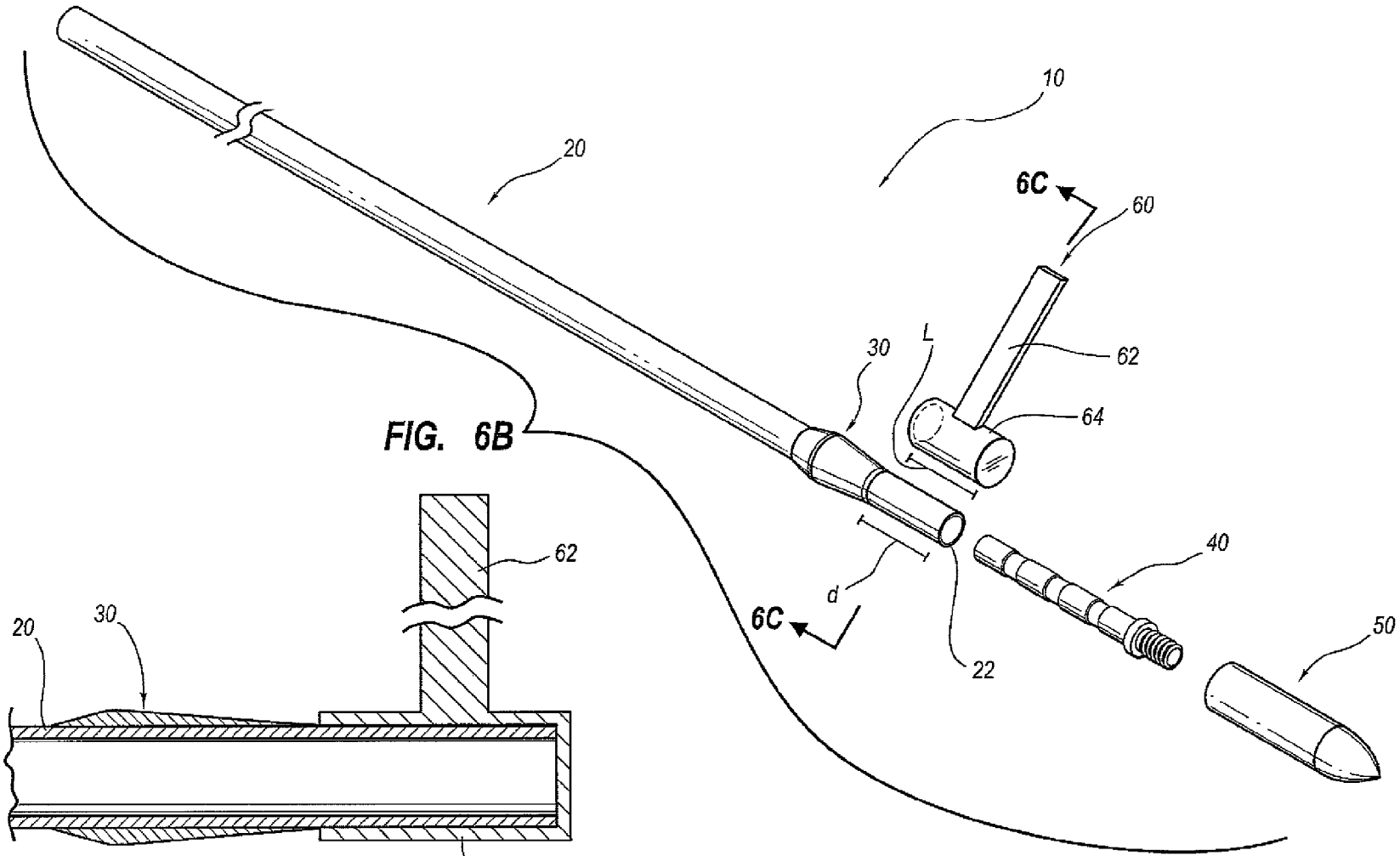
FIG. 6B is a partially assembled perspective view of an arrow apparatus according to an additional embodiment.

As illustrated in the perspective views of FIGS. 6A and 6B, exemplary arrow apparatus 10 may also comprise a gauge 60. As shown in FIG. 6A, gauge 60 generally represents any structure or device useful in determining a preferred distance d from the leading end of arrow point alignment structure 30 to the front end of arrow shaft 20 (or, alternatively, to a front edge of insert 40). In at least one embodiment, gauge 60 comprises a leg portion 62 and a head portion 64 having a length L (FIG. 6A) that is equal to preferred distance d (FIGS. 6A and 6B). In certain embodiments, distance d may be less than, equal to, or greater than the length of the substantially cylindrical portion 56 defined in side arrow point 50, collectively designated as length tin FIG. 5. In embodiments where distance d is less than length l, tapered leading end 32 may, as insert 40 is inserted into arrow point 50, bear against tapered portion 58 of arrow point 50 to prevent threaded end 41 of insert 40 from being completely threaded into the threaded portion 52 of arrow point 50, as explained in detail above. Alternatively, in embodiments where distance d is equal to length l, lip portion 43 may bear against shoulder portion 54 of arrow point 50 at the same time that the outer surface of tapered leading end 32 bears against the tapered portion 58 of the internal aperture defined within arrow point 50. In at least one embodiment, distance d is 0.5 inches.

In the exemplary embodiment illustrated in FIG. 6A, head portion 64 of gauge 60 may be placed alongside arrow shaft 20, with one end of head portion 64 positioned flush with the end wall of leading end 22 (FIG. 5) of arrow shaft 20. An edge of arrow point alignment structure 30 may then be brought into an abutting relationship with the rear edge of gauge 60. The arrow point alignment structure 30 may then be adhered, bonded, or otherwise affixed to the outer surface 26 of arrow shaft 20, as discussed in detail above. Gauge 60 thus enables a user of exemplary arrow apparatus 10 to easily and accurately position arrow point alignment structure 30 a preferred distance from the end wall of the leading end 22 of arrow shaft 20.

Figure 6C:
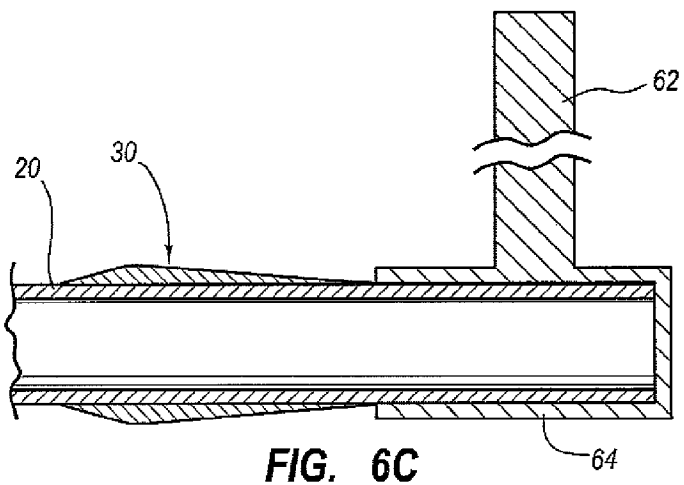
FIG. 6C is a cross-sectional view of the arrow apparatus of FIG. 6B.

Gauge 60 may be formed of any number or combination of materials, such as plastic, aluminum, steel, brass, or any other suitable material. Gauge 60 may also be formed in any number of shapes and sizes. For example, as illustrated in FIG. 6B, head portion 64 of gauge 60 may be substantially cylindrical and may have a cylindrical cavity defined therein for receiving leading end 22 of arrow shaft 20. In this exemplary embodiment, leading end 22 of arrow shaft 20 may be inserted into the cylindrical cavity of gauge 60 until leading end 22 abuts the end wall of the cylindrical cavity, as shown in FIG. 6C. The arrow point alignment structure 30 may then be brought into an abutting relationship with the rear edge of gauge 60. In an additional embodiment, head portion 64 may comprise a lip portion configured to rest against the end wall of the leading end 22 of arrow shaft 20 to ensure proper placement of gauge 60. In yet another embodiment, a gauge similar to what is shown in FIGS. 6B and 6C may be used with an aperture formed in the closed end to receive the threaded portion of insert 40, and the length L includes the thickness of lip portion 43 (FIG. 4C).

Figure 7:
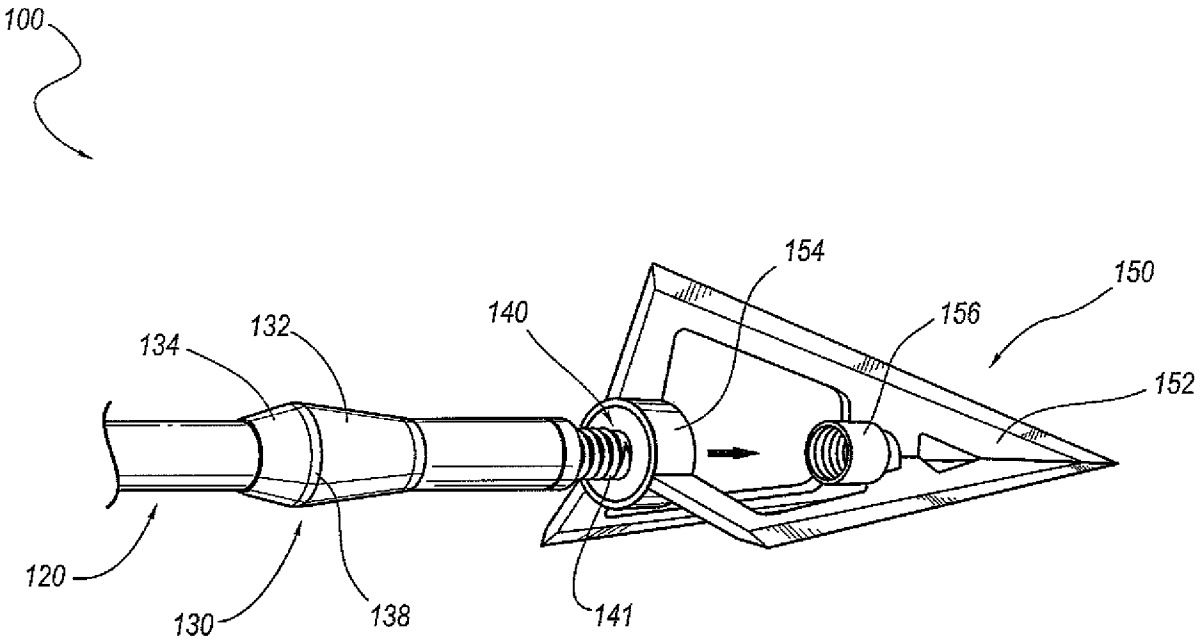
FIG. 7 is a partially assembled perspective view of an arrow apparatus according to an additional embodiment.
Figure 8:
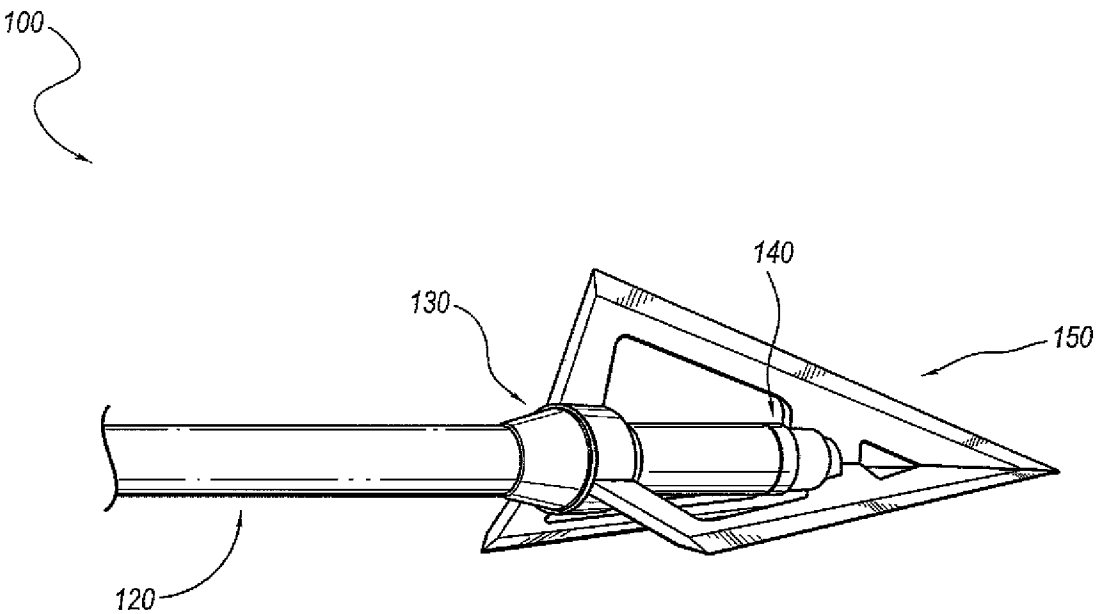
FIG. 8 is an assembled perspective view of the exemplary arrow apparatus illustrated in FIG. 7.

The preceding description has been provided to enable others skilled in the art to best utilize various aspects of the exemplary embodiments described herein. This exemplary description is not intended to be exhaustive or to be limited to any precise form disclosed. Many modifications and variations are possible without departing from the spirit and scope of the instant disclosure. For example, as illustrated in FIGS. 7 and 8, an exemplary arrow apparatus may comprise a broadhead-type arrow point 150, as opposed to the field point-type arrow point 50 previously described and illustrated. As seen in FIGS. 7 and 8, an exemplary arrow apparatus 100 may comprise an arrow shaft 120, an arrow point alignment structure 130, an insert 140, and a broadhead arrow point 150.

Broadhead 150 generally represents any form or type of broadhead; including, for example, unitary, expandable, and replaceable fixed-blade broadheads. In at least one embodiment, broadhead 150 comprises a plurality of blades 152 that each extend from a common frontal point to a base. In certain embodiments, the base of each blade 152 may be connected to a tapered collar 154. Tapered collar 154 may define a central aperture (also referred to as a collar aperture having a tapered surface) that is in axial alignment with a central hub structure 156 provided on the underside of each blade 152 and positioned between the common frontal point and tapered collar 154. Similar to threaded portion 52 of arrow point 50, central hub structure 156 may comprise a plurality of internal threads configured to receive and threadably mate with threaded end 141 of insert 140.

In at least one embodiment, the inner surface of tapered collar 154 may embody the inverse of the generally frustoconical shape of tapered leading end 132 of arrow point alignment structure 130. In addition, the diameter of tapered leading end 132 of arrow point alignment structure 130 may taper from a diameter approximately equal to the outer diameter of arrow shaft 120 to a diameter that is greater than or substantially equal to an outer diameter of tapered collar 154. Thus, as seen in FIG. 8, as threaded end 141 of insert 140 is threaded into central hub structure 156, tapered collar 154 of broadhead 150 may contact, or more specifically may receive and mate with, the tapered leading end 132 of arrow point alignment structure 130. That is, the outer surface of tapered leading end 132 may be brought to bear against the inner surface of tapered collar 154, resulting in a tight engagement between broadhead 150 and arrow point alignment structure 130.

As with exemplary arrow apparatus 10, arrow point alignment structure 130 in exemplary arrow apparatus 100 may be positioned on arrow shaft 120 so as to prevent threaded end 141 of insert 140 from being completely threaded into central hub structure 156. In other words, the distance between the tapered leading end 132 of arrow point alignment structure 130 and the leading end of arrow shaft 120 may be chosen such that, as insert 140 is threaded into central hub structure 156, the outer surface of tapered leading end 132 may bear against the inner surface of tapered collar 154 to prevent the lip portion of insert 140 from abutting a shoulder portion defined in central hub structure 156. Alternatively, the distance between the tapered leading end 132 of arrow point alignment structure 130 and the leading end of arrow shaft 120 may be chosen so that the lip portion of insert 140 bears against a shoulder portion defined in central hub structure 156 at the same time that the outer surface of tapered leading end 132 bears against the inner surface of tapered collar 154.

Similar to arrow point alignment structure 30, tapered leading end 132 of arrow point alignment structure 130 may be shaped so as to bring broadhead 150 into axial alignment with arrow point alignment structure 130. In other words, as seen in FIGS. 7 and 8, as tapered collar 154 mates with and is brought to bear against the outer surface of tapered leading end 132 of arrow point alignment structure 130, the frustoconical shape of tapered leading end 132 may guide broadhead 150 into axial alignment with arrow point alignment structure 130. Moreover, because arrow point alignment structure 130 may be shaped and positioned so as to be in axial alignment with arrow shaft 120, arrow point alignment structure 130 may also bring broadhead 150 into axial alignment with arrow shaft 120.

Because in certain embodiments the shortened distance between the tapered leading end 132 of arrow point alignment structure 130 and the leading end of arrow shaft 120 may prevent threaded end 141 of insert 140 from being completely threaded into central hub structure 156, many of the axial alignment difficulties experienced in conventional broadhead arrow systems may be eliminated. In addition, because broadhead 150 extends over and surrounds at least a portion of arrow shaft 120, as opposed to being cantilevered off the leading end of arrow shaft 120, as with conventional broadheads, broadhead 150 may receive internal structural support from arrow shaft 120, thereby strengthening the attachment of broadhead 150 to arrow shaft 120, and thus the entire arrow/broadhead assembly. Exemplary arrow apparatus 100 may also eliminate the need for the use of conventional ferrules and ferrule assemblies, and accordingly comprises a ferruleless broadhead system. Thus, broadhead 150 may be axially aligned with arrow shaft 120 with greater accuracy and reliability than is possible with conventional broadhead arrow systems, resulting in improved arrow flight and accuracy. Additionally or alternatively, in certain embodiments where the distance between the tapered leading end 132 of arrow point alignment structure 130 and the leading end of arrow shaft 120 is chosen to allow the lip portion of insert 140 to bear against the shoulder portion defined in central hub structure 156, arrow point alignment structure 130 may help negate any alignment problems generated by the engagement of the lip portion of insert 140 with the shoulder portion of central hub structure 156.

Figure 9:
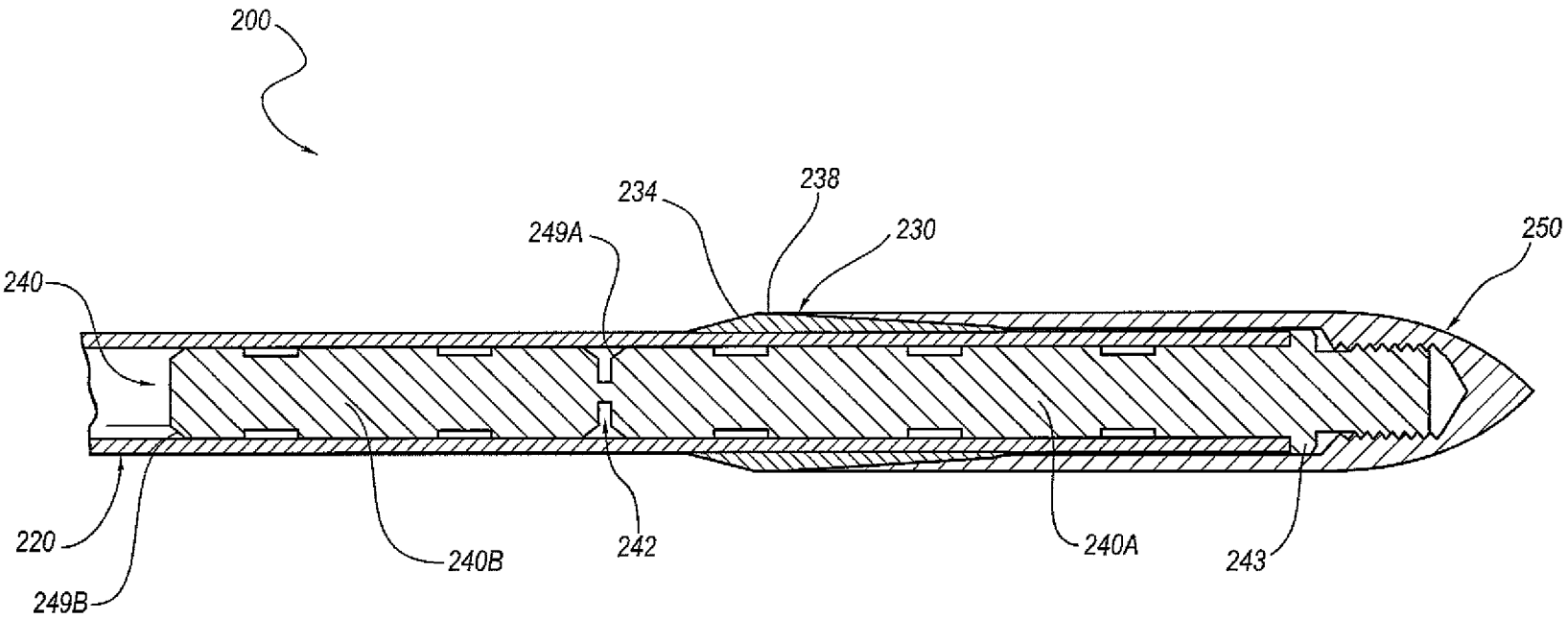
FIG. 9 is a cross-sectional side view of an arrow apparatus according to an additional embodiment.

As detailed above, the weight of the exemplary inserts described and/or illustrated herein may be adjusted by varying the materials used to form the insert or by varying the size and shape of the insert. FIG. 9 is a cross-sectional side view of an arrow apparatus 200 comprising a weight-adjustable insert. As seen in this figure, arrow apparatus 200 may comprise an arrow shaft 220, an arrow point alignment structure 230 (having similar characteristics as discussed above, including a tapered trailing end 234 and a substantially cylindrical portion 238) and an arrow point 250. Arrow apparatus 200 may also comprise a weight-adjustable insert 240 having a first insert portion 240A and a second insert portion 240B. As with insert 40, first and second insert portions 240A and 240B may comprise a plurality of circumferential ridges separated by a plurality of circumferential recesses. Insert portions 240A and 240B may also respectively comprise tapered ends 249A and 249B. In addition, as illustrated in FIG. 9, first insert portion 240A may be connected to second insert portion 240B by a breakable connector 242.

As with insert 40, insert portions 240A and 240B may be formed in any number of shapes and sizes and of any combination of materials, such as aluminum, stainless steel, brass, or the like. In certain embodiments, first insert portion 240A may be formed to have a weight that is different from the weight of second insert portion 240B. For example, first insert portion 240A may be formed to have a granular weight of 42 grains, while second insert portion 240B may be formed to have a granular weight of 15 grains. Other weights for first and second insertion portions 240A and 240B may also be chosen as desired. In at least one embodiment, a user of exemplary arrow apparatus 200 may reduce the total weight of insert 240 by breaking the breakable connector 242 between first insert portion 240A and second insert portion 240B and removing second insert portion 240B. For example, in one embodiment the total weight of insert 240 may be reduced from 57 grains to 42 grains by breaking breakable connector 242 (before installation, of course) between first insert portion 240A (which may have a granular weight of 42 grains) and second insert portion 240B (which may have a granular weight of 15 grains) and disposing of second insert portion 240B. Those skilled in the art will understand that more than two insert portions may be used, as desired and appropriate.

Weight-adjustable insert 240 thus provides a simple and effective means for adjusting the weight of the insert used in exemplary arrow apparatus 240, which insert accounts for a portion of the front-end weight of the assembled arrow. Thus, a user of exemplary arrow apparatus 240 may adjust the front-end weight of the arrow apparatus simply by breaking the breakable connector 242 between first insert portion 240A and second insert portion 240B and disposing of second insert portion 240B. Advantageously, weight-adjustable insert 240 may be adapted for use in connection with multiple types and sizes of arrow shafts and arrow points; including, for example, both field point and broadhead arrow points.

In at least one embodiment, such as the embodiment shown in FIG. 9, tapered end 249A of first insert portion 240A may be positioned directly below the tapered trailing end 234 of arrow point alignment structure 230, with breakable connector 242 extending beyond the tapered trailing end 234 of arrow point alignment structure 230. In certain embodiments, positioning first insert portion 240A within arrow shaft 220 in this manner enables the weight-adjustable insert 240 to provide support for arrow point 250, even if second insert portion 240B is broken off and removed.

Figure 10:
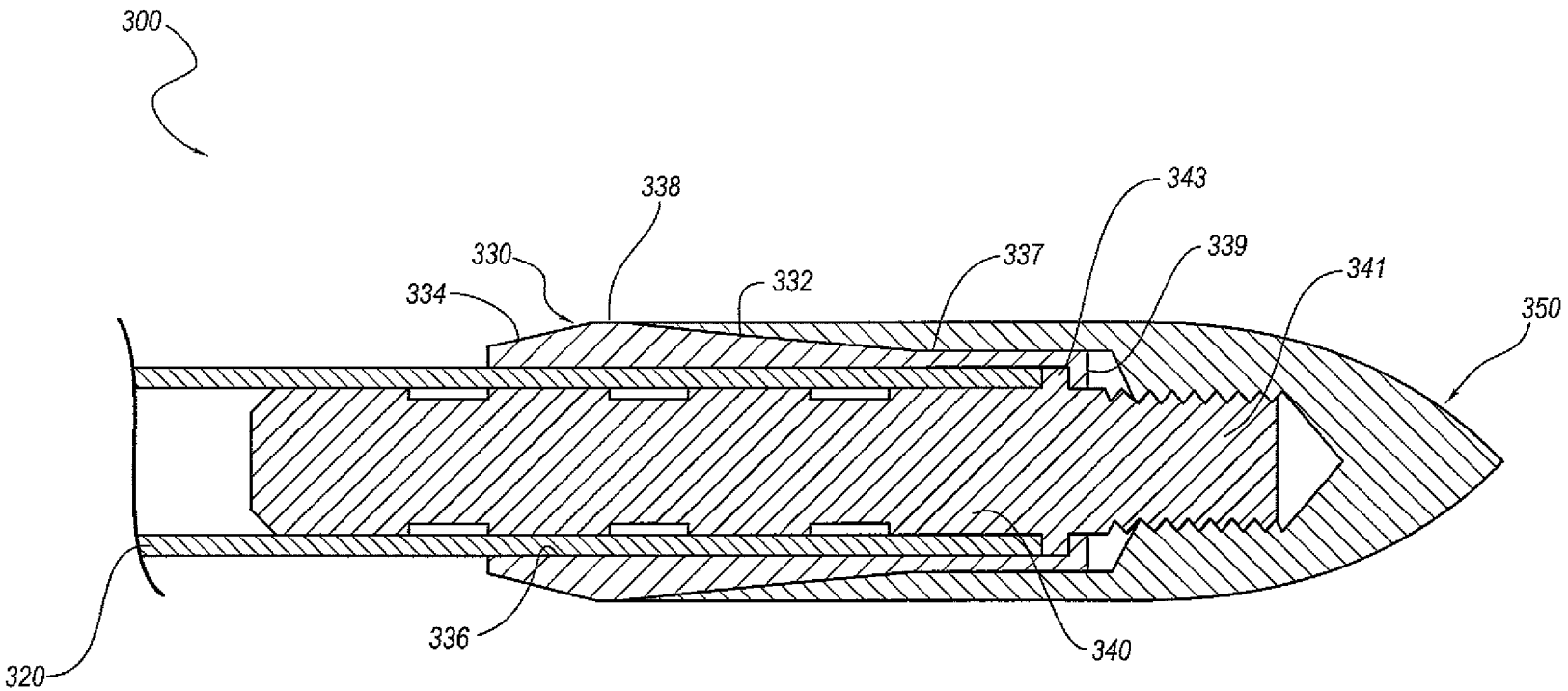
FIG. 10 is a cross-sectional side view of an arrow apparatus according to an additional embodiment.

FIG. 10 is a cross-sectional side view of an arrow apparatus 300 according to an additional embodiment. As seen in this figure, exemplary arrow apparatus 300 may comprise an arrow shaft 320, an arrow point alignment structure 330, an insert 340, and an arrow point 350. In at least one embodiment, arrow point alignment structure 330 may comprise a substantially cylindrical inner surface 336 and an outer surface comprising a tapered leading end 332, a tapered trailing end 334, a first substantially cylindrical portion 338, a second substantially cylindrical portion 337, and a lip portion 339. As with arrow point alignment structure 30 discussed above, the diameter of inner surface 336 may be slightly greater than the outer diameter of arrow shaft 320 so that a portion of arrow shaft 320 may be disposed within arrow point alignment structure 330. However, in contrast to arrow point alignment structure 30, lip portion 339 may be formed to have an inner diameter that is less than the outer diameters of both arrow shaft 320 and lip portion 343 of insert 340. Thus, in certain embodiment embodiments, lip portion 339 of arrow point alignment structure may surround lip portion 343 of insert 340 and prevent the leading end of arrow shaft 320 from passing through the leading end of arrow point alignment structure 330. In at least one embodiment, lip portion 339 may serve to position tapered leading end 332 of arrow point alignment structure 330 a preferred distance (discussed in greater detail above) from the end wall of the leading end of arrow shaft 320.

Figure 11:
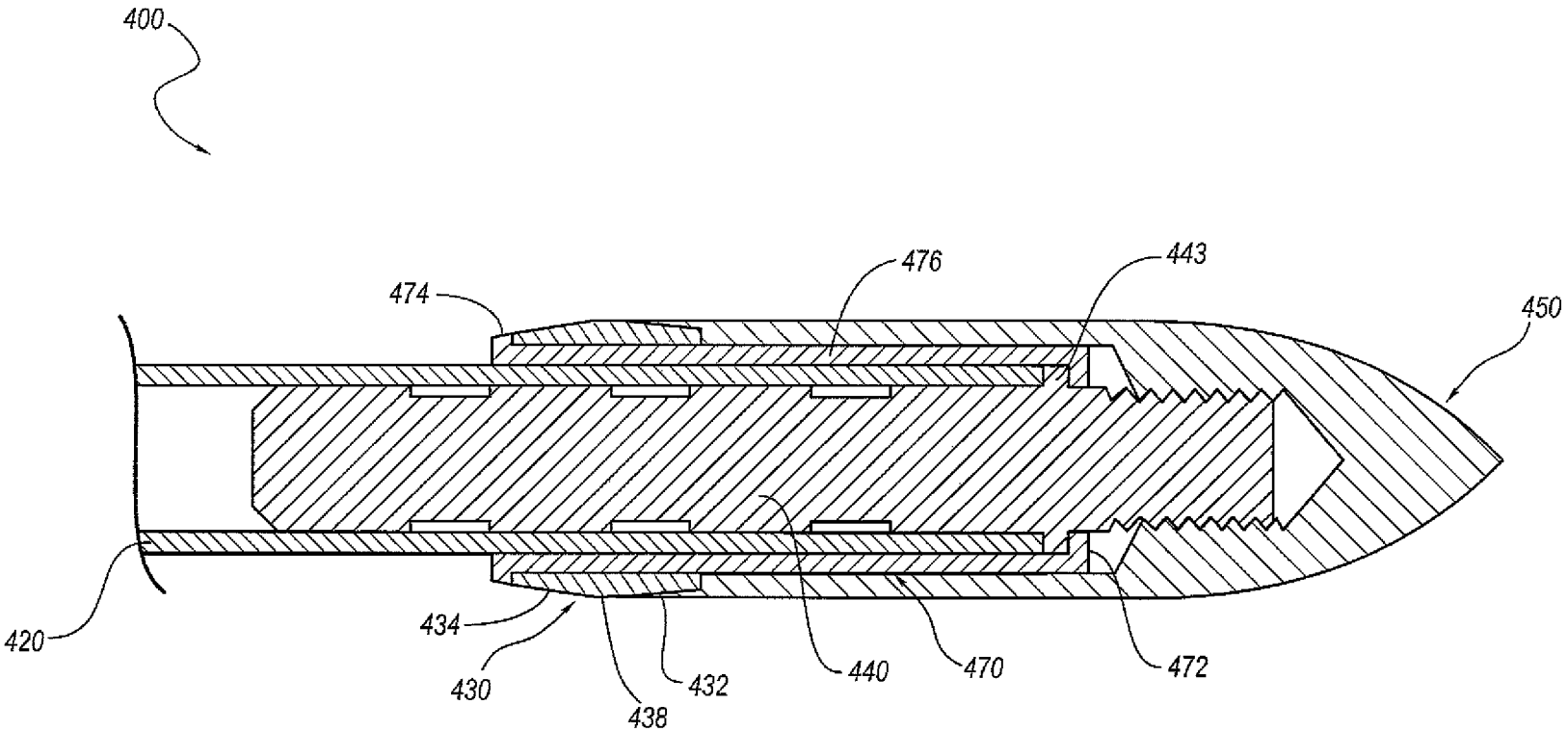
FIG. 11 is a cross-sectional side view of an arrow apparatus according to an additional embodiment.

FIG. 11 is a cross-sectional side view of an arrow apparatus 400 according to an additional embodiment. As seen in this figure, exemplary arrow apparatus 400 may comprise an arrow shaft 420, an arrow point alignment structure 430 having a tapered leading end 432, a tapered trailing end 434, and a substantially cylindrical portion 438, an insert 440, an arrow point 450, and a spacing structure 470. In at least one embodiment, spacing structure 470 may comprise a substantially cylindrical portion 476 surrounded by a first lip portion 472 and a second lip portion 474. In certain embodiments, the inner diameter of substantially cylindrical portion 476 may be slightly greater than the outer diameter of arrow shaft 420 so that a portion of arrow shaft 420 may be disposed within spacing structure 470. In addition, the inner diameter of first lip portion 472 may be less than the outer diameters of both arrow shaft 420 and lip portion 443 of insert 440 so that first lip portion 472 may surround lip portion 443 of insert 440 and prevent arrow shaft 420 from passing through the leading end of spacing structure 470. Further, second lip portion 474 may have an outer diameter that is greater than the diameter of tapered trailing end 434 of arrow point alignment structure 430. Those skilled in the art will understand that break-off portions may be used with virtually any insert used in connection with the various embodiments of the invention.

After at least a portion of insert 440 has been positioned within arrow shaft 420, insert 440 and arrow shaft 420 may be inserted into the trailing end of spacing structure 470 until lip portion 443 of insert 440 abuts first lip portion 472 of spacing structure 470. If desired, spacing structure 470 may be adhered, bonded, or otherwise affixed to the outer surface of arrow shaft 420. Alignment structure 430 may then be slid over the leading end of spacing structure 470 and the tapered trailing end 434 of arrow point alignment structure 430 may be brought into abutment with second lip portion 474 of spacing structure 470. Alignment structure 430 may (or may not) then be adhered, bonded, or otherwise affixed to the outer surface of spacing structure 470. Accordingly, in at least one embodiment, spacing structure 470 may serve to position alignment structure 430 a preferred distance (discussed in greater detail above) from the end wall of the leading end of arrow shaft 420, and may also provide some reinforcement to prevent the whole tip assembly from sliding backward during target impact.

Figure 12:
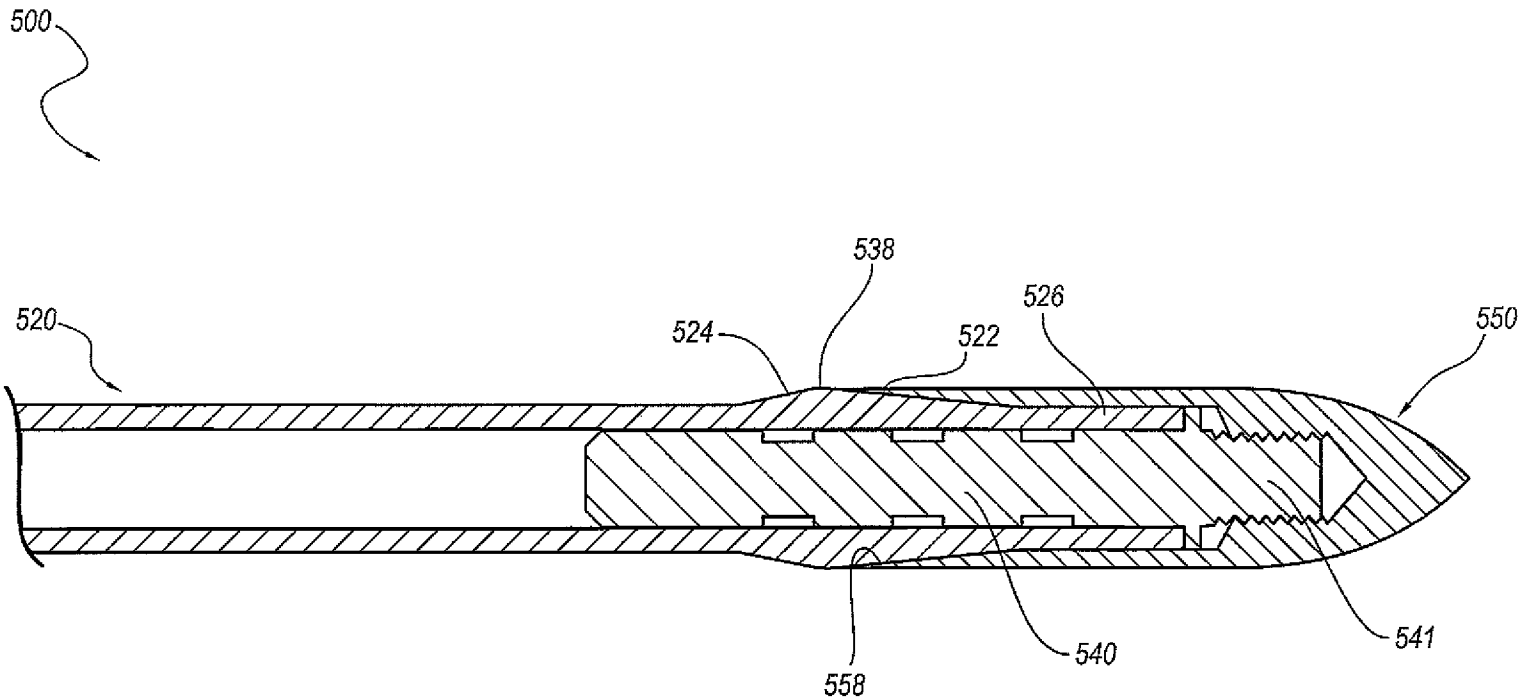
FIG. 12 is a cross-sectional side view of an arrow apparatus according to an additional embodiment.

FIG. 12 is a cross-sectional side view of an arrow apparatus 500 according to an additional embodiment. As seen in this figure, exemplary arrow apparatus 500 may comprise an arrow shaft 520, an insert 540, and an arrow point 550. Rather than comprising a discretely formed alignment structure (such as arrow point alignment structure 30 in FIGS. 1-3), in at least one embodiment arrow shaft 520 may comprise a tapered leading end 522, a tapered trailing end 524, a first substantially cylindrical portion 538, and a second substantially cylindrical portion 526 formed integrally with its outer surface. As with arrow point alignment structure 30, in certain embodiments tapered leading end 522 and tapered trailing end 524 may be substantially frustoconical in shape. In addition, tapered leading end 522 may taper from a diameter approximately equal to the outer diameter of substantially cylindrical portion 526 to a diameter that is greater than or approximately equal to an outer diameter of arrow point 550.

In at least one embodiment, and as seen in FIG. 12, as threaded end 541 of insert 540 is threaded into arrow point 550, the outer surface of tapered leading end 522 may be brought to bear against tapered portion 558 of the internal aperture defined within arrow point 550, resulting in a tight engagement between arrow point 550 and arrow shaft 520. Similar to previous embodiments, the frustoconical shape of tapered leading end 522 may guide arrow point 550 into axial alignment with arrow shaft 520.

Figure 13:
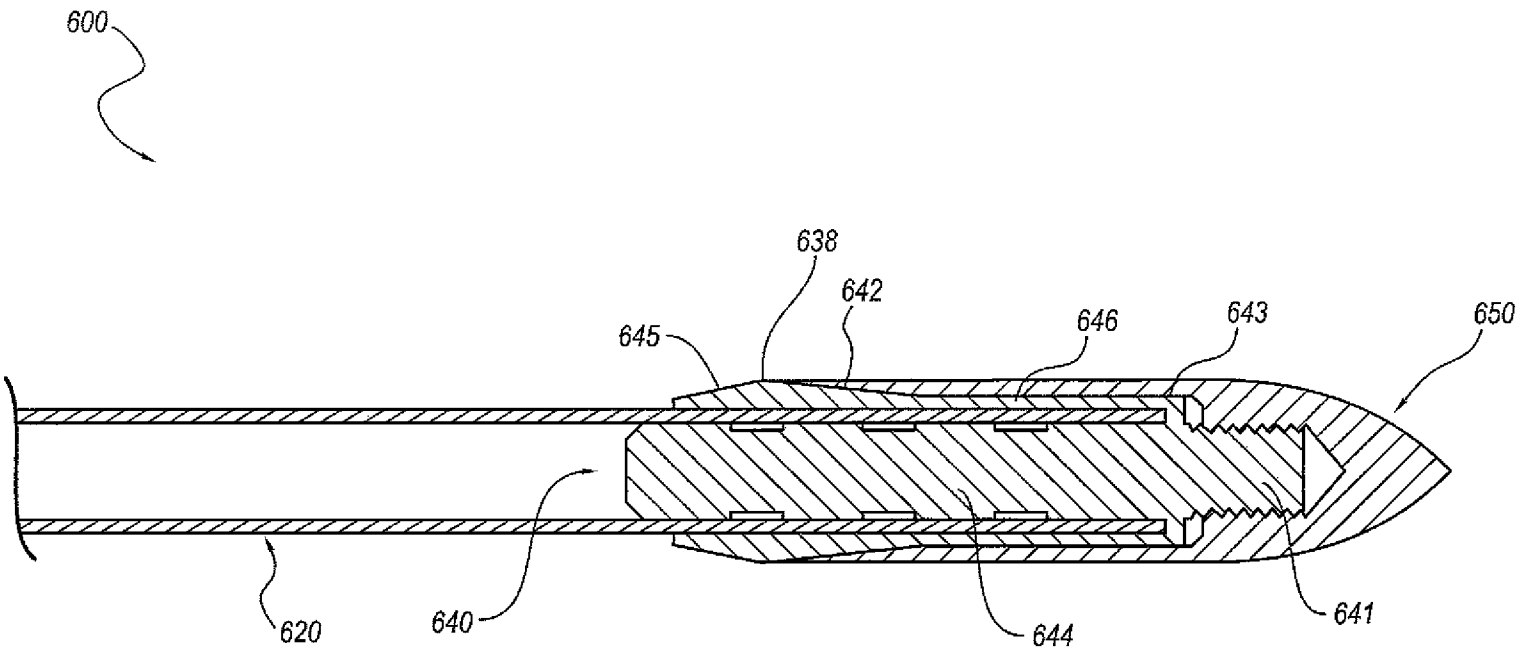
FIG. 13 is a cross-sectional side view of an arrow apparatus according to an additional embodiment.

FIG. 13 is a cross-sectional side view of an arrow apparatus 600 according to an additional embodiment. As seen in this figure, exemplary arrow apparatus 600 may comprise an arrow shaft 620, an insert 640, and an arrow point 650. Similar to insert 40, insert 640 may comprise a threaded end 641, a lip portion 643, and a shank portion 644. In certain embodiments, shank portion 644 of insert 640 may be adhered, bonded, or otherwise affixed to the inner surface of arrow shaft 620. In addition, as opposed to having a discretely formed alignment structure (such as arrow point alignment structure 30), a tapered leading end 642, a tapered trailing end 645, a first substantially cylindrical portion 638, and a second substantially cylindrical portion 646 may be integrally formed with insert 640. As with arrow point alignment structure 30, in certain embodiments tapered leading end 642 and tapered trailing end 645 may be substantially frustoconical in shape. In addition, tapered leading end 642 may taper from a diameter approximately equal to the outer diameter of substantially cylindrical portion 646 to a diameter that is greater than or approximately equal to an outer diameter of arrow point 650.

In at least one embodiment, and as seen in FIG. 13, as threaded end 641 of insert 640 is threaded into arrow point 650, the inner surface of the internal taper defined in arrow point 650 may be brought to bear against the outer surface of tapered leading end 642, resulting in a tight engagement between arrow point 650 and arrow shaft 620. Similar to previous embodiments, the frustoconical shape of tapered leading end 642 may guide arrow point 650 into axial alignment with insert 640 and arrow shaft 620.

Figure 14:
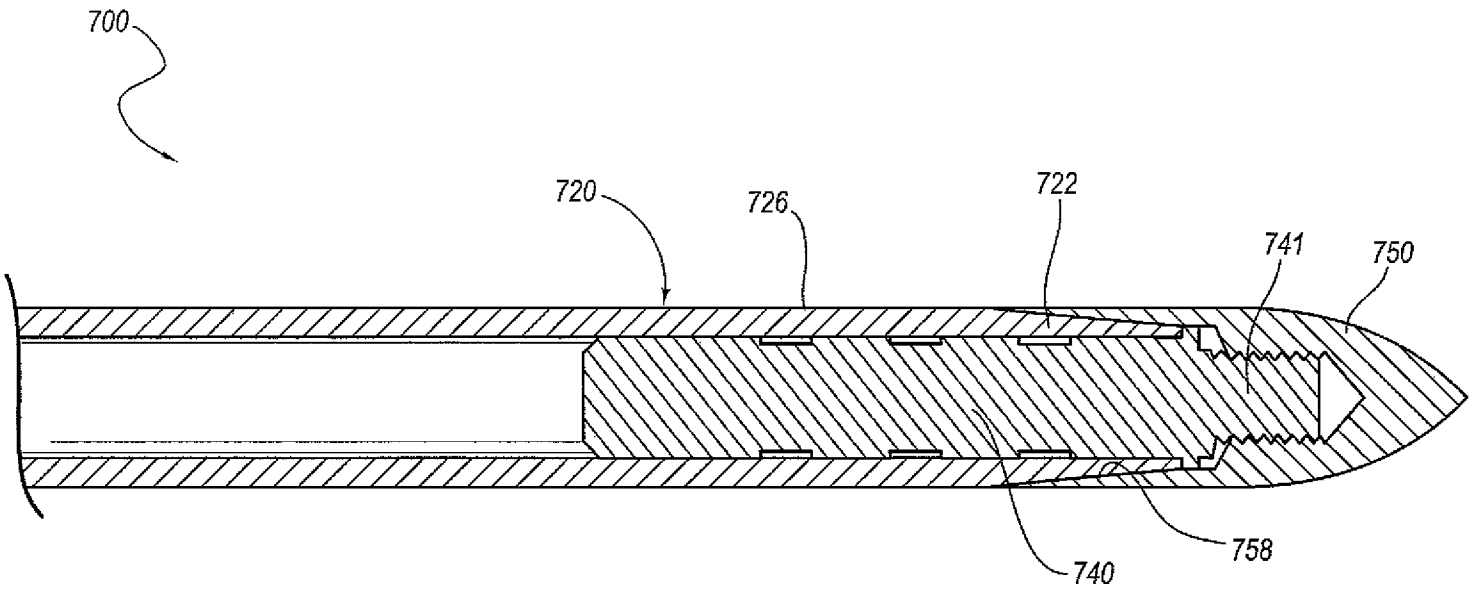
FIG. 14 is a cross-sectional side view of an arrow apparatus according to an additional embodiment.

FIG. 14 is a cross-sectional side view of an arrow apparatus 700 according to an additional embodiment. As seen in this figure, exemplary arrow apparatus 700 may comprise an arrow shaft 720, an insert 740, and an arrow point 750. Similar to the exemplary embodiment illustrated in FIG. 12, in at least one embodiment arrow shaft 720 may comprise a tapered leading end 722 and a substantially cylindrical portion 726 formed integrally with its outer surface. However, rather than comprising a tapered trailing end (such as tapered trailing end 524 in FIG. 12), the remainder of the outer surface of arrow shaft 720 may have a diameter that is substantially equal to the outer diameter of arrow point 550.

In at least one embodiment, and as seen in FIG. 14, as threaded end 741 of insert 740 is threaded into arrow point 750, the outer surface of tapered leading end 722 may be brought to bear against the inner surface of tapered portion 758 of the internal aperture defined within arrow point 750, resulting in a tight engagement between arrow point 750 and arrow shaft 720. Similar to previous embodiments, the frustoconical shape of tapered leading end 722 may guide arrow point 750 into axial alignment with arrow shaft 720.

Figure 15:
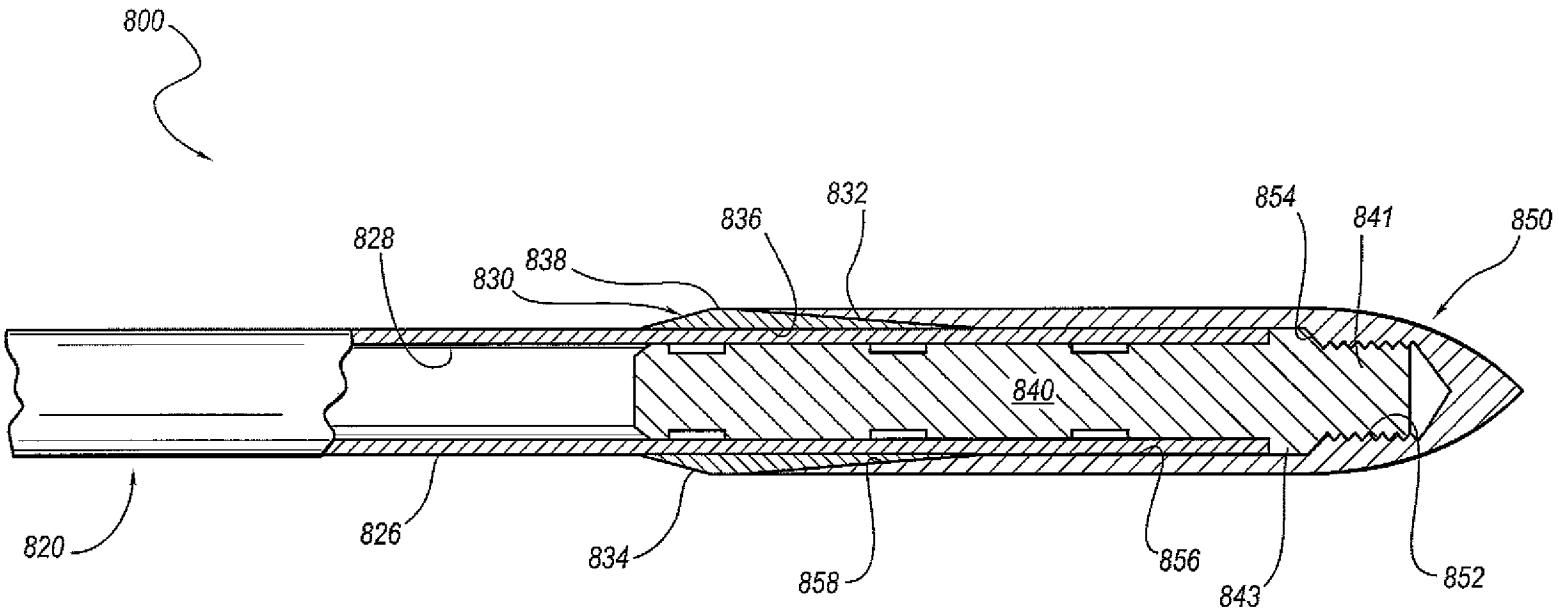
FIG. 15 is a cross-sectional side view of an arrow apparatus according to an additional embodiment.

FIG. 15 is a cross-sectional side view of an arrow apparatus 800 according to an additional embodiment. As seen in this figure, exemplary arrow apparatus 800 may comprise an arrow shaft 820, an arrow point alignment structure 830, an insert 840, and an arrow point 850. In at least one embodiment, arrow point alignment structure 830 may comprise a substantially cylindrical inner surface 836 and an outer surface comprising a tapered leading end 832, a tapered trailing end 834, and a substantially cylindrical portion 838. As with arrow point alignment structure 30 discussed above, the diameter of inner surface 836 of arrow point alignment structure 830 may be slightly greater than the outer diameter of arrow shaft 820 so that a portion of arrow shaft 820 may be disposed within arrow point alignment structure 830. In addition, an internal aperture may be defined within arrow point 850 comprising a threaded portion 852, a shoulder portion 854, a substantially cylindrical portion 856, and a tapered portion 858.

In at least one embodiment, the inner surface 836 of arrow point alignment structure 830 may be disposed about and contact an outer surface 826 of arrow shaft 820 without being adhered, bonded, or otherwise affixed to this outer surface 826. Thus, in certain embodiments, arrow point alignment structure 830 may be disposed about, but remain movable relative to, arrow shaft 820. Instead, in some embodiments, the tapered leading end 832 of arrow point alignment structure 830 may be adhered, bonded, or otherwise affixed to the tapered portion 858 of arrow point 850 to effectively secure arrow point alignment structure 830 to arrow apparatus 800.

In the exemplary embodiment illustrated in FIG. 15, and in contrast to certain previous embodiments, as threaded end 841 of insert 840 is threaded into and received by threaded portion 852 of arrow point 850, the beveled lip portion 843 of insert 840 may be brought to bear and rest against the beveled shoulder portion 854 of arrow point 850. In at least one embodiment, the beveled lip portion 843 of insert 840 may bear against the beveled shoulder portion 854 of arrow point 850 to securely attach arrow point 850 to arrow shaft 850 and to prevent threaded end 841 from being completely threaded into and within threaded portion 852 of arrow point 850.

In addition, as with certain previous embodiments, inner surface 836 of arrow point alignment structure 830 and outer surface 826 of arrow shaft 820 may be shaped such that, when arrow shaft 820 is disposed within arrow point alignment structure 830, arrow point alignment structure 830 may be brought into axial alignment with arrow shaft 820. In other words, the cylindrically shaped inner surface 836 of arrow point alignment structure 830 may be proportional to, and just slightly larger than, the cylindrically shaped outer surface 826 of arrow shaft 820 so that the longitudinal axes of arrow shaft 820 and arrow point alignment structure 830 are brought into alignment with one another when arrow shaft 820 is inserted and disposed within arrow point alignment structure 830. Similarly, the tapered leading end 832 of arrow point alignment structure 830 may be shaped so as to bring arrow point 850 into axial alignment with arrow point alignment structure 830. In other words, as seen in FIG. 15, as the tapered portion 858 of the internal aperture defined within arrow point 850 mates with and is brought to bear against the outer surface of tapered leading end 832 of arrow point alignment structure 830, the frustoconical shape of tapered leading end 832 may guide arrow point 850 into axial alignment with arrow point alignment structure 830.

As with previous embodiments, arrow point alignment structure 830 may be manufactured in any number of shapes and sizes and may be adapted for use with arrow shafts of differing diameters. For example, arrow point 850 may be adapted to fit or mate with an arrow shaft 820 of any outer diameter simply by choosing an arrow point alignment structure 830 that comprises an inner surface 836 having a diameter that is just slightly larger than the outer diameter of the desired arrow shaft 820. In many embodiments, after an appropriate alignment structure 830 is selected, the tapered leading end 832 of arrow point alignment structure 830 may be adhered, bonded, or otherwise affixed to the tapered portion 858 of arrow point 850 to effectively secure arrow point alignment structure 830 to arrow point 850. In this exemplary embodiment, the inner surface 836 of arrow point alignment structure 830 may be disposed about and contact an outer surface 826 of arrow shaft 820 without being adhered, bonded, or otherwise affixed to this outer surface 826. Thus, in the exemplary embodiment illustrated in FIG. 15, a single arrow point (such as arrow point 850) may be adapted for use with a plurality of arrow shafts of differing diameters by matching the arrow point with an alignment structure having an inner diameter that corresponds to the outer diameter of the arrow shaft, thus eliminating the need to manufacture discrete arrow points for each desired arrow shaft diameter.

As detailed above, any of the various arrow apparatuses described and/or illustrated herein may comprise a broadhead-type arrow point, as opposed to the field point-type arrow points previously described and illustrated. For example, as illustrated in the cross-sectional view of FIG. 16, an exemplary arrow apparatus 900 may comprise an arrow shaft 920, an arrow point alignment structure 930, an insert 940, and a broadhead arrow point 950. Broadhead arrow point 950 generally represents any form or type of broadhead; including, for example, unitary, expandable, and replaceable fixed-blade broadheads. In at least one embodiment, broadhead arrow point 950 comprises a plurality of blades 952, each of which extends from a common frontal point to a base. In certain embodiments, the base of each blade 952 may be connected to a tapered collar 954. Tapered collar 954 may define a central aperture that is in axial alignment with a central hub structure 956 formed in the broadhead interior of each blade 952 and positioned between the point of convergence of the blades and tapered collar 954. Central hub structure 956 may comprise a plurality of internal threads 958 configured to receive and threadably mate with threaded end 941 of insert 940.

In at least one embodiment, the inner surface of tapered collar 954 may embody the inverse of the generally frustoconical shape of a tapered leading end 932 of arrow point alignment structure 930. In addition, the diameter of tapered leading end 932 of arrow point alignment structure 930 may taper from a diameter approximately equal to the outer diameter of arrow shaft 920 to a diameter that is greater than or substantially equal to an outer diameter of tapered collar 954. Similar to the exemplary embodiment illustrated in FIG. 15, in at least one embodiment the tapered leading end 932 of arrow point alignment structure 930 may be adhered, bonded, or otherwise affixed to the tapered inner surface of tapered collar 954 of broadhead arrow point 950. In this exemplary embodiment, as threaded end 941 of insert 940 is threaded into central hub structure 956, the beveled lip portion 943 of insert 940 may be brought to bear against the beveled bottom face 957 of central hub structure 956. In at least one embodiment, the beveled lip portion 943 of insert 940 may bear against the beveled bottom face 957 of central hub structure 956 to securely attach broadhead arrow point 950 to arrow shaft 920 and to prevent threaded end 941 from being completely threaded into and within central hub structure 956.

As mentioned above, any one of the various arrow apparatuses described and/or illustrated herein may be adapted for use with so-called hidden insert technology, such as the hidden insert embodiments described and illustrated in U.S. Pat. Nos. 7,004,859 and 7,115,055. For example, as illustrated in the cross-sectional side view of FIG. 17, an exemplary arrow apparatus 1000 may comprise an arrow shaft 1020, an arrow point alignment structure 1030, and an arrow point 1050 attached to a hidden insert 1060 by an adapter 1040. In at least one embodiment, arrow point alignment structure 1030 may be adhered, bonded, or otherwise affixed to the outer surface of arrow shaft 1020.

Figure 17:
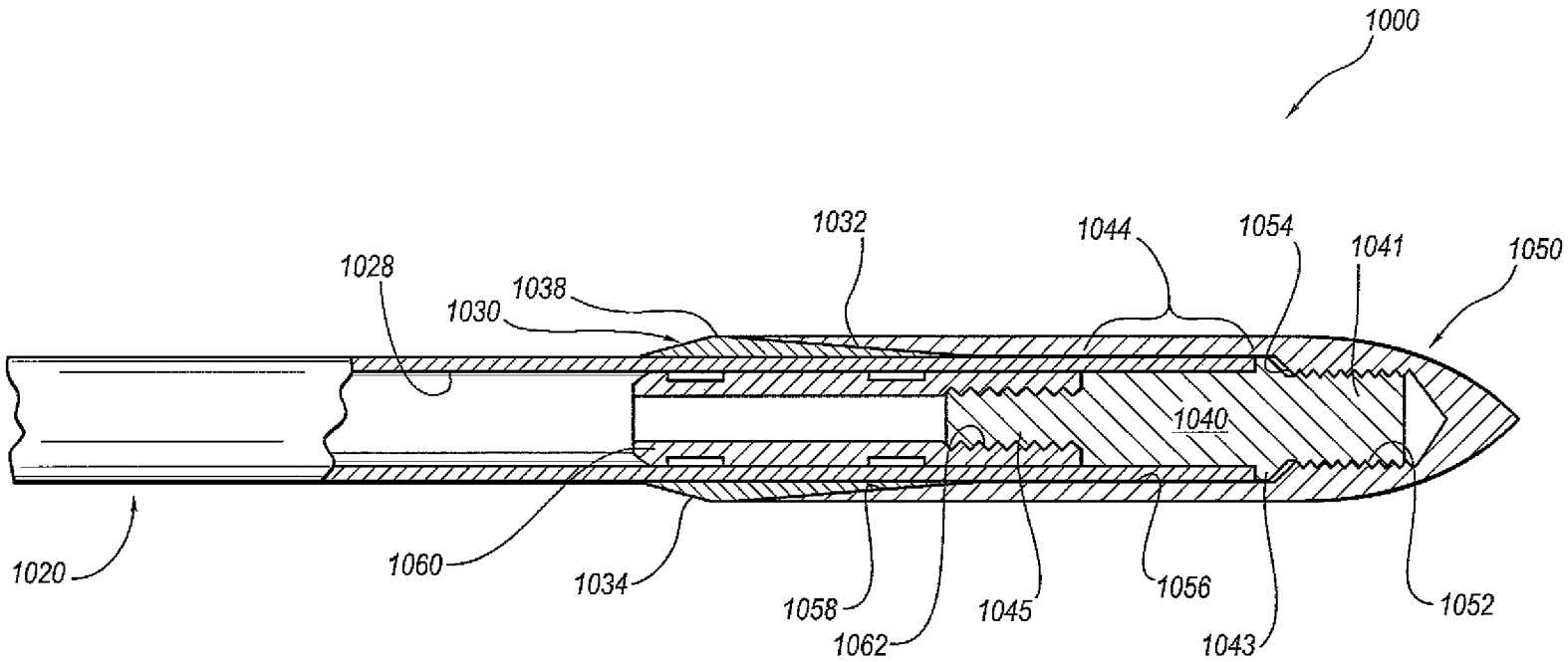
FIG. 17 is a cross-sectional side view of an arrow apparatus according to an additional embodiment.

Adapter 1040 generally represents any type or form of structure capable of removably attaching an arrow point, such as arrow point 1050, to an insert disposed within an arrow shaft, such as hidden insert 1060. Adapter 1040 may be formed in any number of shapes and sizes and of any combination of materials, such as aluminum, stainless steel, brass, or the like. The size of adapter 1040 may also be adapted as necessary for use with arrow shafts of varying sizes and diameters. In the exemplary embodiment illustrated in FIG. 17, adapter 1040 may comprise a first threaded end 1041, a lip portion 1043, a shank portion 1044, and a second threaded end 1045. In at least one embodiment, the diameter of shank portion 1044 and second threaded end 1045 may be less than the inner diameter of arrow shaft 1020 so that a portion of adapter 1040 (e.g., shank portion 1044 and second threaded end 1045) may be inserted within arrow shaft 1020, as seen in FIG. 17. In contrast, the diameter of lip portion 1043 may be greater than the inner diameter of arrow shaft 1020 to prevent adapter 1040 from being completely inserted within arrow shaft 1020. In at least one embodiment, the diameter of lip portion 1043 is substantially equal to the outer diameter of arrow shaft 1020.

Hidden insert 1060 generally represents any type or form of insert capable of being completely disposed within the shaft of an arrow, such as arrow shaft 1020. In many embodiments, the outer surface of hidden insert 1060 may be adhered, bonded, or otherwise affixed to the inner surface of arrow shaft 1020 to securely affix hidden insert 1060 within arrow shaft 1020. In at least one embodiment, hidden insert 1060 comprises a threaded portion 1062 configured to threadably receive an opposing structure, such as the second threaded end 1045 of adapter 1040. For example, as illustrated in FIG. 17, threaded portion 1062 may be configured to threadably receive and mate with the second threaded end 1045 of adapter 1040 to removably and securely attach adapter 1040 to hidden insert 1060 and, in turn, arrow shaft 1020.

In the exemplary embodiment illustrated in FIG. 17, the first threaded end 1041 of adapter 1040 may be threaded into and mate with a threaded portion 1052 of arrow point 1050. In addition, as the first threaded end 1041 of adapter 1040 is threaded into threaded portion 1052 of arrow point 1050, a tapered portion 1058 of arrow point 1050 may contact, and more specifically may receive and mate with, a tapered leading end 1032 of arrow point alignment structure 1030. That is, tapered portion 1058 may embody the inverse of the generally frustoconical shape of tapered leading end 1032 of arrow point alignment structure 1030 such that, as the first threaded end 1041 of adapter 1040 is threaded into threaded portion 1052 of arrow point 1050, the outer surface of tapered leading end 1032 may be brought to bear against the tapered portion 1058 of the internal aperture defined within arrow point 1050, resulting in a tight engagement between arrow point 1050 and arrow point alignment structure 1030, and thus alignment between arrow point 1050 and arrow shaft 1020.

In at least one embodiment, arrow point alignment structure 1030 may be positioned on arrow shaft 1020 so as to prevent first threaded end 1041 of adapter 1040 from being completely threaded into threaded portion 1052 of arrow point 1050. In other words, the distance between the tapered leading end 1032 of arrow point alignment structure 1030 and the leading end of arrow shaft 1020 may be chosen such that, as adapter 1040 is threaded into arrow point 1050, the outer surface of tapered leading end 1032 may bear against the inner surface of tapered portion 1058 of the internal aperture defined within arrow point 1050 to prevent lip portion 1043 from contacting shoulder portion 1054 of arrow point 1050. Alternatively, the distance between the tapered leading end 1032 of arrow point alignment structure 1030 and the leading end of arrow shaft 1020 may be chosen so that lip portion 1043 bears against shoulder portion 1054 of arrow point 1050 at the same time that the outer surface of tapered leading end 1032 bears against the tapered portion 1058 of the internal aperture defined within arrow point 1050.

The exemplary adapter illustrated in FIG. 17 may also be used in connection with broadhead-type arrow points, as opposed to the field point-type arrow points previously described and illustrated. For example, as illustrated in the cross-sectional view of FIG. 18, an exemplary arrow apparatus 1100 may comprise an arrow shaft 1120, an arrow point alignment structure 1130, and a broadhead arrow point 1150 attached to a hidden insert 1160 by an adapter 1140. In at least one embodiment, arrow point alignment structure 1130 may be adhered, bonded, or otherwise affixed to the outer surface of arrow shaft 1120. In addition, as with previous embodiments, hidden insert 1160 may comprise a threaded portion 1162 configured to threadably receive an opposing structure, such as the second threaded end 1145 of adapter 1140. For example, as illustrated in FIG. 18, threaded portion 1162 may be configured to threadably receive and mate with the second threaded end 1145 of adapter 1140 to removably and securely attach adapter 1140 to hidden insert 1160 and, in turn, arrow shaft 1120.

Figure 18:
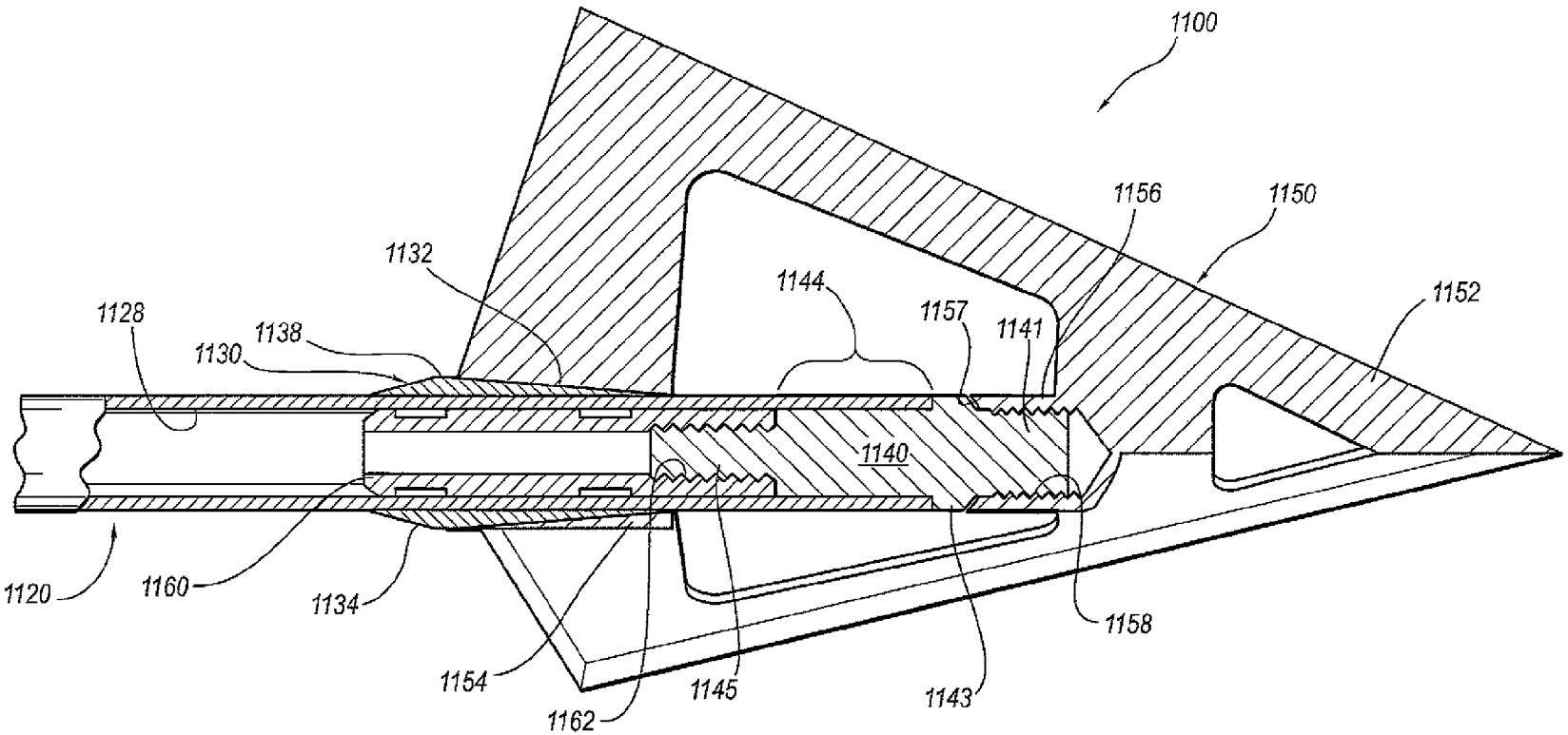
FIG. 18 is a cross-sectional side view of an arrow apparatus according to an additional embodiment.

In addition, in the exemplary embodiment illustrated in FIG. 18, the first threaded end 1141 of adapter 1140 may be threaded into and mate with internal threads provided within a central hub structure 1156 of arrow point 1150. In addition, as the first threaded end 1141 of adapter 1140 is threaded into central hub structure 1156 of arrow point 1150, the inner surface of a tapered collar 1154 of arrow point 1150 may contact, and more specifically may receive and mate with, a tapered portion 1132 of arrow point alignment structure 1130. That is, the tapered inner surface of tapered collar 1154 may embody the inverse of the generally frustoconical shape of tapered leading end 1132 of arrow point alignment structure 1130 such that, as the first threaded end 1141 of adapter 1140 is threaded into central hub structure 1156 of arrow point 1150, the outer surface of tapered leading end 1132 may be brought to bear against the inner surface of tapered 1154 of arrow point 1150, resulting in a tight engagement between arrow point 1150 and arrow point alignment structure 1130, and thus alignment between the arrow point 1150 and arrow shaft 1120.

As with previous embodiments, arrow point alignment structure 1130 may be positioned on arrow shaft 1120 so as to prevent first threaded end 1141 of adapter 1140 from being completely threaded into central hub structure 1156 of arrow point 1150. In other words, the distance between the tapered leading end 1132 of arrow point alignment structure 1130 and the leading end of arrow shaft 1120 may be chosen such that, as adapter 1140 is threaded into central hub structure 1156 of arrow point 1150, the outer surface of tapered leading end 1132 may bear against the inner surface of tapered collar 1154 of arrow point 1150 to prevent lip portion 1143 from contacting the bottom face 1157 of central hub structure 1156. Alternatively, the distance between the tapered leading end 1132 of arrow point alignment structure 1130 and the leading end of arrow shaft 1120 may be chosen so that lip portion 1143 bears against face 1157 of central hub structure 1156 at the same time that the outer surface of tapered leading end 1132 bears against the inner surface of tapered collar 1154 of arrow point 1150.

Figure 19:
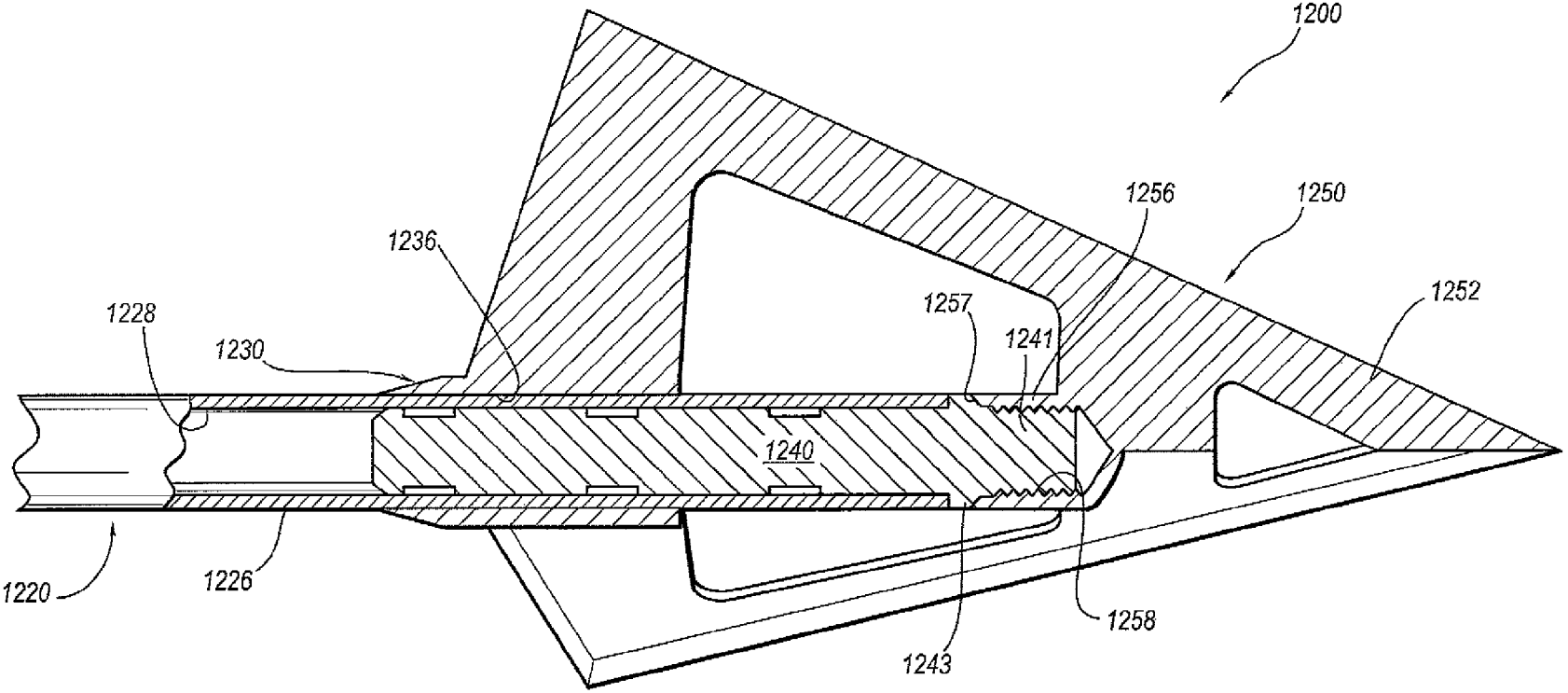
FIG. 19 is a cross-sectional side view of an arrow apparatus according to an additional embodiment.
Figure 20:
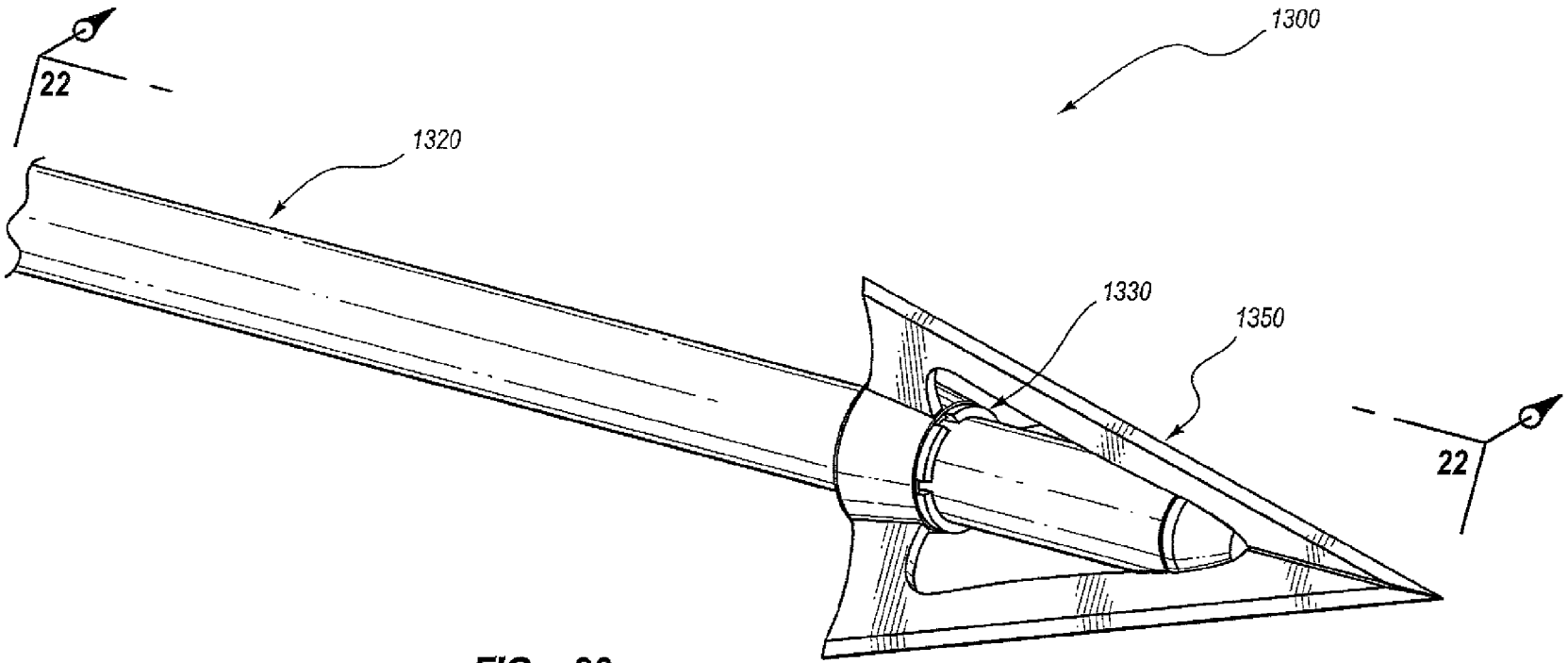
FIG. 20 is a perspective view of another example arrow apparatus in accordance with the present disclosure.
Figure 21:
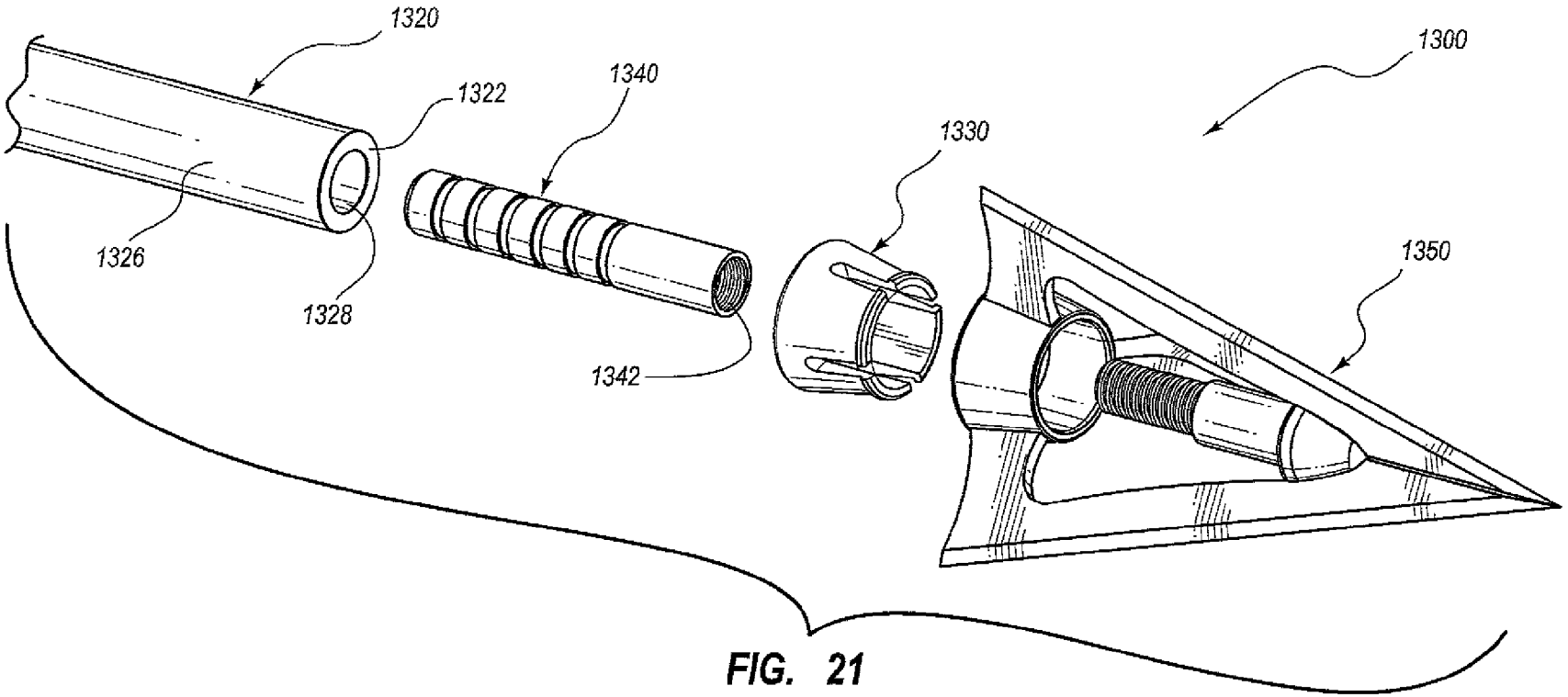
FIG. 21 is an exploded perspective view of the arrow apparatus of FIG. 20.

Although the various arrow point alignment structures described and/or illustrated herein have been characterized as discrete and separately formed elements, in at least one embodiment the alignment structure may be integrally formed with the arrow point. For example, as illustrated in the cross-sectional side view of FIG. 19, an arrow apparatus 1200 according to an additional embodiment may comprise an arrow shaft 1220, an insert 1240, and a broadhead arrow point 1250. In at least one embodiment, arrow point 1250 may comprise a plurality of blades 1252 that each extend from a common frontal point to a base. In certain embodiments, the base of each blade 1252 may be integrally formed with or connected to an arrow point alignment structure 1230. The arrow point alignment structure 1230 may define a central aperture that is in axial alignment with a central hub structure 1256 provided on the underside of each blade 1252 and positioned between the common frontal point and arrow point alignment structure 1230. Central hub structure 1256 may comprise a plurality of internal threads 1258 configured to receive and threadably mate with threaded end 1241 of insert 1240.

The arrow point alignment structure 1230 generally represents any type or form of structure capable of axially aligning arrow point 1250 with arrow shaft 1220. In at least one embodiment, arrow point alignment structure 1230 may be sized to contact, and more specifically receive and mate with, at least a portion of arrow shaft 1220. In addition, an inner surface 1236 of arrow point alignment structure 1230 may be shaped such that, when arrow shaft 1220 is disposed within arrow point alignment structure 1230, arrow point alignment structure 1230 (and thus, in turn, arrow point 1250) may be brought into axial alignment with arrow shaft 1220. In other words, the cylindrically shaped inner surface 1236 of arrow point alignment structure 1230 may be proportional to, and just slightly larger than, the cylindrically shaped outer surface 1226 of arrow shaft 1220 so that the longitudinal axes of arrow shaft 1220 and arrow point alignment structure 1230 are brought into axial alignment with one another when arrow shaft 1220 is inserted and disposed within arrow point alignment structure 1230. Arrow point 1250, and arrow point alignment structure 1230 integrally formed therewith, may also be manufactured in any number of sizes so as to be adapted for use with arrow shafts of differing diameters.

Figure 16:
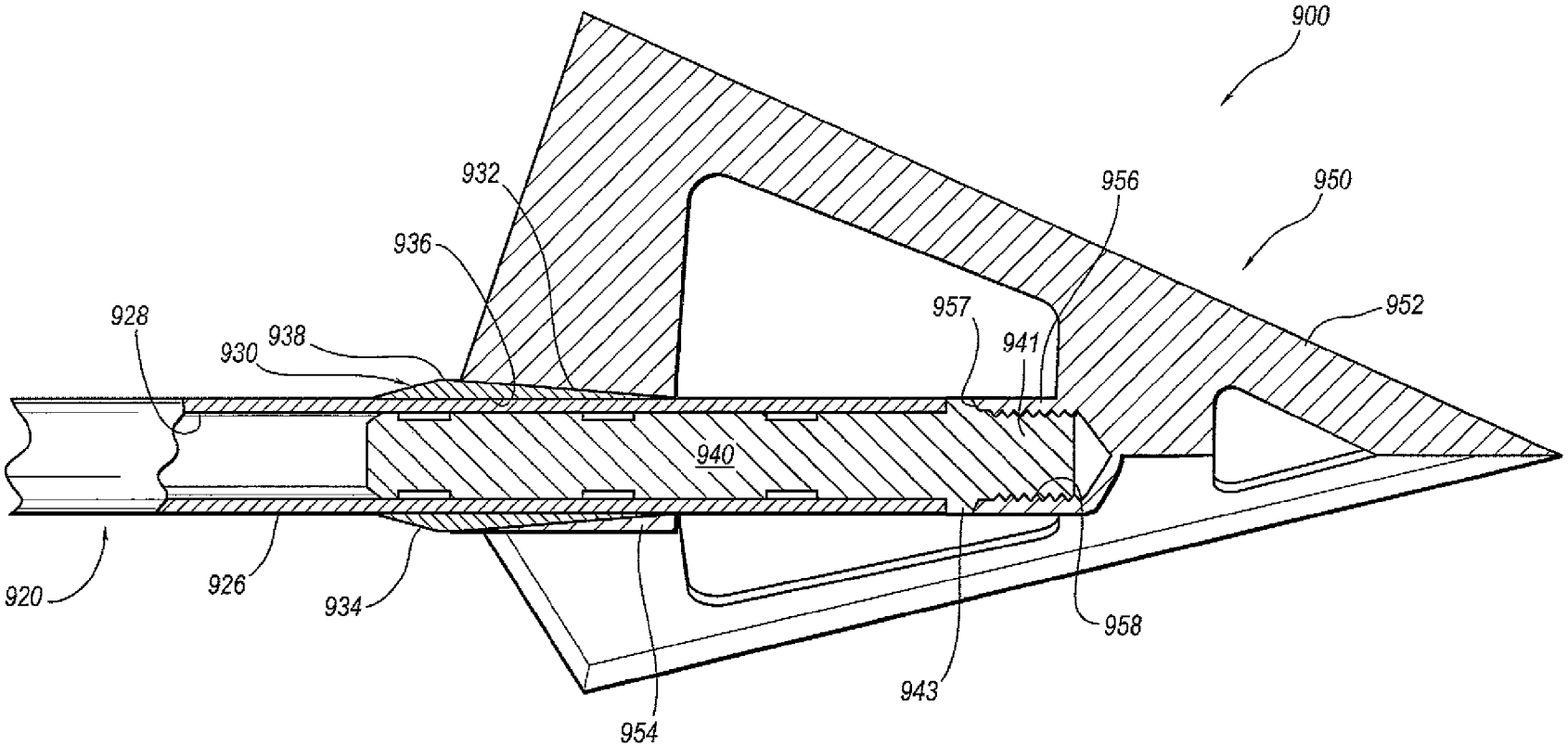
FIG. 16 is a cross-sectional side view of an arrow apparatus according to an additional embodiment.

Similar to the exemplary embodiments illustrated in FIGS. 15 and 16, as threaded end 1241 of insert 1240 is threaded into central hub structure 1256, the beveled lip portion 1243 of insert 1240 may be brought to bear against the beveled bottom face 1257 of central hub structure 1256. In at least one embodiment, the beveled lip portion 1243 of insert 1240 may bear against the beveled bottom face 1257 of central hub structure 1256 to securely attach arrow point 1250 to arrow shaft 1220 and to prevent threaded end 1241 from being completely threaded into and within central hub structure 1256.

Referring now to FIGS. 20-28, another example arrow apparatus 1300 is shown and described. The arrow apparatus includes an arrow shaft 1320, an arrow point alignment structure 1330, an insert 1340, and an arrow point 1350 (see FIGS. 20-23). Typically, the insert 1340 is secured inside the arrow shaft 1320 and may be spaced a distance $X_1$ (FIG. 22) from a distal end of the arrow shaft 1320. The distance $X_1$ is measured from a distal-most location of the insert 1340 to a distal end surface of the arrow shaft 1320.

Figure 22:
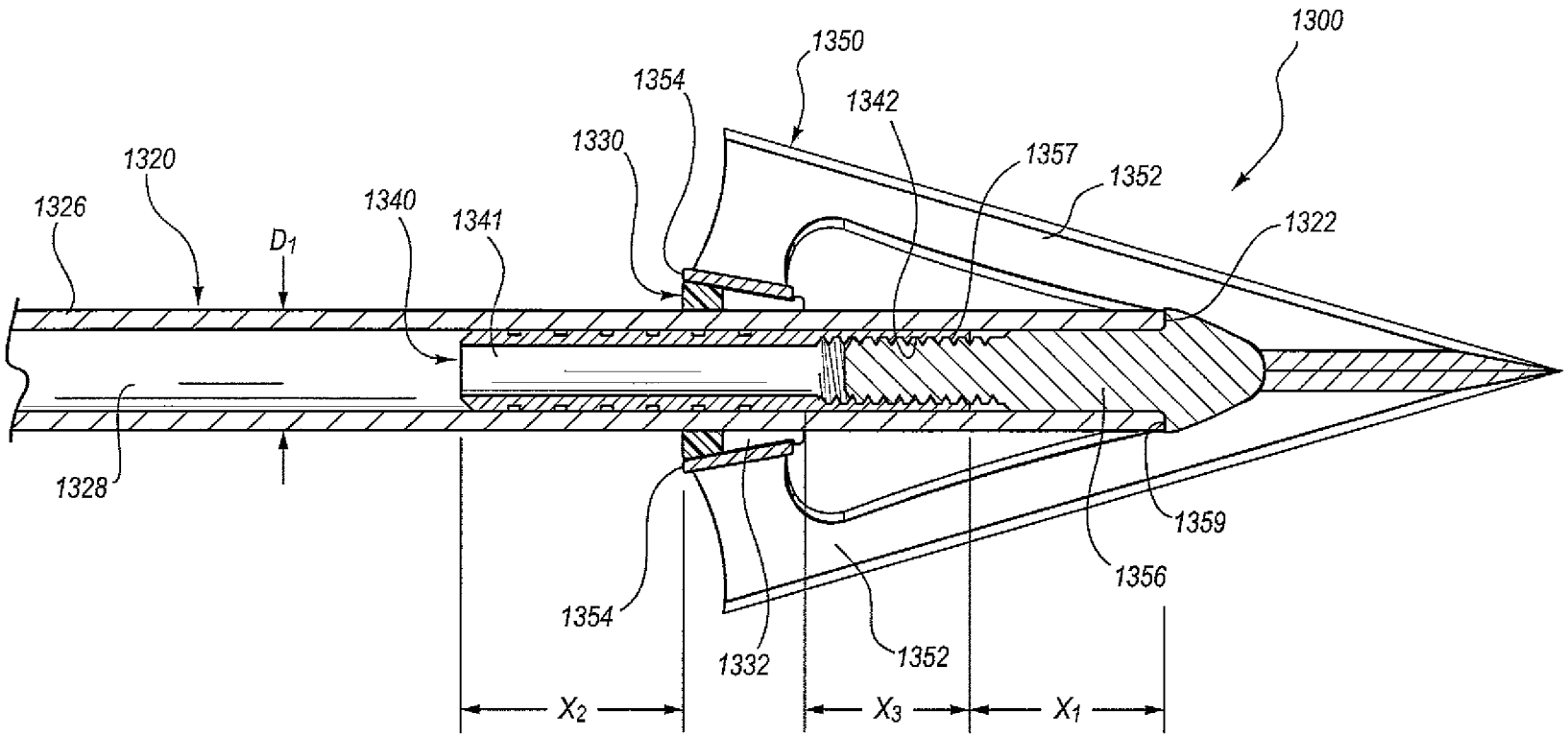
FIG. 22 is a cross-sectional side view of the arrow apparatus of FIG. 20 taken along cross section indicators 22-22.
Figure 25:
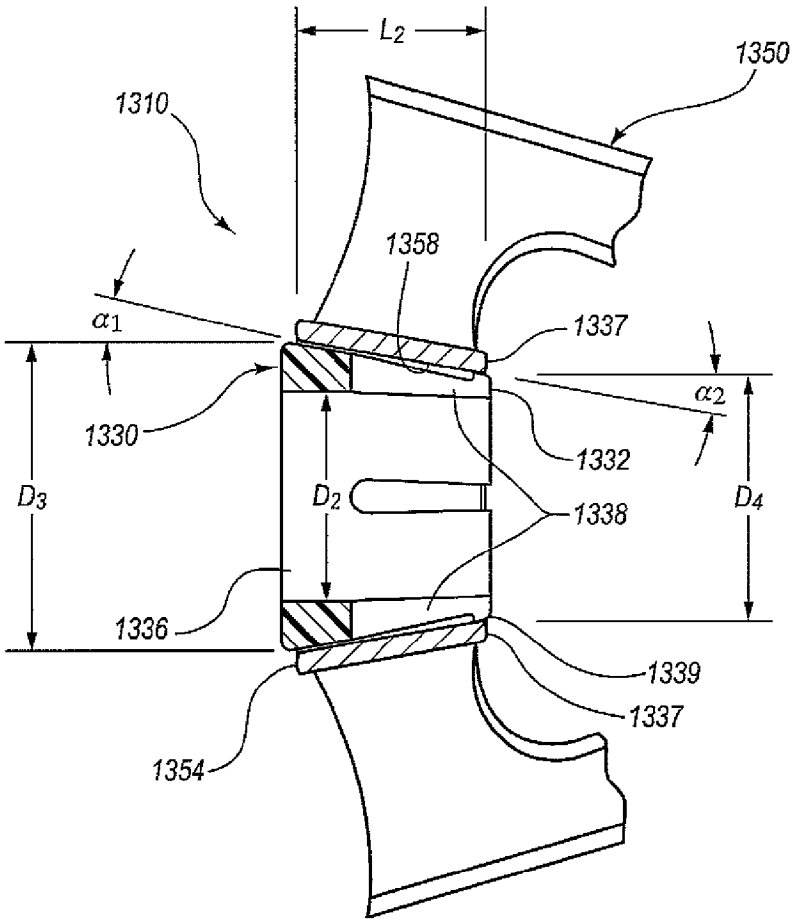
FIG. 25 is a detailed side view of the arrow point and arrow point alignment structure of FIG. 24 partially disassembled.
Figure 24:
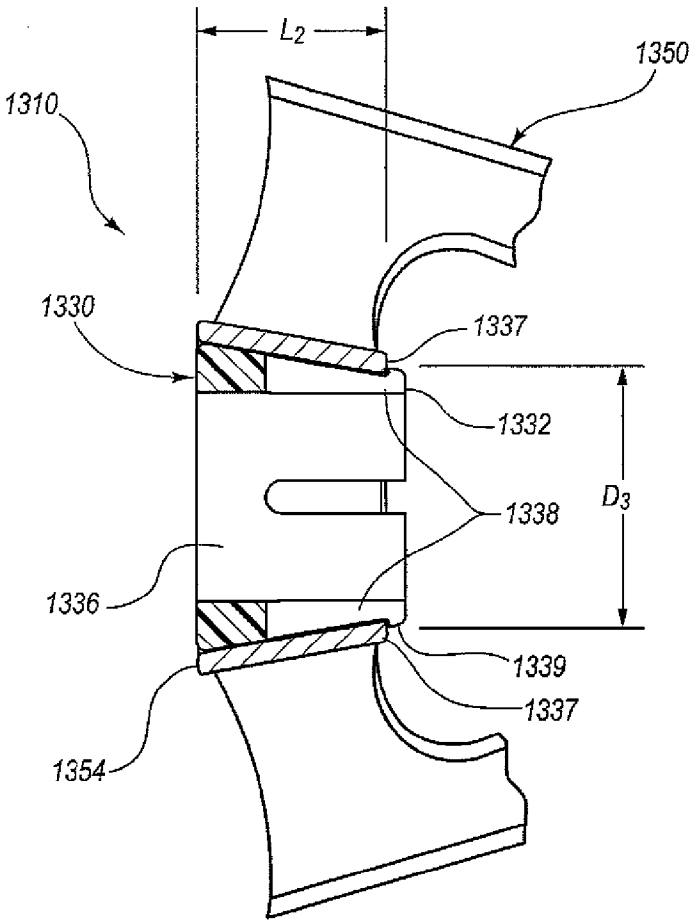
FIG. 24 is a detailed side view of the arrow point and arrow point alignment structure of the arrow apparatus of FIG. 20.
Figure 26:
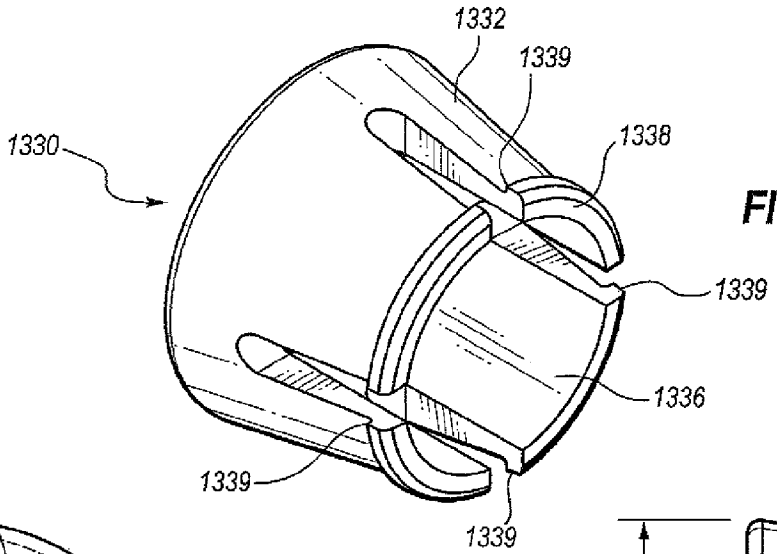
FIG. 26 is a perspective view of an arrow point alignment structure of the arrow apparatus of FIG. 20.

The arrow point alignment structure 1330 may be connected to the arrow point 1350 as part of an arrow point assembly 1310 (see FIGS. 24 and 25). The arrow point assembly 1310 may be mounted to the arrow shaft 1320 by connecting the arrow point 1350 to the insert 1340. A proximal-most point of the insert 1340 is positioned a distance $X_2$ from a proximal-most point of the arrow point assembly 1310 when the arrow apparatus 1300 is assembled (FIG. 22). In some arrangements the entire insert 1340 may be spaced proximal of the arrow point 1350. The distance $X_2$ may be equal to at least one diameter of arrow shaft 1320, and may alternatively be equal to two or more diameters of arrow shaft 1320.

Spacing a portion of the insert 1340 proximal of the arrow point assembly 1310 may help to avoid stress concentrations in the arrow shaft 1320 when transferring forces from the arrow point assembly 1310 to the arrow shaft 1320. In at least some arrangements, the distance $X_1$, the length of the insert 1340, or a combination of the distance $X_1$ and the length of the insert 1340 are designed to maximize the distance $X_2$ without adding unnecessary weight to the arrow apparatus 1300.

The arrow point alignment structure 1330 may closely surround, but not be affixed to, an exterior surface of the arrow shaft 1320. Thus, alignment structure 1330 may slide over the shaft 1320 when connecting/disconnecting the arrow point assembly 1310 relative to the insert 1340. An internal diameter of the arrow point alignment structure 1330 may be sized for a particular arrow shaft outer diameter. In one embodiment, a slight friction fit between the alignment structure 1330 and the outer surface 1326 of the shaft will be present, allowing relative movement by overcoming the small amount of friction. In some arrangements, arrow point alignment structures 1330 of different sized internal diameter may be selected for mounting a given arrow point 1350 to an arrow shaft 1320 having a particular outer diameter.

Figure 23:
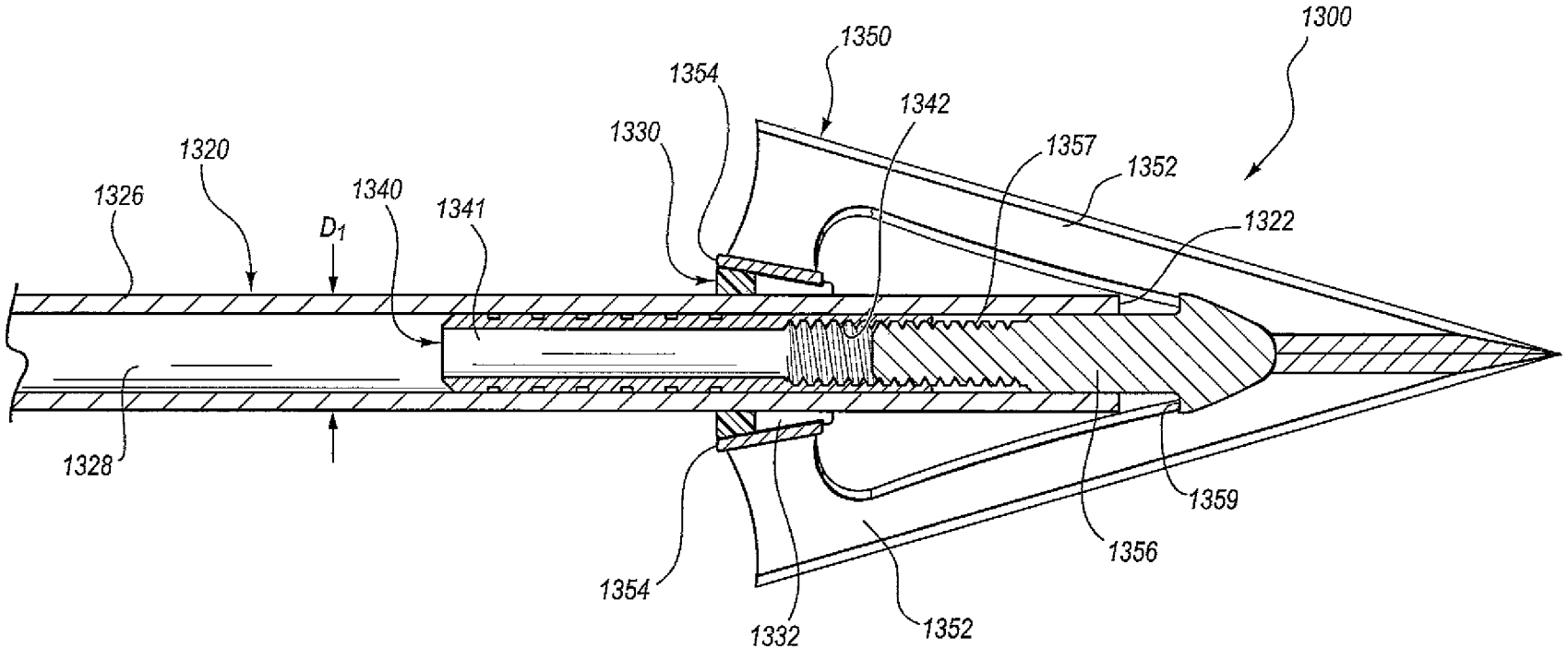
FIG. 23 is a cross-sectional side view of the arrow apparatus of FIG. 22 partially disassembled.

The arrow shaft 1320 may include a leading end surface 1322, an outer surface 1326, and an inner cavity 1328 (see FIGS. 22 and 23). The arrow shaft 1320 may have an outer diameter $D_1$. The outer diameter $D_1$ may be constant along a length of the arrow shaft 1320. However, some arrow shaft constructions may have a tapered portion or have a variable outer diameter wherein the outer diameter $D_1$ may be different at various locations along a length of the arrow shaft 1320.

The arrow point alignment structure 1330 is shown in detail in FIGS. 24-28. The arrow point alignment structure 1330 may include a tapered leading end 1332, an inner surface 1336, a plurality of flexible arms 1338, each of which includes a lip 1339. The flexible arms 1338 may be positioned about the tapered leading end 1332. Each lip 1339 may be positioned at a distal-most location of each flexible arm 1338. There are many potential constructions for the arrow point alignment structure 1330 that may include various structural configurations of the lips 1339, different numbers of flexible arms 1338, or other features that may assist in providing connection between the arrow point alignment structure 1330 and the arrow point 1350.

Figure 28:
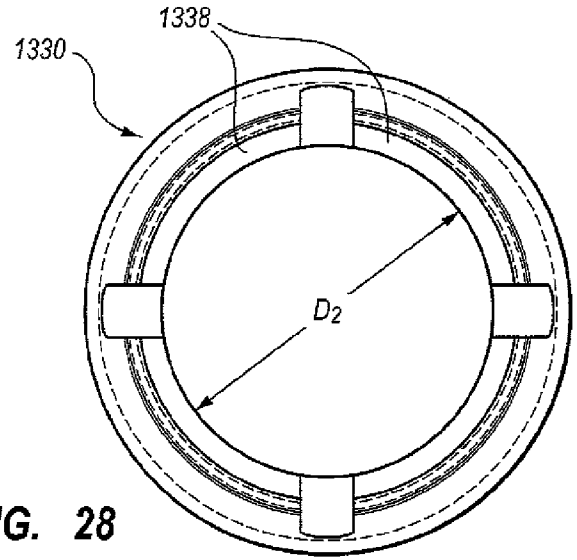
FIG. 28 is a front view of the arrow point alignment structure of FIG. 26.
Figure 29:
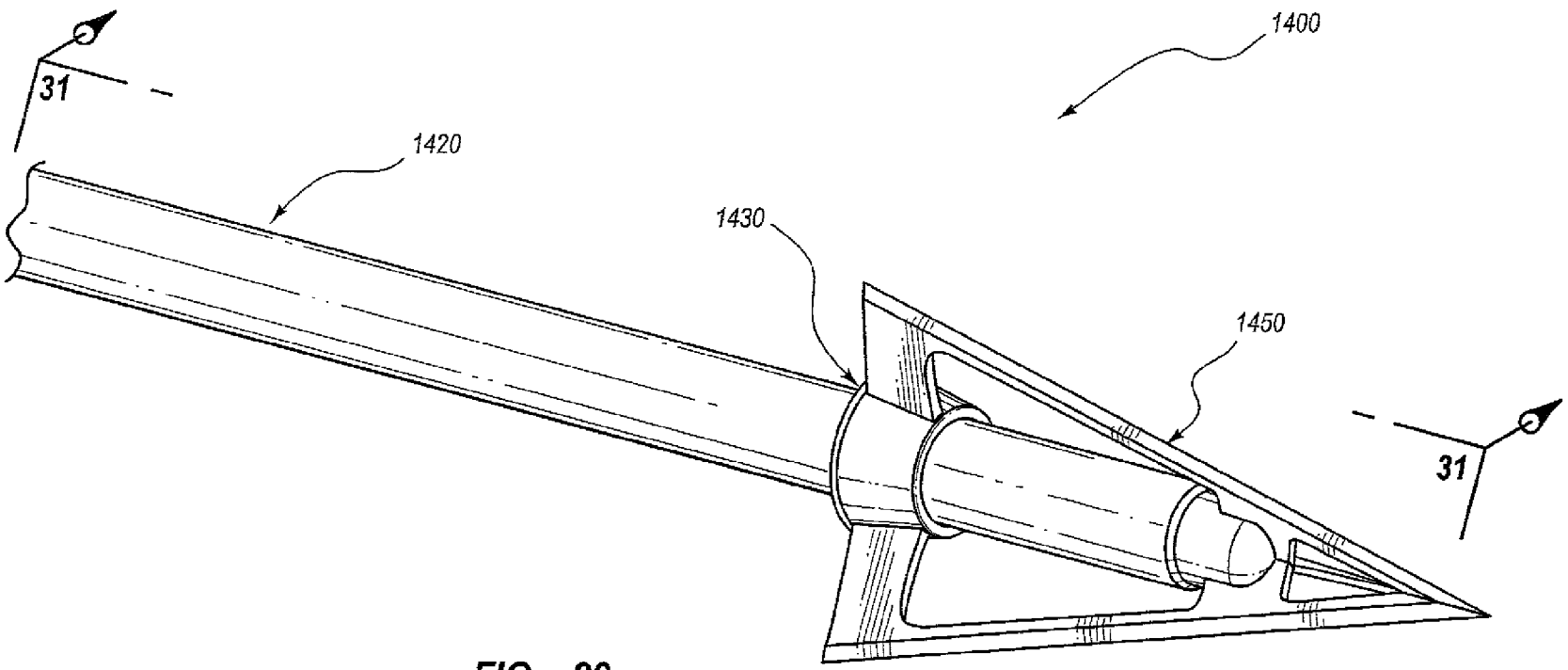
FIG. 29 is a perspective view of another example arrow apparatus in accordance with the present disclosure.
Figure 30:
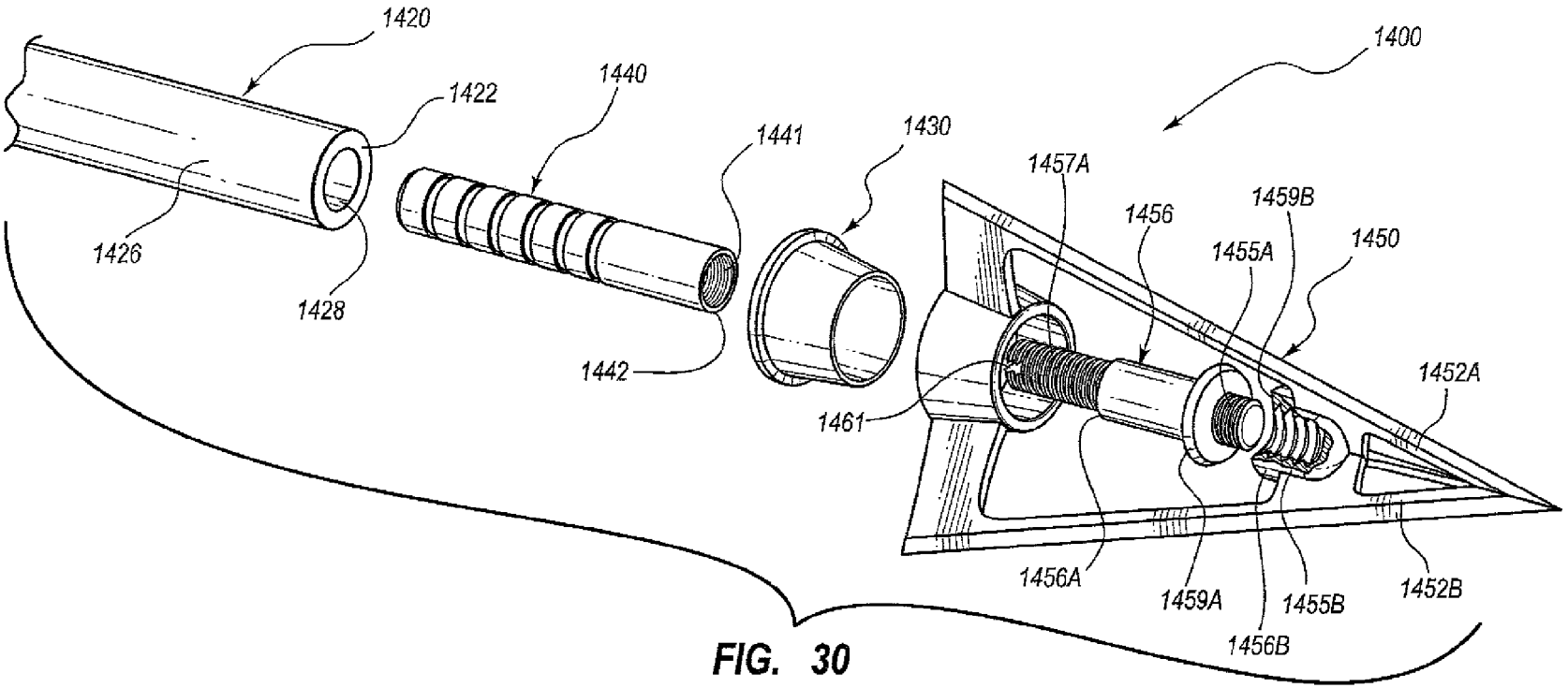
FIG. 30 is an exploded perspective view of the arrow apparatus of FIG. 20.

The arrow point alignment structure 1330 may include an inner diameter $D_2$ along the inner surface 1336 (see FIGS. 25 and 28). The inner diameter $D_2$ may be constant. The inner diameter $D_2$ may be substantially similar to the outer diameter $D_1$ of the arrow shaft 1320, as mentioned. The inner diameter $D_2$ is typically only slightly greater than the outer diameter $D_1$ to permit relative movement between the arrow point alignment structure 1330 and the arrow shaft 1320, whether or not the arrow point alignment structure 1330 is connected to the arrow point 1350, so that the arrangement provide shaft-enhanced rigidity and alignment to the arrow point 1350.

The collar or bushing can be manufactured from a variety of materials. It may be machined from a metal such as aluminum alloy or stainless steel. In addition to machined metal bushings, the bushing can be injection molded out of relatively rigid polymer such as glass-filled nylon. IN any of these cases, the bushing will be bonded to the OD of the arrow shaft. To accomplish this, the ID of the collar may be precisely matched to the OD of the arrow shaft, with the collar ID being 0.001-0.010 inches larger than the arrow OD, to allow for an adhesive gap. The exact size of the adhesive gap is dependent upon the adhesive chosen, which will be understood by those skilled in the art. This approach requires a unique size of bushing for every arrow OD, which is relatively impractical and costly in production.

Another approach may be to manufacture the collar or bushing from a material which is more flexible or compliant. These could be a true rubber, a softer grade of polymer, such as a nylon without glass filling, or certain polycarbonates or butyrates. In addition, it could be made from a thermoplastic elastomer (TPE), which are processed on thermoplastic molding equipment, but exhibit rubber-like properties such as flexibility and low compression set. Examples of TPEs are DuPont EPTV™, Mitsubishi Primalloy™, and ExxonMobil Santoprene™.

These types of materials accommodate a broader range of shaft ODs by stretching over the outside diameter. As such, they do not need to be bonded to the shaft. Depending upon the material chosen and its properties, the ID of the bushing might be from 0.001 inch larger than the OD of the shaft, or it could be up to 0.010 inches smaller.

The arrow point alignment structure 1330 may also have a maximum outer diameter $D_3$. The outer diameter $D_3$ is typically sized to limit relative axial movement between the arrow point alignment structure 1330 and the arrow point 1350 in at least one direction (e.g., the distal direction).

A comparison of FIGS. 24 and 25 illustrates how the flexible arms 1338 may flex radially inward while inserting the arrow point alignment structure 1330 into the broadhead arrow point assembly 1350. Typically, the arrow point alignment structure 1330 has a leading end external diameter $D_5$ (FIG. 27) measured at the lip 1339 when the arms 1338 are in an unflexed or rest state. The diameter $D_5$, measured when the arrow point alignment structure 1330 is in a rest state, is typically greater than a minimum diameter $D_4$ of a collar portion 1354 of the arrow point assembly 1350 inside of which the arrow point alignment structure 1330 is inserted.

Figure 27:
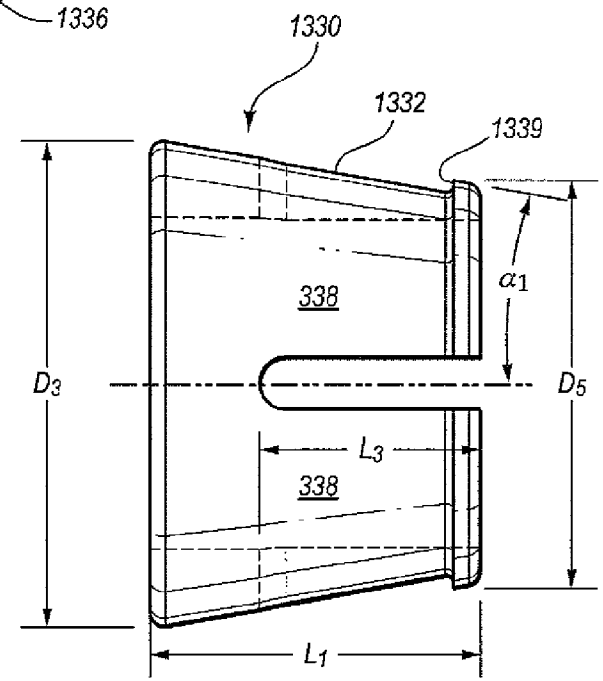
FIG. 27 is a side view of the arrow point alignment structure of FIG. 26.

The flexible arms 1338 typically have a length $L_3$ (FIG. 27), which permits some flexing of the flexible arms 1338 radially inward at least at the location of the lip 1339 (see FIG. 27). The flexibility of flexible arms 1338 may permit a reduction in the outer profile at the tapered leading end 1332 when inserting the arrow point alignment structure 1330 into the arrow point 1350. The flexible arms 1338 may flex back to a rest position once inserted into the arrow point 1350 to a position where the lip 1339 engages a stop surface 1337 of the arrow point 1350 to provide a snap-fit connection (see FIG. 24). The snap-fit connection may be releasable by flexing the flexible arms 1338 radially inward again to release the lip 1339 from the stop surface 1337 of the arrow point 1350. Typically, the snap-fit connection is not releasable from the arrow point 1350 when the arrow point assembly 1310 is mounted to the arrow shaft 1320.

Other types of connections are possible between the arrow point alignment structure 1330 and the arrow point 1350. Some example connections include, for example and without limitation, an interference fit, a key fit, a twist-lock connection (e.g., a bayonet lock), or the use of adhesives or other bonding techniques that provide a permanent connection between the arrow point alignment structure 1330 and the arrow point 1350.

The arrow point 1350 may be constructed with broadhead features such as a plurality of blades 1352. The arrow point 1350 may also include a tapered collar 1354 having the minimum diameter $D_4$ (see FIG. 25), and a central connection member or portion comprising a shank portion 1356. The tapered collar 1354 defines a tapered portion or tapered surface 1358. The tapered surface 1358 may extend at a taper angle $\alpha_2$. A distal-most end of the insert 1340 may be spaced a distance $X_3$ (see FIG. 22) from a distal end of tapered collar 1354 to help reduce stress concentrations in the arrow shaft 1320.

The central connection member comprising the shank portion 1356 may include a plurality of threads 1357 and an abutment shoulder 1359. The threads 1357 may be configured to threadably connect with internal threads of a threaded cavity 1341 of the insert 1340. A leading end 1342 of the insert 1340 is typically spaced a distance $X_1$ from the leading end surface 1322 of the arrow shaft 1320. Other example inserts for use with the arrow apparatus 1300 are disclosed in U.S. Pat. Nos. 7,004,859 and 7,115,055, which patents are incorporated by reference above.

The abutment shoulder 1359 is arranged and configured to contact the leading end surface 1322 of the arrow shaft 1320. Contract between the leading end surface 1322 and the abutment shoulder 1359 typically defines a final stop position or connection position of the arrow point 1350 relative to the arrow shaft 1320. In this final stop position, at least some of the threads 1357 may remain outside of the insert 1340, or at least some of the threads of the threaded cavity 1341 are not engaged with the threads 1357. In other arrangements, all of the threads 1357 are positioned within the insert 1340.

An interface between the leading end surface 1322 of the arrow shaft 1320 and the abutment shoulder 1359 of the arrow point 1350 is typically the only interface between the arrow shaft 1320 and the arrow point 1350 in a longitudinal direction. The only other contact along an exterior surface 1326 of the arrow shaft 1320 is at the inner surface 1336 of the arrow point alignment structure 1330 at a location spaced proximal of the leading end surface 1322. The contact between the arrow point alignment structure 1330 and the arrow shaft 1320 is at least in part in the lateral direction. Thus, some of the lateral forces from the arrow point 1350 may be transferred to the arrow shaft via the arrow point alignment structure 1330. Furthermore, the angled construction of the shank portion 1356 may permit transfer of some axial forces in the arrow point 1350 to the arrow shaft 1320 via the arrow point alignment structure 1330.

The taper angle $\alpha_2$ of the arrow point 1350 is typically substantially the same as a taper angle $\alpha_1$ of the tapered leading end 1332 of the arrow point alignment structure 1330 (see FIG. 25). Providing the taper angles $\alpha_1$, $\alpha_2$ substantially the same may assist in providing axial alignment between the arrow point alignment structure 1330 and the arrow point 1350. Typically, the taper angles $\alpha_1$, $\alpha_2$ are in the range of about 10° to about 45°, and more preferably about 15° to about 30°.

The shank portion 1356 may be integrally formed as a single piece with the blades 1352 of the arrow point 1350. In at least one example, the arrow point 1350 is formed using a casting process wherein all features of the arrow point 1350 are formed in a single step. Other manufacturing processes such as stamping, grinding, cutting, and molding may be used to form the arrow point 1350. In one example, powder metal injection molding (MIM) may be used to form at least some portions of the arrow point 1350.

In other examples, the shank portion 1356 may be formed as a separate piece from the blades 1352, and the shank portion 1356 and blades 1352 are connected in a separate assembly step. The shank portion 1356 may be connected to the blades 1352 using, for example and without limitation, welding (e.g., laser welding), adhesives, or other bonding techniques.

Providing the arrow point 1350 with a shank portion 1356 permits mounting of the arrow point 1350 to an arrow shaft 1320 having an insert 1340 mounted therein, and then replacing the arrow point 1350 with a different arrow point. The different arrow point may be constructed for use with the arrow shaft 1320 without the use of the arrow point alignment structure 1330. In one example, the arrow point 1350 may be replaced with a standard field point that also includes a shank portion having threads and an abutment shoulder that defines a stop position for the field point when mounted to the arrow shaft 1320.

The arrow point 1350 may comprise a metal material, metal alloy, or other material with sufficient strength and hardness properties such as various types of polymer or composite materials. The arrow point alignment structure 1330 may comprise, for example, a metal material or a polymer material, as will be understood by those skilled in the art.

The arrow point alignment structure 1330 may have various lengths, thicknesses, weights, and other structural features and properties for use with arrow points and arrow shafts of different structures and properties. In at least one example, the length $L_1$ of the arrow point alignment structure 1330 may be substantially longer than a length $L_2$ (see FIG. 24) of the tapered collar 1354, while in other embodiments the length $L_1$ is equal to or less than length $L_2$. In some arrangements, a greater length $L_1$ may provide additional aligning function along a length of the arrow shaft 1320 due to the increase in the amount of surface area along the inner surface 1336 of the arrow point alignment structure 1330.

Other types of arrow points besides the broadhead arrow point 1350 shown with reference to FIGS. 20-25 may benefit from an arrow point alignment structure having at least some features and functionality of the arrow point alignment structure 1330 described with reference to FIGS. 20-28. The replaceability of the arrow point alignment structure 1330 for a given arrow point 1350 may be particularly useful when attempting to use the arrow point 1350 with arrow shafts 1320 of different outer diameters $D_1$.

The arrow apparatus 1300 may be assembled by first connecting together the arrow point alignment structure 1330 to the arrow point 1350 to provide an arrow point assembly 1310. The arrow point alignment structure 1330 may be connected to the arrow point 1350 by inserting at least a portion of the arrow point alignment structure 1330 into a cavity or recess of the arrow point 1350. As described above, one embodiment provides a snap-fit connection between arrow point alignment structure 1330 and the arrow point 1350. The arrow point alignment structure 1330 and arrow point 1350 may include mating tapered surfaces that provide at least some alignment and/or centering between the arrow point alignment structure 1330 and arrow point 1350, and between the arrow point 1350 and arrow shaft 1320.

The arrow point assembly 1310 may be mounted or connected to the arrow shaft 1320 by inserting a central connection member comprising a shank portion 1356 of the arrow point 1350 into the arrow shaft 1320. The shank portion 1356 may be releasably connected to an insert 1340 positioned within the arrow shaft 1320. In one arrangement, a threaded portion 1357 of the shank portion 1356 may be threadably connected to internal threads of the insert 1340. The insert 1340 may be positioned spaced proximally from a distal end surface of the arrow shaft 1320 and may be referenced as a hidden insert.

A distal end of the arrow shaft 1320 may be concurrently inserted through the arrow point alignment structure 1330 while inserting the shank portion 1356 into the arrow shaft 1320. An internal surface of the arrow point alignment structure 1330 is positioned adjacent to, and at some locations in contact with, an outer surface of the arrow shaft 1320. Arrow point alignment structures 1330 of different internal diameters may be used with the arrow point 1350, so that the same arrow point 1350 may be used with different outer diameter arrow shafts.

The arrow point 1350 may contact the arrow shaft 1320 at spaced apart locations along a length of the arrow shaft 1320. For example, the leading end surface 1322 of the arrow shaft may contact the arrow point 1350 at a first contact point at the abutment shoulder 1359, and contact the arrow point 1350 at a second point at the arrow point alignment structure 1330 mounted to the tapered collar 1354. The contact points between the arrow shaft 1320 and arrow point 1350 may be defined as being axially or longitudinally spaced apart. Contact between the leading end surface 1322 and abutment shoulder 1359 may define one of the contact points rather than contact between the threads 1357 of the shank portion 1356 and the insert 1340. The contact points between the arrow shaft 1320 and the arrow point 1350 may be defined only as contact points with an exterior surface of the arrow shaft 1320.

Referring now to FIGS. 29-36, another example arrow apparatus 1400 is shown and described. The arrow apparatus 1400 includes an arrow shaft 1420, an arrow point alignment structure 1430, an insert 1440, and an arrow point 1450 (see FIGS. 29-31). The insert 1440 may be secured inside the arrow shaft 1420 and may be spaced a distance $X_1$ (see FIG. 31) from a distal end of the arrow shaft 1420. The distance $X_1$ is measured from a distal-most location of the insert 1440 to a distal end surface of the arrow shaft 1420.

Figure 31:
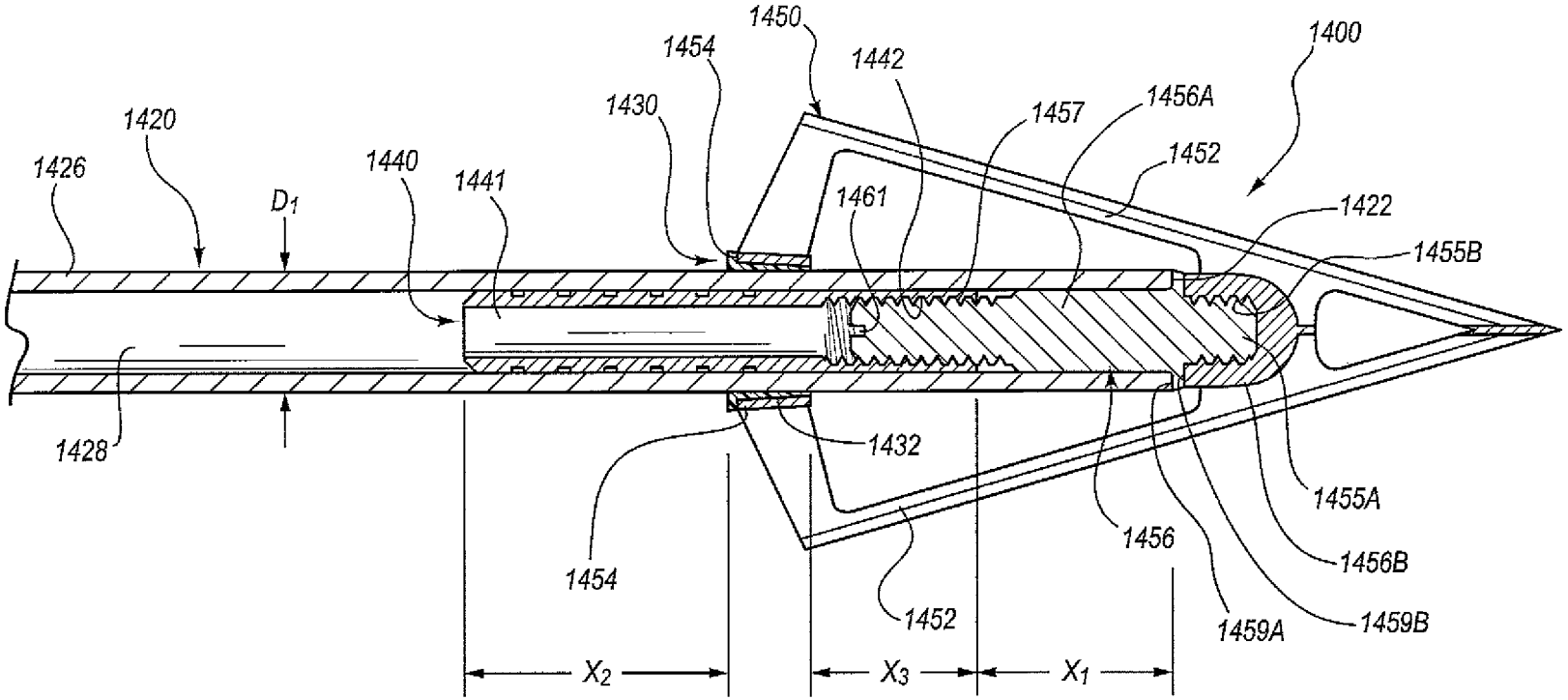
FIG. 31 is a cross-sectional side view of the arrow apparatus of FIG. 20.
Figure 33:
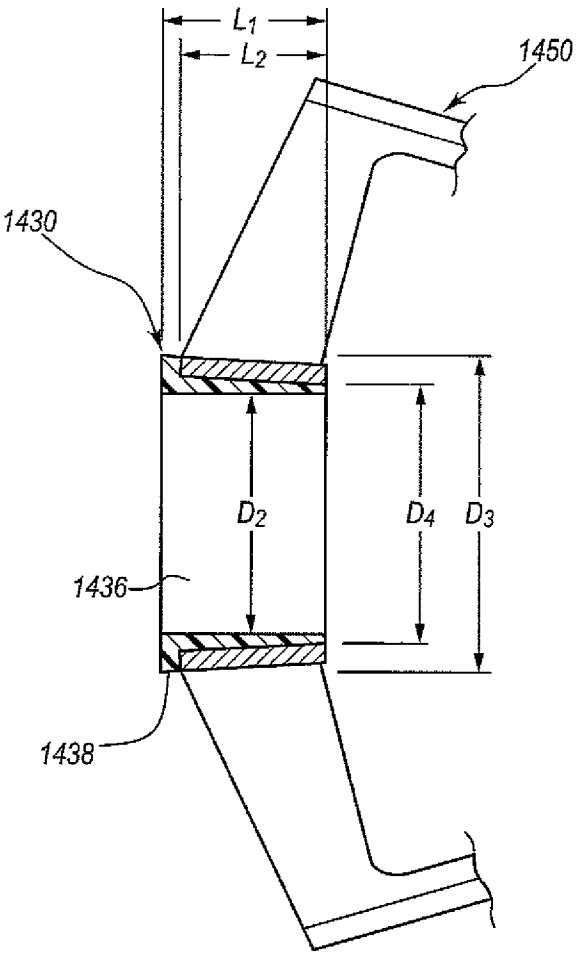
FIG. 33 is a detailed side view of the arrow point and arrow point alignment structure of FIG. 29 assembled.
Figure 32:
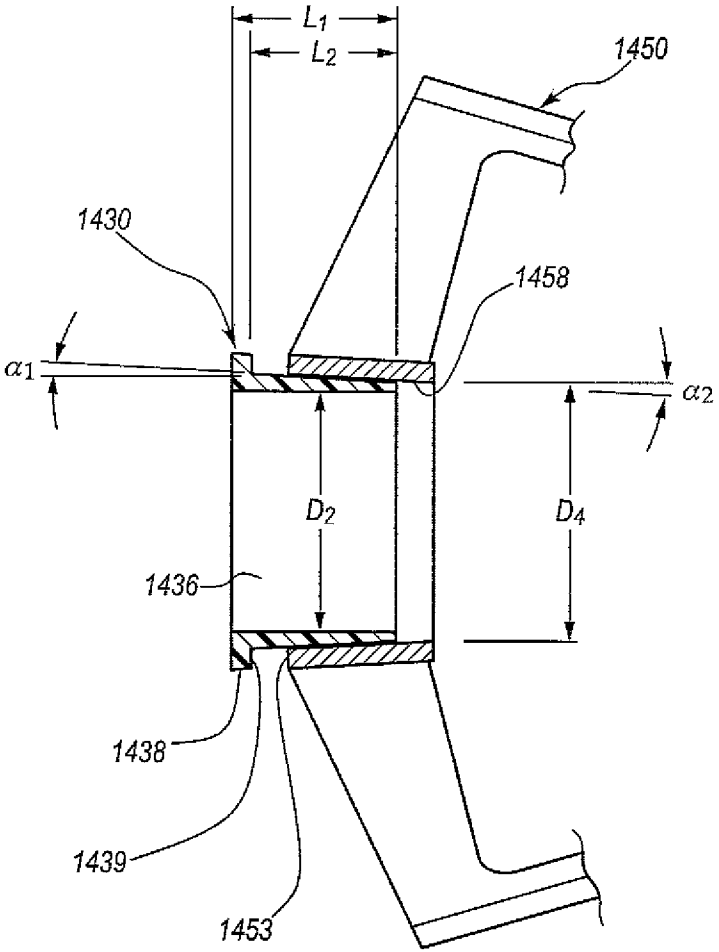
FIG. 32 is a detailed side view of the arrow point and arrow point alignment structure of the arrow apparatus of FIG. 29 partially disassembled.

The arrow point alignment structure 1430 may be connected to the arrow point 1450 as part of an arrow point assembly 1410 (see FIGS. 32 and 33). The arrow point assembly 1410 may be mounted to the arrow shaft 1420 by connecting the arrow point 1450 to the insert 1440. A proximal-most point of the insert 1440 is positioned a distance $X_2$ from a proximal-most point of the arrow point assembly 1410 when the arrow apparatus 1400 is assembled (see FIG. 31). In some arrangements the entire insert 1440 may be spaced proximal of the arrow point 1450. The distance $X_2$ may be equal to at least one diameter of arrow shaft 1420, and may alternatively be equal to two or more diameters of arrow shaft 1420.

Spacing a portion of the insert 1440 proximal of the arrow point assembly 1410 may help to avoid stress concentrations in the arrow shaft 1420 when transferring forces from the arrow point assembly 1410 to the arrow shaft 1420. In at least some arrangements, the distance $X_1$, the length of the insert 1440, or a combination of the distance $X_1$ and the length of the insert 1440 is designed to maximize the distance $X_2$ without adding unnecessary weight to the arrow apparatus 1400.

The arrow point alignment structure 1430 may be positioned over an exterior surface of the arrow shaft 1420. The arrow point alignment structure 1430 may slide over the arrow shaft 1420 when connecting/disconnecting the arrow point assembly 1410 relative to the insert 1440. An internal diameter of the arrow point alignment structure 1430 may be sized for a particular arrow shaft outer diameter. In one embodiment, a slight friction fit between the arrow point alignment structure 1430 and the outer surface 1426 of the shaft will be present, allowing relative axial movement by overcoming the small amount of friction. The materials of the arrow point alignment structure 1430 may provide some friction with the arrow shaft 1420. In one example, arrow point alignment structures 1430 of different sized internal diameter, but each having a common outer dimensions for interfacing with a given arrow point 1450, may be selected for arrow shafts of different outer diameters.

The arrow shaft 1420 may include a leading end surface 1422, an outer surface 1426, and an inner cavity 1428 (see FIG. 31). The arrow shaft 1420 may have an outer diameter $D_1$. The outer diameter $D_1$ may be constant along a length of the arrow shaft 1420. However, some arrow shaft constructions may have a tapered portion or have a variable outer diameter wherein the outer diameter $D_1$ may be different at various locations along a length of the arrow shaft 1420. The internal diameter of the arrow point alignment structure 1430 may be sized to substantially match the outer diameter $D_1$ at a location along a length of the arrow shaft 1420 where the arrow point alignment structure 1430 is expected to reside after the arrow point 1450 is positioned for use.

Figure 34:
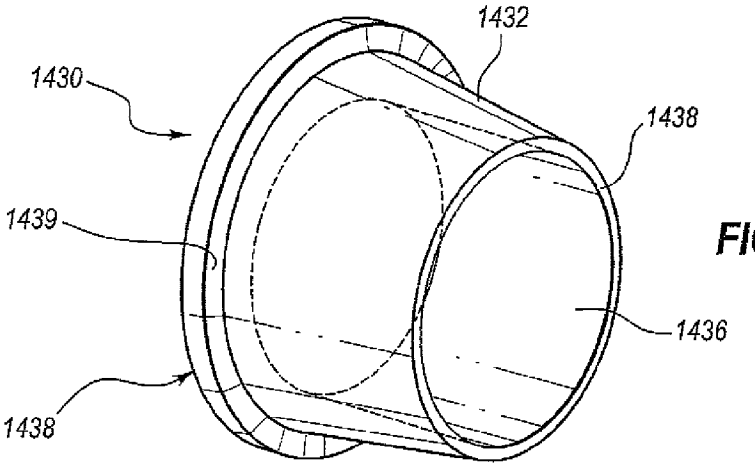
FIG. 34 is a perspective view of an arrow point alignment structure of the arrow apparatus of FIG. 29.
Figure 35:
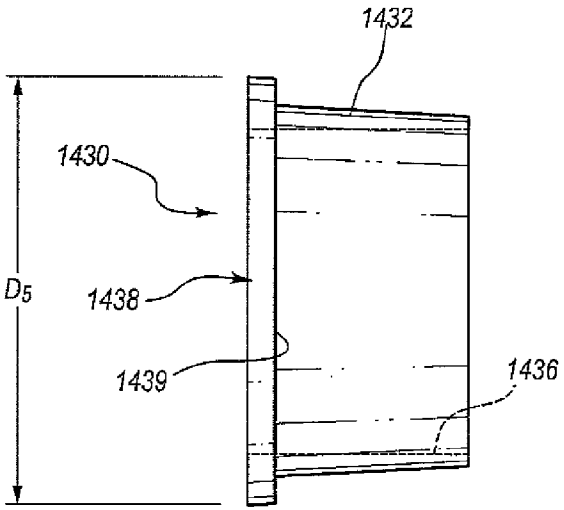
FIG. 35 is a side view of the arrow point alignment structure of FIG. 35.
Figure 36:
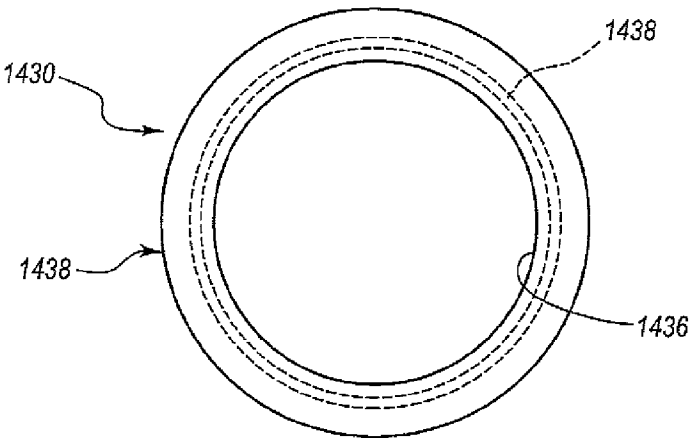
FIG. 36 is a front view of the arrow point alignment structure of FIG. 35.

The arrow point alignment structure 1430 is shown in detail in FIGS. 34-36. The arrow point alignment structure 1430 may include a tapered leading end 1432, an inner surface 1436, and a shoulder structure 1438 at a proximal end thereof. The shoulder structure 1438 may extend radially outward from the tapered surface defined by the tapered leading end 1432. The shoulder structure 1438 may provide a stop surface 1439 (FIGS. 32 and 34) against which a proximal surface 1453 of the arrow point 1450 contacts (see FIG. 31). The shoulder structure 1438 may be integrally formed with the tapered leading end 1432. The shoulder structure 1438 may define a maximum diameter or width dimension $D_5$ of the arrow point alignment structure 1430. The shoulder structure 1438 may also define a proximal surface of the arrow point alignment structure 1430.

The arrow point alignment structure 1430 may include an inner diameter $D_2$ along the inner surface 1436 (see FIGS. 32 and 33). The inner diameter $D_2$ may be constant. The inner diameter $D_2$ may be substantially similar to the outer diameter $D_1$ of the arrow shaft 1420, as mentioned. The inner diameter $D_2$ may only be slightly greater than the outer diameter $D_1$ to permit relative movement between the arrow point alignment structure 1430 and the arrow shaft 1420, whether or not the arrow point alignment structure 1430 is connected to the arrow point 1450, so that the arrangement provides shaft-enhanced rigidity and alignment to the arrow point 1450. In other arrangements, the inner diameter $D_2$ is the same or slightly smaller than the outer diameter $D_1$ to provide an interference fit between the arrow point alignment structure 1430 and the arrow shaft 1420.

The materials of the arrow point alignment structure 1430 may permit some compression, distortion or expansion of the inner diameter $D_2$ to permit relative movement between the arrow point alignment structure 1430 and the arrow shaft 1420 upon application of a force, while providing sufficient friction so that the arrow point alignment structure 1430 maintains its axial position relative to the arrow shaft 1420 when the force is removed. As such, after initial assembly of the arrow point 1450 to the shaft 1420, the alignment structure 1430 will remain in a desired location after removal of the arrow point 1450. The applied force may be an axially directed force component applied by the arrow point 1450 when mounting the arrow point 1450 onto the shaft via, for example, threaded engagement of the arrow point 1450 with the insert 1440.

The arrow point alignment structure 1430 (also referred to as a collar or bushing) may be manufactured from a variety of materials. It may be machined or injection molded using any of the materials, methods, and considerations described above related to arrow point alignment structure 1330. For example, the arrow point alignment structure 1430 may comprise a material that is more flexible or compliant such as, for example, a true rubber, a softer grade of polymer, such as a nylon without glass filling, certain polycarbonates or butyrates, or a thermoplastic elastomer (TPE). Examples of TPEs are DuPont EPTV™, Mitsubishi Primalloy™, and ExxonMobil Santoprene™. These types of materials accommodate a broader range of shaft ODs by stretching over the outside diameter. As such, they do not need to be bonded to the shaft. Depending upon the material chosen and its properties, the ID of the bushing might be from, for example, about 0.001 inch larger than the OD of the shaft, or it could be up to, for example, about 0.010 inches smaller.

The arrow point alignment structure 1430 may also have a maximum outer diameter $D_3$ defined by the shoulder structure 1438. The outer diameter $D_3$ is typically sized to limit relative axial movement between the arrow point alignment structure 1430 and the arrow point 1450 in at least one direction (e.g., a distal direction).

The arrow point 1450 may be constructed with broadhead features such as a plurality of blades 1452. The arrow point 1450 may also include a tapered collar 1454 having the minimum diameter $D_4$ (see FIG. 32), and a central connection member or portion comprising a shank portion 1456. The tapered collar 1454 defines a tapered portion or tapered surface 1458. The tapered surface 1458 may extend at a taper angle $\alpha_2$. A distal-most end of the insert 1440, to which the shank portion 1456 connects, may be spaced a distance $X_3$ (see. FIG. 31) from a distal end of tapered collar 1454 to help reduce stress concentrations in the arrow shaft 1420.

The shank portion 1456 may comprise a two-piece construction that includes an insert connection portion 1456A and a base portion 1456B. The insert connection portion 1456A and base portion 1456B may be threadably connected to each other. In one example, the insert connection portion 1456A includes a plurality of exterior threads 1457A, an abutment shoulder 1459A, and a threaded shank 1455A. The base portion 1456B includes a threaded bore 1455B that threadably mates with the threaded shank 1455A. A slot 1461 (see FIG. 31) may be formed in a proximal end of the insert connection portion 1456A to help connect the insert connection portion 1456A to the base portion 1456B during manufacturing (e.g., by using a screwdriver to rotatably connect the insert connection portion 1456A to the base portion 1456B together). In other embodiments, the insert connection portion 1456A and base portion 1456B are integrally formed as a single piece (e.g, see feature 1356 described above). In another embodiment (not shown), the shank portion 1456 may alternatively comprise an integral, one-piece portion that combines insert connection portion 1456A and base portion 1456B.

The external threads 1457A may be configured to threadably connect with internal threads of a threaded cavity 1441 of the insert 1440. A leading end 1442 of the insert 1440 is typically spaced a distance $X_1$ from the leading end surface 1422 of the arrow shaft 1420. Other example inserts for use with the arrow apparatus 1400 are disclosed in U.S. Pat. Nos. 7,004,859 and 7,115,055, which patents are hereby incorporated in their entireties by this reference.

The abutment shoulder 1459A is arranged and configured to contact the leading end surface 1422 of the arrow shaft 1420. Contact between the leading end surface 1422 and the abutment shoulder 1459A typically defines a final stop position or connection position of the arrow point 1450 relative to the arrow shaft 1420. In this final stop position, at least some of the external threads 1457A may remain outside of the insert 1440, or at least some of the threads of the threaded cavity 1441 are not engaged with the external threads 1457A. In other arrangements, all of the external threads 1457A are positioned within the insert 1440.

An interface between the leading end surface 1422 of the arrow shaft 1420 and the abutment shoulder 1459A of the arrow point 1450 is typically the only interface between the arrow shaft 1420 and the arrow point 1450 in a longitudinal direction. The only other contact along an outer surface 1426 of the arrow shaft 1420 is at the inner surface 1436 of the arrow point alignment structure 1430 at a location spaced proximal of the leading end surface 1422. The contact between the arrow point alignment structure 1430 and the arrow shaft 1420 is at least in part in the lateral direction. Thus, some of the lateral forces from the arrow point 1450 may be transferred to the arrow shaft via the arrow point alignment structure 1430. Furthermore, the angled construction of the shank portion 1456 may permit transfer of some axial forces in the arrow point 1450 to the arrow shaft 1420 via the arrow point alignment structure 1430.

The taper angle $\alpha_2$ of the arrow point 1450 is typically substantially the same as a taper angle $\alpha_1$ of the tapered leading end 1432 of the arrow point alignment structure 1430 (see FIG. 32). Providing the taper angles $\alpha_1$, $\alpha_2$ substantially the same may assist in providing axial alignment between the arrow point alignment structure 1430 and the arrow point 1450. Typically, the taper angles $\alpha_1$, $\alpha_2$ are in the range of about 10° to about 45°, and more preferably about 15° to about 30°.

The base portion 1456B may include an abutment shoulder 1459B. The abutment shoulder 1459B may contact the abutment shoulder 1459A of the insert connection portion 1456A to provide a position stop for connecting the insert connection portion 1456A to the base portion 1456B. The insert connection portion 1456A and base portion 1456B may be permanently connected together. Alternatively, the insert connection portion 1456A may be removably connected to the base portion 1456B to provide replacement of the insert connection portion 1456A for purposes of maintenance or accounting for different sizes, shapes, or designs of the insert 1440.

In at least one example, the arrow point 1450 is formed using a casting process wherein all features of the arrow point 1450 are formed in a single step. Other manufacturing processes such as stamping, grinding, cutting, and molding may be used to form the arrow point 1450. In one example, powder metal injection molding (MIM) may be used to form at least some portions of the arrow point 1450.

Some portions of the shank portion 1456 may be formed as a separate piece from the blades 1452, and the shank portion 1456 and blades 1452 may be connected in a separate assembly step. The shank portion 1456 may be connected to the blades 1452 using, for example and without limitation, welding (e.g., laser welding), adhesives, or other bonding techniques.

Providing the arrow point 1450 with a shank portion 1456 permits mounting of the arrow point 1450 to an arrow shaft 1420 having an insert 1440 mounted therein, and then replacing the arrow point 1450 with a different arrow point. The different arrow point may be constructed for use with the arrow shaft 1420 without the use of the arrow point alignment structure 1430. In one example, the arrow point 1450 may be replaced with a field point that also includes a shank portion having threads and an abutment shoulder that defines a stop position for the field point when mounted to the arrow shaft 1420.

The arrow point 1450 may comprise a metal material, metal alloy, or other material with sufficient strength and hardness properties such as various types of polymer or composite materials. The arrow point alignment structure 1430 may comprise, for example, a metal material or a polymer material, as will be understood by those skilled in the art. Portions of the blades 1452 may be removed (e.g., see cut out portions 1452A,B in FIG. 30) to, for example, help reduce weight in the arrow point, improve aerodynamic properties, or permit visualization of features that are otherwise more difficult to view.

The arrow point alignment structure 1430 may have various lengths, thicknesses, weights, and other structural features and properties for use with arrow points and arrow shafts of different structures and properties. In at least one example, the length $L_1$ of the arrow point alignment structure 1430 may be substantially longer than a length $L_2$ (see FIG. 32-33) of the tapered collar 1454, while in other embodiments the length $L_1$ is equal to or less than length $L_2$. In some arrangements, a greater length $L_1$ may provide additional aligning function along a length of the arrow shaft 1420 due to the increase in the amount of surface area along the inner surface 1436 of the arrow point alignment structure 1430.

Other types of arrow points besides the broadhead arrow point 1450 shown with reference to FIGS. 29-36 may be used in connection with an arrow point alignment structure having at least some features and functionality of the arrow point alignment structure 1430 described with reference to FIGS. 29-36. The replaceability of the arrow point alignment structure 1430 for a given arrow point 1450 may be particularly useful when attempting to use the arrow point 1450 with arrow shafts 1420 of different outer diameters $D_1$.

The arrow apparatus 1400 may be assembled by mounting the arrow point alignment structure 1430 on the arrow shaft 1420 at a location that is spaced distal of an expected final axial position of the arrow point alignment structure 1430 during use. The arrow point 1450 is then mounted to the arrow shaft 1420 by inserting a distal end of the arrow shaft 1420 through the tapered collar 1454 of the arrow point 1450 and inserting the shank portion 1456 into the interior 1428 of the arrow shaft 1420 and into contact with the insert 1440. The shank portion 1456 may be threadably connected to internal threads of the insert 1440 by rotating the arrow point 1450 in a clock-wise direction relative to the arrow shaft 1420 and insert 1440.

Rotatably mounting the arrow point 1450 to the arrow shaft 1420 and insert 1440 includes advancing the arrow point 1450 in a proximal direction, which moves the tapered surface 1458 of the tapered collar 1454 into contact with the tapered surface of the tapered leading end 1332 of the arrow point alignment structure 1430, and moves the proximal surface 1453 of the arrow point 1450 into contact with the shoulder structure 1438 of the arrow point alignment structure 1430. The arrow point 1450 is advanced proximally along the arrow shaft 1420 until the abutment shoulder 1459A of the shank portion 1456 contacts the leading end surface 1422 of the arrow shaft 1420. The arrow point 1450 should be in a "shooting" position when the abutment shoulder 1459A of the shank portion 1456 contacts the leading end surface 1422 of the arrow shaft 1420.

Removal of the arrow point 1450 from the arrow shaft 1420 may include rotating the arrow point 1450 in an opposite (or counter-clockwise) direction relative to the arrow shaft 1420 and insert 1440 to withdraw the arrow point 1450 distally. The arrow point alignment structure 1430 may maintain the same axial position on the arrow shaft 1420 during use of the arrow assembly 1400 and after removal of the arrow point 1450 due to friction between the outer surface of the arrow shaft and the arrow point alignment structure 1430. The arrow point alignment structure 1430 may be removed by applying a force to the arrow point alignment structure 1430 in a distal direction.

The arrow point 1450 may contact with the arrow shaft 1420 at spaced apart locations along a length of the arrow shaft 1420. For example, the leading end surface 1422 of the arrow shaft may contact the arrow point 1450 at a first contact point at the abutment shoulder 1459, and contact the arrow point 1450 at a second point at the arrow point alignment structure 1430 mounted to the tapered collar 1454. The contact points between the arrow shaft 1420 and arrow point 1450 may be defined as being axially or longitudinally spaced apart. Contact between the leading end surface 1422 and abutment shoulder 1459 may define one of the contact points rather than contact between the threads 1457 of the shank portion 1456 and the insert 1440. The contact points between the arrow shaft 1420 and the arrow point 1450 may be defined only as contact points with an exterior surface of the arrow shaft 1420.

The arrow point 1450 may be referred to as a ferrule-less arrow point, or an arrow point that is free or void of a ferrule structure. A ferrule-less arrow point may provide an improved distribution of forces to the arrow shaft by connecting to the arrow shaft at multiple locations and at locations that are spaced proximal of a distal end of the arrow shaft.

It is desired that the embodiments described herein be considered in all respects illustrative and not restrictive and that reference be made to the appended claims and their equivalents for determining the scope of the instant disclosure. For ease of use, the words "including" and "having," as used in the specification and claims, are interchangeable with and have the same meaning as the word "comprising."

What is claimed is:

1. An arrow apparatus, comprising:

a hollow arrow shaft having an outer surface, an interior, and a leading end surface;

an arrow point alignment structure positioned on the outer surface of the arrow shaft at a location proximal of the leading end surface of the arrow shaft, the arrow point alignment structure comprising a tapered portion;

an arrow point in contact with the tapered portion of the arrow point alignment structure;

a central connection member extending into the interior of the arrow shaft.

2. The arrow apparatus of claim 1, wherein the entire arrow point alignment structure is spaced proximal of the leading end surface of the arrow shaft.

3. The arrow apparatus of claim 1, wherein the central connection member is permanently connected to the arrow point.

4. The arrow apparatus of claim 3, wherein the central connection member includes a shank portion and an abutment shoulder, the shank portion including a plurality of threads, the abutment shoulder arranged to contact the leading end surface of the arrow shaft.

5. The arrow apparatus of claim 4, further comprising an insert disposed within the interior of the arrow shaft at a location proximal of the leading end surface, the insert being configured to releasable connect to the central connection member.

6. The arrow apparatus of claim 5, wherein the insert includes a proximal end and as distal end, the distal end being spaced proximal of the leading end surface of the arrow shaft, and the proximal end of the insert being spaced proximally of a proximal end of the arrow point alignment structure.

7. The arrow apparatus of claim 5, wherein a proximal end of the insert is spaced proximally of a proximal end of the arrow point alignment structure a distance at least as great as a diameter of the arrow shaft.

8. The arrow apparatus of claim 1, wherein the arrow point alignment structure is movable relative to the outer surface of the arrow shaft.

9. The arrow apparatus of claim 1, wherein the arrow point alignment structure is connected to the arrow point with a snap-fit connection.

10. The arrow apparatus of claim 1, wherein the arrow point is a broadhead and comprises a collar, the collar being configured to receive and contact at least a tapered portion of the arrow point alignment structure.

11. The arrow apparatus of claim 10, wherein the collar defines a tapered surface arranged to contact the tapered portion of the arrow point alignment structure.

12. The arrow apparatus of claim 1, wherein the arrow point alignment structure contacts the outer surface of the arrow shaft.

13. The arrow apparatus of claim 11, wherein the tapered surface of the collar has a taper angle that is the same as a taper angle of the tapered portion of the arrow point alignment structure.

14. An arrow point assembly for attachment to an arrow shaft, the arrow point assembly comprising:

a leading end;

a trailing end;

a central connection portion having a threaded shaft and an abutment shoulder, the threaded shaft being insertable into an arrow shaft, and the abutment shoulder being arranged to contact a leading end surface of the arrow shaft;

a tapered aperture defined within the arrow point assembly proximate the trailing end, the tapered aperture defining a tapered surface;

wherein the tapered surface of the tapered aperture is configured to contact a corresponding tapered surface of an arrow point alignment structure that is in contact with an outer surface of the arrow shaft.

15. The arrow point assembly of claim 14, wherein the arrow point alignment structure is connected to the arrow point assembly.

16. The arrow point assembly of claim 14, wherein the arrow point assembly comprises a broadhead and comprises a tapered collar that defines the tapered aperture.

17. The arrow point assembly of claim 14, wherein the abutment shoulder and tapered surface are axially spaced apart.

18. A method of assembling an arrow apparatus, comprising:

providing a hollow arrow shaft, an arrow point, and an arrow point alignment structure, the arrow shaft having an interior, an outer surface, and a leading end surface, the arrow point having axially spaced apart first and second contact points, the second contact point having a tapered portion, the arrow point alignment structure having a tapered portion;

positioning the arrow point alignment structure spaced proximally of the leading end surface of the arrow shaft in contact with the outer surface of the arrow shaft;

positioning the arrow point in contact with the leading end surface of the arrow shaft at the first contact point and in contact with the tapered portion of the arrow point alignment structure at the tapered portion of the second contact point to axially align the arrow point alignment structure with the arrow shaft.

19. The method of claim 18, wherein the arrow point includes a tapered aperture defining a tapered surface within the arrow point, and positioning the arrow point in contact with the tapered portion of the arrow point alignment structure includes contacting the tapered portion of the arrow point alignment structure with the tapered surface.

20. The method of claim 18, further comprising:

providing an arrow shaft insert and a central connection member, the central connection member being connected to the arrow point and having an abutment shoulder that defines the first contact point;

disposing the insert within the interior of the arrow shaft spaced proximally of the leading end surface of the arrow shaft;

inserting the central connection member into the interior of the arrow shaft and releasably connecting the central connection member with the insert.

21. The method of claim 20, further comprising permanently affixing the central connection member to the arrow point.

22. The method of claim 18, further comprising affixing the arrow point alignment structure to the arrow point.

23. A broadhead arrow point assembly, comprising:

a broadhead arrow point having a threaded shank and a collar, the collar defining a collar aperture, and the threaded shank being insertable into an arrow shaft to which the broadhead arrow point assembly is mounted;

an arrow point alignment structure having a tapered portion, the tapered portion being in contact with the collar aperture, the arrow point alignment structure being configured to align axially the broadhead arrow point with an arrow shaft to which the broadhead arrow point is mounted.

24. The broadhead arrow point assembly of claim 23, wherein the collar aperture includes a tapered surface that contacts the tapered portion of the arrow point alignment structure.

25. The broadhead arrow point assembly of claim 23, wherein when the broadhead arrow point is mounted to an arrow shaft, the arrow point alignment structure contacts an outer surface of the arrow shaft.

26. The broadhead arrow point assembly of claim 23, wherein the broadhead arrow point includes a distal end portion and a proximal end portion, the threaded shank extending proximally from the distal end portion and the collar being positioned at the distal end portion at a location axially spaced apart from the threaded shank.

27. The broadhead arrow point assembly of claim 23, wherein the arrow point alignment structure comprises a molded thermoplastic elastomer material.

28. A method of assembling an arrow apparatus, comprising:

providing an arrow shaft, an arrow point, and an arrow point alignment structure, the arrow shaft having an outer surface, the arrow point having a first tapered portion, the arrow point alignment structure having a second tapered portion;

positioning the arrow point alignment structure on the outer surface of the arrow shaft;

inserting the arrow shaft through a portion of the arrow point to contact the first and second tapered portions;

threadably connecting the arrow point to the arrow shaft;

wherein as the arrow point is threadably connected to the arrow shaft, the arrow point alignment structure is urged proximally overcoming friction between the arrow point alignment structure and the outer surface of the arrow shaft until the arrow point attains an operation position relative to the arrow shaft.

29. The method of claim 28, wherein the arrow point alignment structure comprises a thermoplastic elastomer.

30. The method of claim 28, wherein when the arrow point is threadably removed from the arrow shaft, the arrow point alignment structure maintains an axial position along the arrow shaft.

31. The method of claim 28, wherein the arrow point includes a threaded shank and the arrow shaft includes an insert having a threaded bore, wherein threadably connecting the arrow point to the arrow shaft includes theadably engaging the threaded shank with the threaded bore.

32. An arrow apparatus, comprising:

a hollow arrow shaft having an outer surface, an interior, and a leading end;

an arrow point alignment structure positioned on the outer surface of the arrow shaft at a location spaced proximal of the leading end surface of the arrow shaft, the arrow point alignment structure comprising a tapered portion;

a broadhead arrow point having a plurality of blades and being supported at the leading end of the arrow shaft and at the tapered portion of the arrow point alignment structure, the plurality of blades extending proximal of the leading end of the arrow shaft.

33. The arrow apparatus of claim 32, wherein the arrow point alignment structure includes a shoulder member positioned at a proximal end thereof, the shoulder member defining a stop surface against which a proximal surface of the broadhead arrow contacts.

34. The arrow apparatus of claim 33, wherein the proximal surface of the broadhead arrow contacts the shoulder member to move the arrow point alignment structure axially when mounting the broadhead arrow point to the arrow shaft.

35. The arrow apparatus of claim 32, wherein the arrow point alignment structure comprises thermoplastic elastomer material.

36. The arrow apparatus of claim 32, wherein the broadhead arrow point is a void of ferrule structures.

37. The arrow apparatus of claim 32, further comprising an insert including a threaded bore and positioned within the interior of the arrow shaft, and the broadhead arrow point includes a threaded shank positioned distal of a proximal end of the broadhead arrow point that threadably engages the threaded bore of the insert.

38. The arrow apparatus of claim 32, wherein the tapered portion of the arrow point alignment structure includes a continuous, smooth surface.

39. The arrow apparatus of claim 32, wherein the arrow point alignment structure includes an arrow bore sized to receive the arrow shaft and provide an interference fit with the outer surface of the arrow shaft.

40. The arrow apparatus of claim 39, wherein the arrow bore is adjustable in diameter to fit arrow shafts of different outer diameter.

41. The arrow apparatus of claim 32, wherein the broadhead arrow point includes a threaded shank extending in a proximal direction, wherein the threaded shank includes a slot formed in a proximal end thereof sized to receive a screwdriver head.

42. A method of assembling an arrow apparatus, comprising:

providing a hollow arrow shaft, an arrow point, an arrow point alignment structure, an arrow shaft insert and a central connection member, the arrow shaft having an interior, an outer surface, and a leading end surface, the arrow point having axially spaced apart first and second contact points, the arrow point alignment structure having a tapered portion, the central connection member being connected to the arrow point and having an abutment shoulder that defines the first contact point;

positioning the arrow point alignment structure spaced proximally of the leading end surface of the arrow shaft in contact with the outer surface of the arrow shaft;

positioning the arrow point in contact with the leading end surface of the arrow shaft at the first contact point and in contact with the tapered portion of the arrow point alignment structure at the second contact point to axially align the arrow point alignment structure with the arrow shaft;

disposing the insert within the interior of the arrow shaft spaced proximally of the leading end surface of the arrow shaft;

inserting the central connection member into the interior of the arrow shaft and releasably connecting the central connection member with the insert.

43. A broadhead arrow point assembly, comprising:

a broadhead arrow point having a threaded shank and a collar, the collar defining a collar aperture;

an arrow point alignment structure having a tapered portion, the tapered portion being in contact with the collar aperture, the arrow point alignment structure being configured to align axially the broadhead arrow point with an arrow shaft to which the broadhead arrow point is mounted;

wherein the broadhead arrow point includes a distal end portion and a proximal end portion, the threaded shank extending proximally from the distal end portion and the collar being positioned at the distal end portion at a location axially spaced apart from the threaded shank.

44. An arrow apparatus, comprising:

a hollow arrow shaft having an outer surface, an interior, and a leading end;

an arrow point alignment structure positioned on the outer surface of the arrow shaft at a location spaced proximal of the leading end surface of the arrow shaft, the arrow point alignment structure comprising a tapered portion;

a broadhead arrow point supported at the leading end of the arrow shaft and at the tapered portion of the arrow point alignment structure;

wherein the arrow point alignment structure includes a shoulder member positioned at a proximal end thereof, the shoulder member defining a stop surface against which a proximal surface of the broadhead arrow contacts.

45. The arrow apparatus of claim 44, wherein the proximal surface of the broadhead arrow contacts the shoulder member to move the arrow point alignment structure axially when mounting the broadhead arrow point to the arrow shaft.

46. An arrow apparatus, comprising:

a hollow arrow shaft having an outer surface, an interior, and a leading end;

an arrow point alignment structure positioned on the outer surface of the arrow shaft at a location spaced proximal of the leading end surface of the arrow shaft, the arrow point alignment structure comprising a tapered portion;

a broadhead arrow point supported at the leading end of the arrow shaft and at the tapered portion of the arrow point alignment structure;

wherein the broadhead arrow point is a void of ferrule structures.

47. An arrow apparatus, comprising:

a hollow arrow shaft having an outer surface, an interior, and a leading end;

an arrow point alignment structure positioned on the outer surface of the arrow shaft at a location spaced proximal of the leading end surface of the arrow shaft, the arrow point alignment structure comprising a tapered portion;

a broadhead arrow point supported at the leading end of the arrow shaft and at the tapered portion of the arrow point alignment structure;

an insert including a threaded bore and positioned within the interior of the arrow shaft, and the broadhead arrow point includes a threaded shank positioned distal of a proximal end of the broadhead arrow point that threadably engages the threaded bore of the insert.

48. An arrow apparatus, comprising:

a hollow arrow shaft having an outer surface, an interior, and a leading end;

an arrow point alignment structure positioned on the outer surface of the arrow shaft at a location spaced proximal of the leading end surface of the arrow shaft, the arrow point alignment structure comprising a tapered portion;

a broadhead arrow point supported at the leading end of the arrow shaft and at the tapered portion of the arrow point alignment structure;

wherein the arrow point alignment structure includes an arrow bore sized to receive the arrow shaft and provide an interference fit with the outer surface of the arrow shaft, and the arrow bore is adjustable in diameter to fit arrow shafts of different outer diameter.

49. An arrow apparatus, comprising:

a hollow arrow shaft having an outer surface, an interior, and a leading end;

an arrow point alignment structure positioned on the outer surface of the arrow shaft at a location spaced proximal of the leading end surface of the arrow shaft, the arrow point alignment structure comprising a tapered portion;

a broadhead arrow point supported at the leading end of the arrow shaft and at the tapered portion of the arrow point alignment structure;

wherein the broadhead arrow point includes a threaded shank extending in a proximal direction, wherein the threaded shank includes a slot formed in a proximal end thereof sized to receive a screwdriver head.

* * * * *